US009140476B2

(12) United States Patent
Eckhoff et al.

(10) Patent No.: US 9,140,476 B2
(45) Date of Patent: Sep. 22, 2015

(54) TEMPERATURE-CONTROLLED STORAGE SYSTEMS

(71) Applicant: Tokitae LLC, Bellevue, WA (US)

(72) Inventors: Philip A. Eckhoff, Bellevue, WA (US); William Gates, Medina, WA (US); Roderick A. Hyde, Redmond, WA (US); Edward K. Y. Jung, Bellevue, WA (US); Nathan P. Myhrvold, Medina, WA (US); Nels R. Peterson, Bellevue, WA (US); Clarence T. Tegreene, Mercer Island, WA (US); Charles Whitmer, North Bend, WA (US); Lowell L. Wood, Jr., Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 306 days.

(21) Appl. No.: 13/853,245

(22) Filed: Mar. 29, 2013

(65) Prior Publication Data

US 2013/0306656 A1 Nov. 21, 2013

Related U.S. Application Data

(63) Continuation-in-part of application No. 12/001,757, filed on Dec. 11, 2007, and a continuation-in-part of application No. 12/006,089, filed on Dec. 27, 2007, and a continuation-in-part of application No.

(Continued)

(51) Int. Cl.
*F25D 23/12* (2006.01)
*F25D 3/12* (2006.01)

(Continued)

(52) U.S. Cl.
CPC ..... *F25D 3/125* (2013.01); *B65D 51/1644* (2013.01); *B65D 81/3802* (2013.01);

(Continued)

(58) Field of Classification Search
CPC ..... F24F 5/0035; Y02B 30/545; F28D 5/00; F25D 3/08
USPC ..... 62/216, 271, 304, 314, 457.2, 259.4
See application file for complete search history.

(56) References Cited

U.S. PATENT DOCUMENTS 520,584 A 5/1894 Turner
1,903,171 A * 3/1933 Cordrey ..... 62/385

(Continued)

FOREIGN PATENT DOCUMENTS

CN 2414742 Y 1/2001
CN 2460457 Y 11/2001

(Continued)

OTHER PUBLICATIONS

U.S. Appl. No. 13/720,328, Hyde et al.

(Continued)

*Primary Examiner* — Melvin Jones

(57) ABSTRACT

In some embodiments, a substantially thermally sealed storage container includes an outer assembly and an evaporative cooling assembly integral to the container. In some embodiments, the outer assembly includes one or more sections of ultra efficient insulation material substantially defining at least one thermally-controlled storage region, and a single access conduit to the at least one thermally-controlled storage region. In some embodiments, the evaporative cooling assembly integral to the container includes: an evaporative cooling unit affixed to a surface of the at least one thermally-controlled storage region; a desiccant unit affixed to an external surface of the container; a vapor conduit, the vapor conduit including a first end and a second end, the first end attached to the evaporative cooling unit, the second end attached to the desiccant unit; and a vapor control unit attached to the vapor conduit.

38 Claims, 11 Drawing Sheets

Related U.S. Application Data

12/658,579, filed on Feb. 8, 2010, and a continuation-in-part of application No. 12/927,981, filed on Nov. 29, 2010, and a continuation-in-part of application No. 12/927,982, filed on Nov. 29, 2010, and a continuation-in-part of application No. 13/135,126, filed on Jun. 23, 2011, now Pat. No. 8,887,944, and a continuation-in-part of application No. 13/200,555, filed on Sep. 23, 2011, and a continuation-in-part of application No. 13/385,088, filed on Jan. 31, 2012, which is a continuation of application No. 12/006,088, filed on Dec. 27, 2007, now Pat. No. 8,215,518.

(51) Int. Cl.
*B65D 81/38* (2006.01)
*B65D 51/16* (2006.01)

(52) U.S. Cl.
CPC ..... *B65D81/3811* (2013.01); *B65D 81/3813* (2013.01); *B65D 81/3823* (2013.01); *B65D 81/3825* (2013.01); *B65D 81/3834* (2013.01); *B65D 81/3837* (2013.01); *B65D 81/3888* (2013.01); *B65D 81/3897* (2013.01); *B65D 2203/10* (2013.01)

(56) References Cited

U.S. PATENT DOCUMENTS 2,161,295 A 6/1939 Hirschberg
2,496,296 A 2/1950 Lobl
2,717,937 A 9/1955 Lehr et al.
2,967,152 A 1/1961 Matsch et al.
3,029,967 A * 4/1962 Morrison ..... 220/592.11
3,034,845 A 5/1962 Haumann
3,069,045 A * 12/1962 Haumann et al. ..... 220/592.27
3,108,840 A 10/1963 Conrad et al.
3,238,002 A * 3/1966 O'Connell et al. ..... 312/400
3,921,844 A 11/1975 Walles
3,948,411 A 4/1976 Conte
4,003,426 A 1/1977 Best et al.
4,034,129 A 7/1977 Kittle
4,057,029 A 11/1977 Seiter
4,057,101 A 11/1977 Ruka et al.
4,094,127 A 6/1978 Romagnoli
4,154,363 A * 5/1979 Barthel ..... 220/560.12
4,184,601 A 1/1980 Stewart et al.
4,312,669 A 1/1982 Boffito et al.
4,318,058 A 3/1982 Mito et al.
4,358,490 A 11/1982 Nagai
4,388,051 A 6/1983 Dresler et al.
4,402,927 A 9/1983 Von Dardel et al.
4,428,854 A 1/1984 Enjo et al.
4,481,779 A 11/1984 Barthel
4,481,792 A 11/1984 Groeger et al.
4,482,465 A 11/1984 Gray
4,521,800 A 6/1985 Howe
4,526,015 A 7/1985 Laskaris
4,640,574 A 2/1987 Unger
4,726,974 A 2/1988 Nowobilski et al.
4,766,471 A 8/1988 Ovshinsky et al.
4,796,432 A 1/1989 Fixsen et al.
4,810,403 A 3/1989 Bivens et al.
4,855,950 A 8/1989 Takada
4,862,674 A 9/1989 Lejondahl et al.
4,920,387 A 4/1990 Takasu et al.
4,951,014 A 8/1990 Wohlert et al.
4,955,204 A 9/1990 Pehl et al.
4,956,976 A 9/1990 Kral et al.
4,969,336 A 11/1990 Knippscheer et al.
4,974,423 A 12/1990 Pring
4,976,308 A 12/1990 Faghri
5,012,102 A 4/1991 Gowlett
5,103,337 A 4/1992 Schrenk et al.
5,116,105 A 5/1992 Hong
5,138,559 A 8/1992 Kuehl et al.
5,187,116 A 2/1993 Kitagawa et al.
5,215,214 A 6/1993 Lev et al.
5,245,869 A 9/1993 Clarke et al.
5,261,241 A 11/1993 Kitahara et al.
5,277,031 A 1/1994 Miller et al.
5,277,959 A 1/1994 Kourtides et al.
5,302,840 A 4/1994 Takikawa
5,330,816 A 7/1994 Rusek, Jr.
5,355,684 A 10/1994 Guice
5,376,184 A 12/1994 Aspden
5,390,734 A 2/1995 Voorhes et al.
5,390,791 A 2/1995 Yeager
5,444,223 A 8/1995 Blama
5,452,565 A 9/1995 Blom et al.
5,505,046 A 4/1996 Nelson et al.
5,548,116 A 8/1996 Pandelisev
5,563,182 A 10/1996 Epstein et al.
5,573,133 A 11/1996 Park
5,580,522 A 12/1996 Leonard et al.
5,590,054 A 12/1996 McIntosh
5,600,071 A 2/1997 Sooriakumar et al.
5,607,076 A 3/1997 Anthony
5,633,077 A 5/1997 Olinger
5,671,856 A 9/1997 Lisch
5,679,412 A 10/1997 Kuehnle et al.
5,709,472 A 1/1998 Prusik et al.
5,782,344 A 7/1998 Edwards et al.
5,800,905 A 9/1998 Sheridan et al.
5,821,762 A 10/1998 Hamaguchi et al.
5,829,594 A 11/1998 Warder
5,846,224 A 12/1998 Sword et al.
5,846,883 A 12/1998 Moslehi
5,857,778 A 1/1999 Ells
5,900,554 A 5/1999 Baba et al.
5,915,283 A 6/1999 Reed et al.
5,954,101 A 9/1999 Drube et al.
6,030,580 A 2/2000 Raasch et al.
6,042,264 A 3/2000 Prusik et al.
6,050,598 A 4/2000 Upton
6,209,343 B1 4/2001 Owen
6,212,904 B1 4/2001 Arkharov et al.
6,213,339 B1 4/2001 Lee
6,234,341 B1 5/2001 Tattam
6,272,679 B1 8/2001 Norin
6,287,652 B2 9/2001 Speckhals et al.
6,321,977 B1 11/2001 Lee
6,337,052 B1 1/2002 Rosenwasser
6,438,992 B1 8/2002 Smith et al.
6,439,406 B1 8/2002 Duhon
6,453,749 B1 9/2002 Petrovic et al.
6,465,366 B1 10/2002 Nemani et al.
6,467,642 B2 10/2002 Mullens et al.
6,485,805 B1 11/2002 Smith et al.
6,521,077 B1 2/2003 McGivern et al.
6,571,971 B1 6/2003 Weiler
6,584,797 B1 7/2003 Smith et al.
6,624,349 B1 9/2003 Bass
6,673,594 B1 1/2004 Owen et al.
6,688,132 B2 2/2004 Smith et al.
6,692,695 B1 2/2004 Bronshtein et al.
6,701,724 B2 3/2004 Smith et al.
6,742,650 B2 6/2004 Yang et al.
6,742,673 B2 6/2004 Credle, Jr. et al.
6,751,963 B2 6/2004 Navedo et al.
6,771,183 B2 8/2004 Hunter
6,806,808 B1 10/2004 Watters et al.
6,813,330 B1 11/2004 Barker et al.
6,841,917 B2 1/2005 Potter
6,877,504 B2 4/2005 Schreff et al.
6,967,051 B1 11/2005 Augustynowicz et al.
6,997,241 B2 2/2006 Chou et al.
7,001,656 B2 2/2006 Maignan et al.
7,038,585 B2 5/2006 Hall et al.
7,128,807 B2 10/2006 Mörschner et al.
7,240,513 B1 7/2007 Conforti
7,253,788 B2 8/2007 Choi et al.
7,258,247 B2 8/2007 Marquez

(56) References Cited

U.S. PATENT DOCUMENTS

| | | | |
|---|---|---|---|
| 7,267,795 | B2 | 9/2007 | Ammann et al. |
| 7,278,278 | B2 | 10/2007 | Wowk et al. |
| 7,596,957 | B2 | 10/2009 | Fuhr et al. |
| 7,789,258 | B1 | 9/2010 | Anderson |
| 7,807,242 | B2 | 10/2010 | Soerensen et al. |
| 7,982,673 | B2 | 7/2011 | Orton et al. |
| 8,074,271 | B2 | 12/2011 | Davis et al. |
| 8,138,913 | B2 | 3/2012 | Nagel et al. |
| 8,174,369 | B2 | 5/2012 | Jones et al. |
| 8,211,516 | B2 | 7/2012 | Bowers et al. |
| 2002/0050514 | A1 | 5/2002 | Schein |
| 2002/0083717 | A1 | 7/2002 | Mullens et al. |
| 2002/0084235 | A1 | 7/2002 | Lake |
| 2002/0130131 | A1 | 9/2002 | Zucker et al. |
| 2002/0155699 | A1 | 10/2002 | Ueda |
| 2002/0187618 | A1 | 12/2002 | Potter |
| 2003/0039446 | A1 | 2/2003 | Hutchinson et al. |
| 2003/0072687 | A1 | 4/2003 | Nehring et al. |
| 2003/0148773 | A1 | 8/2003 | Spriestersbach et al. |
| 2003/0160059 | A1 | 8/2003 | Credle, Jr. et al. |
| 2004/0035120 | A1 | 2/2004 | Brunnhofer |
| 2004/0055313 | A1 | 3/2004 | Navedo et al. |
| 2004/0055600 | A1 | 3/2004 | Izuchukwu |
| 2004/0103302 | A1 | 5/2004 | Yoshimura et al. |
| 2004/0145533 | A1 | 7/2004 | Taubman |
| 2005/0009192 | A1 | 1/2005 | Page |
| 2005/0029149 | A1 | 2/2005 | Leung et al. |
| 2005/0053345 | A1 | 3/2005 | Bayindir et al. |
| 2005/0067441 | A1 | 3/2005 | Alley |
| 2005/0143787 | A1 | 6/2005 | Boveja et al. |
| 2005/0188715 | A1 | 9/2005 | Aragon |
| 2005/0247312 | A1 | 11/2005 | Davies |
| 2005/0255261 | A1 | 11/2005 | Nomula |
| 2005/0274378 | A1 | 12/2005 | Bonney et al. |
| 2006/0021355 | A1 | 2/2006 | Boesel et al. |
| 2006/0027467 | A1 | 2/2006 | Ferguson |
| 2006/0054305 | A1 | 3/2006 | Ye |
| 2006/0071585 | A1 | 4/2006 | Wang |
| 2006/0150662 | A1 | 7/2006 | Lee et al. |
| 2006/0187026 | A1 | 8/2006 | Kochis |
| 2006/0191282 | A1 | 8/2006 | Sekiya et al. |
| 2006/0196876 | A1 | 9/2006 | Rohwer |
| 2006/0259188 | A1 | 11/2006 | Berg |
| 2006/0280007 | A1 | 12/2006 | Ito et al. |
| 2007/0041814 | A1 | 2/2007 | Lowe |
| 2007/0210090 | A1 | 9/2007 | Sixt et al. |
| 2008/0012577 | A1 | 1/2008 | Potyrailo et al. |
| 2008/0022698 | A1 | 1/2008 | Hobbs et al. |
| 2008/0060215 | A1 | 3/2008 | Reilly et al. |
| 2008/0129511 | A1 | 6/2008 | Yuen et al. |
| 2008/0164265 | A1 | 7/2008 | Conforti |
| 2008/0184719 | A1 | 8/2008 | Lowenstein |
| 2008/0186139 | A1 | 8/2008 | Butler et al. |
| 2008/0233391 | A1 | 9/2008 | Sterzel et al. |
| 2008/0269676 | A1 | 10/2008 | Bieberich et al. |
| 2008/0272131 | A1 | 11/2008 | Roberts et al. |
| 2008/0297346 | A1 | 12/2008 | Brackmann et al. |
| 2009/0049845 | A1 | 2/2009 | McStravick et al. |
| 2009/0275478 | A1 | 11/2009 | Atkins et al. |
| 2009/0301125 | A1 | 12/2009 | Myles et al. |
| 2009/0309733 | A1 | 12/2009 | Moran et al. |
| 2010/0016168 | A1 | 1/2010 | Atkins et al. |
| 2010/0028214 | A1 | 2/2010 | Howard et al. |
| 2010/0265068 | A1 | 10/2010 | Brackmann et al. |
| 2010/0287963 | A1 | 11/2010 | Billen et al. |
| 2011/0100605 | A1 | 5/2011 | Zheng et al. |
| 2011/0117538 | A1 | 5/2011 | Niazi |
| 2011/0297306 | A1 | 12/2011 | Yang |
| 2012/0168645 | A1 | 7/2012 | Atzmony et al. |
| 2013/0306656 | A1 | 11/2013 | Eckhoff et al. |

FOREIGN PATENT DOCUMENTS

| | | | |
|---|---|---|---|
| CN | 1496537 | A | 5/2004 |
| CN | 1756912 | A | 4/2006 |
| CN | 1827486 | A | 9/2006 |
| CN | 101073524 | A | 11/2007 |
| FR | 2 621 685 | | 10/1987 |
| GB | 2 441 636 | A | 3/2008 |
| WO | WO 94/15034 | | 7/1994 |
| WO | WO 99/36725 | A1 | 7/1999 |
| WO | WO 2005/084353 | A2 | 9/2005 |
| WO | WO 2007/039553 | A2 | 4/2007 |

OTHER PUBLICATIONS

U.S. Appl. No. 13/720,256, Hyde et al.
U.S. Appl. No. 13/489,058, Bowers et al.
U.S. Appl. No. 13/385,088, Hyde et al.
U.S. Appl. No. 13/374,218, Hyde et al.
U.S. Appl. No. 13/200,555, Chou et al.
U.S. Appl. No. 13/199,439, Hyde et al.
U.S. Appl. No. 13/135,126, Deane et al.
U.S. Appl. No. 12/927,982, Deane et al.
U.S. Appl. No. 12/927,981, Chou et al.
U.S. Appl. No. 12/658,579, Deane et al.
U.S. Appl. No. 12/220,439, Hyde et al.
U.S. Appl. No. 12/152,467, Bowers et al.
U.S. Appl. No. 12/152,465, Bowers et al.
U.S. Appl. No. 12/077,322, Hyde et al.
U.S. Appl. No. 12/012,490, Hyde et al.
U.S. Appl. No. 12/008,695, Hyde et al.
U.S. Appl. No. 12/006,089, Hyde et al.
U.S. Appl. No. 12/006,088, Hyde et al.
U.S. Appl. No. 12/001,757, Hyde et al.

BINE Informationsdienst; "Zeolite/water refrigerators, Projekt*info* 16/10"; BINE Information Service; printed on Feb. 12, 2013; pp. 1-4; FIZ Karlsruhe, Germany; located at: http://www.bine.info/fileadmin/content/Publikationen/Englische_Infos/projekt_1610_engl_internetx.pdf.

Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.

Cool-System Keg GmbH; "Cool-System presents: CoolKeg® The world's first self-chilling Keg!"; printed on Feb. 6, 2013; pp. 1-5; located at: http://www.coolsystem.de/.

Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.

Dometic S.A.R.L.; "Introduction of Zeolite Technology into refrigeration systems, LIFE04 ENV/LU/000829, Layman's Report"; printed on Feb. 6, 2013; pp. 1-10; located at: http://ec.europa.eu/environment/life/project/Projects/index.cfm?fuseaction=home.showFile&rep=file&fil=LIFE04_ENV_LU_000829_LAYMAN.pdf.

Dow Chemical Company; "Calcium Chloride Handbook: A Guide to Properties, Forms, Storage and Handling"; Aug. 2003; pp. 1-28.

Gast Manufacturing, Inc.; "Vacuum and Pressure Systems Handbook"; printed on Jan. 3, 2013; pp. 1-20; located at: http://www.gastmfg.com/vphb/vphh_s1.pdf.

Gea Wiegand; "Pressure loss in vacuum lines with water vapour"; printed on Mar. 13, 2013; pp. 1-2; located at: http://produkte.gea-wiegand.de/GEA/GEACategory/139/index_en.html.

Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.

Kozubal, et al.; "Desiccant Enhanced Evaporative Air-Conditioning (DEVap): Evaluation of a New Concept in Ultra Efficient Air Conditioning, Technical Report NREL/TP-5500-49722"; National Renewable Energy Laboratory; Jan. 2011; pp. i-vii, 1-60, plus three cover pages and Report Documentation Page.

(56) References Cited

OTHER PUBLICATIONS

Machine-History.com; "Refrigeration Machines"; printed on Mar. 27, 2013; pp. 1-10; located at: http://www.machine-history.com/Refrigeration%20Machines.
Marquardt, Niels; "Introduction to the Principles of Vacuum Physics"; 1999; pp. 1-24; located at http://www.cientificosaficionados.com/libros/CERN/vaciol-CERN.pdf.
Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modemmechanix.com/icybail-is-practical-refrigerator-for-farm-or-camp-use/.
Oxychem; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical-properlies.pdf.
Restuccia, et al.; "Selective water sorbent for solid sorption chiller: experimental results and modeling"; International Journal of Refrigeration; 2004; pp. 284-293; vol. 27; Elsevier Ltd and IIR.
Rezk, et al.; "Physical and operating conditions effects on silica gel/water adsorption chiller performance"; Applied Energy; 2012; pp. 142-149; vol. 89; Elsevier Ltd.
Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.
Saha, et al.; "A new generation of cooling device employing $CaCl_2$-in-silica gel-water system"; International Journal of Heat and Mass Transfer; 2009; pp. 516-524; vol. 52; Elsevier Ltd.
Uop; "An Introduction to Zeolite Molecular Sieves"; printed on Jan. 10, 2013; pp. 1-20; located at: http://www.eltrex.pl/pdf/karty/adsorbenty/ENG-Introduction%20to%20Zeolite%20Molecular%20Sieves.pdf.
Wang, et al.; "Study of a novel silica gel-water adsorption chiller. Part I. Design and performance prediction"; International Journal of Refrigeration; 2005; pp. 1073-1083; vol. 28; Elsevier Ltd and IIR.
Wikipedia; "Icyball"; Mar. 14, 2013; printed on Mar. 27, 2013; pp. 1-4; located at: http://en.wikipedia.org/wiki/Icyball.
3M Monitor Mark™; "Time Temperature Indicators—Providing a visual history of time temperature exposure"; 3M Microbiology; bearing a date of 2006; pp. 1-4; located at 3M.com/microbiology.
Adams, R. O.; "A review of the stainless steel surface"; The Journal of Vacuum Science and Technology A; Bearing a date of Jan.-Mar. 1983; pp. 12-18; vol. 1, No. 1; American Vacuum Society.
Arora, Anubhav; Hakim, Itzhak; Baxter, Joy; Rathnasingham, Ruben; Srinivasan, Ravi; Fletcher, Daniel A.; "Needle-Free Delivery of Macromolecules Across the Skin by Nanoliter-Volume Pulsed Microjets"; PNAS Applied Biological Sciences; Mar. 13, 2007; pp. 4255-4260; vol. 104; No. 11; The National Academy of Sciences USA.
Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).
Bapat, S. L. et al.; "Experimental investigations of multilayer insulation"; Cryogenics; Bearing a date of Aug. 1990; pp. 711-719; vol. 30.
Bapat, S. L. et al.; "Performance prediction of multilayer insulation"; *Cryogenics*; Bearing a date of Aug. 1990; pp. 700-710; vol. 30.
Barth, W. et al.; "Experimental investigations of superinsulation models equipped with carbon paper"; *Cryogenics*; Bearing a date of May 1988; pp. 317-320; vol. 28.
Barth, W. et al.; "Test results for a high quality industrial superinsulation"; *Cryogenics*; Bearing a date of Sep. 1988; pp. 607-609; vol. 28.
Bartl, J., et al.; "Emissivity of aluminium and its importance for radiometric measurement"; Measurement Science Review; Bearing a date of 2004; pp. 31-36; vol. 4, Section 3.
Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.
Benvenuti, C.; "Decreasing surface outgassing by thin film getter coatings"; *Vacuum*; Bearing a date of 1998; pp. 57-63; vol. 50; No. 1-2; Elsevier Science Ltd.
Benvenuti, C.; "Nonevaporable getter films for ultrahigh vacuum applications"; *Journal of Vacuum Science Technology A Vacuum Surfaces, and Films*; Bearing a date of Jan./Feb. 1998; pp. 148-154; vol. 16; No. 1; American Chemical Society.
Benvenuti, C. et al.; "Obtention of pressures in the $10^{-14}$ torr range by means of a Zr V Fe non evaporable getter"; *Vacuum*; Bearing a date of 1993; pp. 511-513; vol. 44; No. 5-7; Pergamon Press Ltd.
Benvenuti, C., et al.; "Pumping characteristics of the St707 nonevaporable getter (Zr 70 V 24.6-Fe 5.4 wt %)"; The Journal of Vacuum Science and Technology A; Bearing a date of Nov.-Dec. 1996; pp. 3278-3282; vol. 14, No. 6; American Vacuum Society.
Berman, A.; "Water vapor in vacuum systems"; *Vacuum*; Bearing a date of 1996; pp. 327-332; vol. 47; No. 4; Elsevier Science Ltd.
Bernardini, M. et al.; "Air bake-out to reduce hydrogen outgassing from stainless steel"; *Journal of Vacuum Science Technology*; Bearing a date of Jan./Feb. 1998; pp. 188-193; vol. 16; No. 1; American Chemical Society.
Bo, H. et al.; "Tetradecane and hexadecane binary mixtures as phase change materials (PCMs) for cool storage in district cooling systems"; *Energy*; Bearing a date of 1999; vol. 24; pp. 1015-1028; Elsevier Science Ltd.
Boffito, C. et al.; "A nonevaporable low temperature activatable getter material"; *Journal of Vacuum Science Technology*; Bearing a date of Apr. 1981; pp. 1117-1120; vol. 18; No. 3; American Vacuum Society.
Brenzel, Logan; Wolfson, Lara J.; Fox-Rushby, Julia; Miller, Mark; Halsey, Neal A.; "Vaccine-Preventable Diseases—Chapter 20"; Disease Control Priorities in Developing Countries; printed on Oct. 15, 2007; pp. 389-411.
Brown, R.D.; "Outgassing of epoxy resins in vacumm."; *Vacuum*; Bearing a date of 1967; pp. 25-28; vol. 17; No. 9; Pergamon Press Ltd.
Burns, H. D.; "Outgassing Test for Non-metallic Materials Associated with Sensitive Optical Surfaces in a Space Environment"; MSFC-SPEC-1443; Bearing a date of Oct. 1987; pp. 1-10.
Cabeza, L. F. et al.; "Heat transfer enhancement in water when used as PCM in thermal energy storage"; Applied Thermal Engineering; 2002; pp. 1141-1151; vol. 22; Elsevier Science Ltd.
CDC; "Vaccine Management: Recommendations for Storage and Handling of Selected Biologicals"; Jan. 2007; 16 pages total; Department of Health & Human Services U.S.A.
Chen, Dexiang et al.; "Characterization of the freeze sensitivity of a hepatitis B vaccine"; Human Vaccines; Jan. 2009; pp. 26-32; vol. 5, Issue 1; Landes Bioscience.
Chen, Dexiang, et al.; "Opportunities and challenges of developing thermostable vaccines"; Expert Reviews Vaccines; 2009; pp. 547-557; vol. 8, No. 5; Expert Reviews Ltd.
Chen, G. et al.; "Performance of multilayer insulation with slotted shield"; *Cryogenics ICEC Supplement*; Bearing a date of 1994; pp. 381-384; vol. 34.
Chen, J. R.; "A comparison of outgassing rate of 304 stainless steel and A6063-EX aluminum alloy vacuum chamber after filling with water"; *Journal of Vacuum Science Technology A Vacuum Surfaces and Film*; Bearing a date of Mar. 1987; pp. 262-264; vol. 5; No. 2; American Chemical Society.
Chen, J. R. et al.; "An aluminum vacuum chamber for the bending magnet of the SRRC synchrotron light source"; *Vacuum*; Bearing a date of 1990; pp. 2079-2081; vol. 41; No. 7-9; Pergamon Press PLC.
Chen, J. R. et al.; "Outgassing behavior of A6063-EX aluminum alloy and SUS 304 stainless steel"; *Journal of Vacuum Science Technology*; Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; *Journal of Vacuum Science Technology*; Bearing a date of Jul./Aug. 1994; pp. 1750-1754; vol. 12; No. 4; American Vacuum Society.

(56) References Cited

OTHER PUBLICATIONS

Chen, J. R. et al.; "Thermal outgassing from aluminum alloy vacuum chambers"; *Journal of Vacuum Science Technology*; Bearing a date of Nov./Dec. 1985; pp. 2188-2191; vol. 3; No. 6; American Vacuum Society.
Chiggiato, P.; "Production of extreme high vacuum with non evaporable getters" *Physica Scripta*; Bearing a date of 1997; pp. 9-13; vol. T71.
Chinese State Intellectual Property Office; Office Action; App. No. 200980109399.4; Aug. 29, 2012; pp. 1-12 (No translation provided).
Chinese State Intellectual Property Office; Office Action; App. No. 200880120367.X; Oct. 25, 2012; pp. 1-5 (No translation provided).
Chinese State Intellectual Property Office; Office Action; App. No. 200880120366.5; Feb. 17, 2013 (received by our agent Feb. 19, 2013); pp. 1-3 (No translation provided).
Chinese State Intellectual Property Office; Office Action; App. No. 200880120366.5; Jun. 1, 2012; pp. 1-19 (No translation provided).
Chinese State Intellectual Property Office; Office Action; App. No. 200880119918.0; Dec. 12, 2012; pp. 1-11 (No translation provided).
Chinese State Intellectual Property Office; Office Action; App. No. 200880119918.0; Jul. 13, 2011; pp. 1-9 (No translation provided).
Chinese State Intellectual Property Office; Office Action; App. No. 200880119777.2; Jan. 7, 2013 (received by our agent on Jan. 9, 2013); pp. 1-12 (No translation provided).
Chinese State Intellectual Property Office; Office Action; App. No. 200880119777.2; Mar. 30, 2012; pp. 1-10 (No translation provided).
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315; The American Association for the Advancement of Science.
Cho, B.; "Creation of extreme high vacuum with a turbomolecular pumping system: A baking approach"; *Journal of Vacuum Science Technology*; Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; *Composites Part B: Engineering*; Bearing a date of 2008; pp. 782-791; vol. 39; Elsevier Science Ltd.
Chun, I. et al.; "Effect of the Cr-rich oxide surface on fast pumpdown to ultrahigh vacuum"; *Journal of Vacuum Science Technology A Vacuum, Surfaces, and Films*; Bearing a date of Sep./Oct. 1997; pp. 2518-2520; vol. 15; No. 5; American Vacuum Society.
Chun, I. et al.; "Outgassing rate characteristic of a stainless-steel extreme high vacuum system"; *Journal of Vacuum Science Technology*; Bearing a date of Jul./Aug. 1996; pp. 2636-2640; vol. 14; No. 4; American Vacuum Society.
Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.
Cole-Parmer; "Temperature Labels and Crayons"; www.coleparmer.com; bearing a date of 1971 and printed on Sep. 27, 2007; p. 1.
Cornell University Coop; "The Food Keeper"; printed on Oct. 15, 2007; 7 pages total (un-numbered).
Crawley, D J. et al.; "Degassing Characteristics of Some 'O' Ring Materials"; *Vacuum*; Bearing a date of 1963; pp. 7-9; vol. 14; Pergamon Press Ltd.
Csernatony, L.; "The Properties of Viton 'A' Elastomers II. The influence of permeation, diffusion and solubility of gases on the gas emission rate from an O-ring used as an atmospheric seal or high vacuum immersed"; *Vacuum*; Bearing a date of 1965; pp. 129-134; vol. 16; No. 3; Pergamon Press Ltd.
Daryabeigi, Kamran; "Thermal Analysis and Design Optimization of Multilayer Insulation for Reentry Aerodynamic Heating"; Journal of Spacecraft and Rockets; Jul.—Aug. 2002; pp. 509-514; vol. 39; No. 4; American Institute of Aeronautics and Astronautics Inc.
Day, C.; "The use of active carbons as cryosorbent"; *Colloids and Surfaces A Physicochemical and Engineering Aspects*; Bearing a date of 2001; pp. 187-206; vol. 187-188; Elsevier Science.
Della Porta, P.; "Gas problem and gettering in sealed-off vacuum devices"; *Vacuum*; Bearing a date of 1996; pp. 771-777; vol. 47; No. 6-8 Elsevier Science Ltd.
Demko, J. A., et al.; "Design Tool for Cryogenic Thermal Insulation Systems"; Advances in Cryogenic Engineering: Transactions of the Cryogenic Engineering Conference—CEC; Bearing a date of 2008; pp. 145-151; vol. 53; American Institute of Physics.
Department of Health and Social Services, Division of Public Health, Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.
Dylla, H. F. et al.; "Correlation of outgassing of stainless steel and aluminum with various surface treatments"; *Journal of Vacuum Science Technology*; Bearing a date of Sep./Oct. 1993; pp. 2623-2636; vol. 11; No. 5; American Vacuum Society.
Edstam, James S. et al.; "Exposure of hepatitis B vaccine to freezing temperatures during transport to rural health centers in Mongolia"; Preventive Medicine; 2004; pp. 384-388; vol. 39; The Institute for Cancer Prevention and Elsevier Inc.
Efe, Emine et al.; "What do midwives in one region in Turkey know about cold chain?"; Midwifery; 2008; pp. 328-334; vol. 24; Elsevier Ltd.
Elsey, R. J. "Outgassing of vacuum material I"; *Vacuum*; Bearing a date of 1975; pp. 299-306; vol. 25; No. 7; Pergamon Press Ltd.
Elsey, R. J. "Outgassing of vacuum materials II" *Vacuum*; Bearing a date of 1975; pp. 347-361; vol. 25; No. 8; Pergamon Press Ltd.
Engelmann, G. et al.; "Vacuum chambers in composite material"; *Journal of Vacuum Science Technology*; Bearing a date of Jul./Aug. 1987; pp. 2337-2341; vol. 5; No. 4; American Vacuum Society.
Ette, Ene I.; "Conscience, the Law, and Donation of Expired Drugs"; The Annals of Pharmacotherapy; Jul./Aug. 2004; pp. 1310-1313; vol. 38.
Eyssa, Y. M. et al.; "Thermodynamic optimization of thermal radiation shields for a cryogenic apparatus"; *Cryogenics*; Bearing a date of May 1978; pp. 305-307; vol. 18; IPC Business Press.
Ferrotec; "Ferrofluid: Magnetic Liquid Technology"; bearing dates of 2001-2008; printed on Mar. 10, 2008; found at http://www.ferrotec.com/technology/ferrofluid.php.
Fricke, Jochen; Emmerling, Andreas; "Aerogels—Preparation, Properties, Applications"; Structure and Bonding; 1992; pp. 37-87; vol. 77; Springer-Verlag Berlin Heidelberg.
Glassford, A. P. M. et al.; "Outgassing rate of multilayer insulation"; 1978; Bearing a date of 1978; pp. 83-106.
Greenbox Systems; "Thermal Management System"; 2010; Printed on: Feb. 3, 2011; p. 1 of 1; located at hap://www.greenboxsystems.com.
Günter, M. M. et al.; "Microstructure and bulk reactivity of the nonevaporable getter Zr57V36Fe7"; J. Vac. Sci. Technol. A; Nov./Dec. 1998; pp. 3526-3535; vol. 16, No. 6; American Vacuum Society.
Gupta, A. K. et al.; "Outgassing from epoxy resins and methods for its reduction"; *Vacuum*; Bearing a date of 1977; pp. 61-63; vol. 27; No. 12; Pergamon Press Ltd.
Hałaczek, T. et al.; "Flat-plate cryostat for measurements of multilayer insulation thermal conductivity"; *Cryogenics*; Bearing a date of Oct. 1985; pp. 593-595; vol. 25; Butterworth & Co. Ltd.
Hałaczek, T. et al.; "Unguarded cryostat for thermal conductivity measurements of multilayer insulations"; *Cryogenics*; Bearing a date of Sep. 1985; pp. 529-530; vol. 25; Butterworth & Co. Ltd.
Hałaczek, T. L. et al.; "Heat transport in self-pumping multilayer insulation"; *Cryogenics*; Bearing a date of Jun. 1986; pp. 373-376; vol. 26; Butterworth & Co. Ltd.
Hałaczek, T. L. et al.; "Temperature variation of thermal conductivity of self-pumping multilayer insulation"; *Cryogenics*; Bearing a date of Oct. 1986; pp. 544-546.; vol. 26; Butterworth & Co. Ltd.
Halldórsson, Árni, et al.; "The sustainable agenda and energy efficiency: Logistics solutions and supply chains in times of climate

(56) References Cited

OTHER PUBLICATIONS change"; *International Journal of Physical Distribution & Logistics Management*; Bearing a date of 2010; pp. 5-13; vol. 40; No. ½; Emerald Group Publishing Ltd.
Halliday, B. S.; "An introduction to materials for use in vacuum"; *Vacuum*; Bearing a date of 1987; pp. 583-585; vol. 37; No. 8-9; Pergamon Journals Ltd.
Hedayat, A., et al.; "Variable Density Multilayer Insulation for Cryogenic Storage"; Contract NAS8-40836; 36$^{th}$ Joint Propulsion Conference; Bearing a date of Jul. 17-19, 2000; pp. 1-10.
Hipgrave, David B. et al ; "Immunogenicity of a Locally Produced Hepatitis B Vaccine With the Birth Dose Stored Outside the Cold Chain in Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hirohata, Y.; "Hydrogen desorption behavior of aluminium materials used for extremely high vacuum chamber"; *Journal of Vacuum Science Technology*; Bearing a date of Sep./Oct. 1993; pp. 2637-2641; vol. 11; No. 5; American Vacuum Society.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Holtrop, K. L. et al.; "High temperature outgassing tests on materials used in the DIII-D tokamak"; *Journal of Vacuum Science Technology*; Bearing a date of Jul./Aug. 2006; pp. 1572- ; vol. 24; No. 4; American Vacuum Society.
Hong, S. et al.; "Investigation of gas species in a stainless steel ultrahigh vacuum chamber with hot cathode ionization gauges"; *Measurement Science and Technology*; Bearing a date of 2004; pp. 359-364; vol. 15; IOP Science.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.
Ishikawa, Y.; "An overview of methods to suppress hydrogen outgassing rate from austenitic stainless steel with reference to UHV and EXV"; *Vacuum*; Bearing a date of 2003; pp. 501-512; vol. 69; No. 4; Elsevier Science Ltd.
Ishikawa, Y. et al.; "Reduction of outgassing from stainless surfaces by surface oxidation"; *Vacuum*; Bearing a date of 1990; pp. 1995-1997; vol. 4; No. 7-9; Pergamon Press PLC.
Ishimaru, H.; "All-aluminum-alloy ultrahigh vacuum system for a large-scale electron—positron collider"; *Journal of Vacuum Science Technology*; Bearing a date of Jun. 1984; pp. 1170-1175; vol. 2; No. 2; American Vacuum Society.
Ishimaru, H.; "Aluminium alloy-sapphire sealed window for ultrahigh vacuum"; *Vacuum*; Bearing a date of 1983; pp. 339-340.; vol. 33; No. 6; Pergamon Press Ltd.
Ishimaru, H.; "Bakeable aluminium vacuum chamber and bellows with an aluminium flange and metal seal for ultra-high vacuum"; *Journal of Vacuum Science Technology*; Bearing a date of Nov./Dec. 1978; pp. 1853-1854; vol. 15; No. 6; American Vacuum Society.
Ishimaru, H.; "Ultimate pressure of the order of $10^{-13}$ Torr in an aluminum alloy vacuum chamber"; *Journal of Vacuum Science and Technology*; Bearing a date of May/Jun. 1989; pp. 2439-2442; vol. 7; No. 3; American Vacuum Society.
Ishimaru, H. et al.; "All Aluminum Alloy Vacuum System for the TRISTAN e+ e− Storage"; *IEEE Transactions on Nuclear Science*; Bearing a date of Jun. 1981; pp. 3320-3322; vol. NS-28; No. 3.
Ishimaru, H. et al.; "Fast pump-down aluminum ultrahigh vacuum system"; *Journal of Vacuum Science Technology*; Bearing a date of May/Jun. 1992; pp. 547-552 ; vol. 10; No. 3; American Vacuum Society.
Ishimaru, H. et al.; "Turbomolecular pump with an ultimate pressure of $10^{-12}$ Torr"; *Journal of Vacuum Science Technology*; Bearing a date of Jul./Aug. 1994; pp. 1695-1698; vol. 12; No. 4; American Vacuum Society.
Jacob, S. et al.; "Investigations into the thermal performance of multilayer insulation (300-77 K) Part 1: Calorimetric studies"; *Cryogenics*; Bearing a date of 1992; pp. 1137-1146; vol. 32; No. 12; Butterworth-Heinemann Ltd.
Jacob, S. et al.; "Investigations into the thermal performance of multilayer insulation (300-77 K) Part 2: Thermal analysis"; *Cryogenics*; Bearing a date of 1992; pp. 1147-1153; vol. 32; No. 12; Butterworth-Heinemann Ltd.
JAMC; "Preventing Cold Chain Failure: Vaccine Storage and Handling"; JAMC; Oct. 26, 2004; p. 1050; vol. 171; No. 9; Canadian Medical Association.
Jenkins, C. H. M.; "Gossamer spacecraft: membrane and inflatable structures technology for space applications"; AIAA; Bearing a date of 2000; pp. 503-527; vol. 191.
Jhung, K. H. C. et al.; "Achievement of extremely high vacuum using a cryopump and conflat aluminium"; *Vacuum*; Bearing a date of 1992; pp. 309-311; vol. 43; No. 4; Pergamon Press PLC.
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical Medicine and Hygiene; 2006; pp. 750-754; vol. 74; No. 5; The American Society of Tropical Medicine and Hygiene.
Kato, S. et al.; "Achievement of extreme high vacuum in the order of $10^{-10}$ Pa without baking of test chamber"; *Journal of Vacuum Science Technology*; Bearing a date of May/Jun. 1990; pp. 2860-2864; vol. 8 ; No. 3; American Vacuum Society.
Keller, C. W., et al.; "Thermal Performance of Multilayer Insulations, Final Report, Contract NAS 3-14377"; Bearing a date of Apr. 5, 1974; pp. 1-446.
Keller, K. et al.; "Application of high temperature multilayer insulations"; *Acta Astronautica* ; Bearing a date of 1992; pp. 451-458; vol. 26; No. 6; Pergamon Press Ltd.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Koyatsu, Y. et al. "Measurements of outgassing rate from copper and copper alloy chambers"; *Vacuum*; Bearing a date of 1996; pp. 709-711; vol. 4; No. 6-8; Elsevier Science Ltd.
Kristensen, D. et al.; "Stabilization of vaccines: Lessons learned"; *Human Vaccines*; Bearing a date of Mar. 2010; pp. 227-231; vol. 6; No. 3; Landes Bioscience.
Kropschot, R. H.; "Multiple layer insulation for cryogenic applications"; *Cryogenics*; Bearing a date of Mar. 1961; pp. 135-135; vol. 1.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Li, Y.; "Design and pumping characteristics of a compact titanium—vanadium non-evaporable getter pump"; *Journal of Vacuum Science Technology*; Bearing a date of May/Jun. 1998; pp. 1139-1144; vol. 16; No. 3; American Vacuum Society.
Li, Yang et al.; "Study on effect of liquid level on the heat leak into vertical cryogenic vessels"; Cryogenics; 2010; pp. 367-372; vol. 50; Elsevier Ltd.
Little, Arthur D.; "Liquid Propellant Losses During Space Flight, Final Report on Contract No. NASw-615"; Bearing a date of Oct. 1964; pp. 1-315.
Liu, Y. C. et al.; "Thermal outgassing study on aluminum surfaces"; *Vacuum*; Bearing a date of 1993; pp. 435-437; vol. 44; No. 5-7; Pergamon Press Ltd.

(56) References Cited

OTHER PUBLICATIONS

Llanos-Cuentas, A.; Campos, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute *Plasmodium falciparum* Malaria in Peru"; The Brazilian Journal of Infectious Diseases; 2001; pp. 67-72; vol. 5; No. 2; The Brazilian Journal of Infectious Diseases and Contexto Publishing.

Lockheed Missiles & Space Company; "High-Performance Thermal Protection Systems, Contract NAS 8-20758, vol. II"; Bearing a date of Dec. 31, 1969; pp. 1-117.

Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4° C. to 55° C."; 12th Conference on Retroviruses and Opportunistic Infections, Boston, Massachusetts; Feb. 22-25, 2005; p. 1; Foundation for Retrovirology and Human Health.

Londer, H. et al.; "New high capacity getter for vacuum insulated mobile $LH_2$ storage tank systems"; *Vacuum*; Bearing a date of 2008; pp. 431-434; vol. 82; No. 4; Elsevier Ltd.

Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.

Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.

Matolin, V. et al.; "Static SIMS study of TiZrV NEG activation"; Vacuum; 2002; pp. 177-184; vol. 67; Elsevier Science Ltd.

Matsuda, A. et al.; "Simple structure insulating material properties for multilayer insulation"; *Cryogenics*; Bearing a date of Mar. 1980; pp. 135-138; vol. 20; IPC Business Press.

Matthias, Dipika M., et al.; "Freezing temperatures in the vaccine cold chain: A systematic literature review"; Vaccine; 2007; pp. 3980-3986; vol. 25; Elsevier Ltd.

Mikhalchenko, R. S. et al.; "Study of heat transfer in multilayer insulations based on composite spacer materials."; *Cryogenics*; Bearing a date of Jun. 1983; pp. 309-311; vol. 23; Butterworth & Co. Ltd.

Mikhalchenko, R. S. et al.; "Theoretical and experimental investigation of radiative-conductive heat transfer in multilayer insulation"; *Cryogenics*; Bearing a date of May 1985; pp. 275-278; vol. 25; Butterworth & Co. Ltd.

Miki, M. et al.; "Characteristics of extremely fast pump-down process in an aluminum ultrahigh vacuum system"; *Journal of Vacuum Science Technology*; Bearing a date of Jul./Aug. 1994; pp. 1760-1766; vol. 12; No. 4; American Vacuum Society.

Mohri, M. et al.; "Surface study of Type 6063 aluminium alloys for vacuum chamber materials"; *Vacuum*; Bearing a date of 1984; pp. 643-647; vol. 34; No. 6; Pergamon Press Ltd.

Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.

Moshfegh, B.; "A New Thermal Insulation System for Vaccine Distribution; Journal of Thermal Insulation"; Jan. 1992; pp. 226-247; vol. 15; Technomic Publishing Co., Inc.

Mukugi, K. et al.; "Characteristics of cold cathode gauges for outgassing measurements in uhv range"; *Vacuum*; Bearing a date of 1993; pp. 591-593; vol. 44; No. 5-7; Pergamon Press Ltd.

Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.

Nemanič, V.; "Outgassing of thin wall stainless steel chamber"; *Vacuum*; Bearing a date of 1998; pp. 431-437; vol. 50; No. 3-4; Elsevier Science Ltd.

Nemanič, V.; "Vacuum insulating panel"; *Vacuum*; bearing a date of 1995; pp. 839-842; vol. 46; No. 8-10; Elsevier Science Ltd.

Nemanič, V. et al.; "Anomalies in kinetics of hydrogen evolution from austenitic stainless steel from 300 to 1000° C. "; *Journal of Vacuum Science Technology*; Bearing a date of Jan./Feb. 2001; pp. 215-222; vol. 19; No. 1; American Vacuum Society.

Nemanič, V. et al.; "Outgassing in thin wall stainless steel cells"; *Journal of Vacuum Science Technology*; Bearing a date of May/Jun. 1999; pp. 1040-1046; vol. 17; No. 3; American Vacuum Society.

Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.

Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.

Nemanič, Vincenc, et al.; "Outgassing of a thin wall vacuum insulating panel"; Vacuum; Bearing a date of 1998; pp. 233-237; vol. 49, No. 3; Elsevier Science Ltd.

Nolan, Timothy D. C.; Hattler, Brack G.; Federspiel, William J.; "Development of a Balloon Volume Sensor for Pulsating Balloon Catheters"; ASAIO Journal; 2004; pp. 225-233; vol. 50; No. 3; American Society of Artificial Internal Organs.

Odaka, K.; "Dependence of outgassing rate on surface oxide layer thickness in type 304 stainless steel before and after surface oxidation in air"; *Vacuum*; Bearing a date of 1996; pp. 689-692; vol. 47; No. 6-8; Elsevier Science Ltd.

Odaka, K. et al.; "Effect of baking temperature and air exposure on the outgassing rate of type 316L stainless steel"; *Journal of Vacuum Science Technology*; Bearing a date of Sep./Oct. 1987; pp. 2902-2906; vol. 5; No. 5; American Vacuum Society.

Okamura, S. et al.; "Outgassing measurement of finely polished stainless steel"; *Journal of Vacuum Science Technology*; Bearing a date of Jul./Aug. 1991; pp. 2405-2407; vol. 9; No. 4; American Vacuum Society.

PATH—A Catalyst for Global Health; "Uniject™ Device—The Radically Simple Uniject™ Device—Rethinking the Needle to Improve Immunization"; bearing dates of 1995-2006; printed on Oct. 11, 2007; pp. 1-2; located at http://www.path.org/projects/uniject.php; PATH Organization.

Patrick, T. J.; "Outgassing and the choice of materials for space instrumentation"; *Vacuum*; Bearing a date of 1973; pp. 411-413; vol. 23; No. 11; Pergamon Press Ltd.

Patrick, T. J.; "Space environment and vacuum properties of spacecraft materials"; *Vacuum*; Bearing a date of 1981; pp. 351-357; vol. 31; No. 8-9; Pergamon Press Ltd.

Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins.

PCT International Search Report; Application No. PCT/US2011/001939; Mar. 27, 2012; pp. 1-2.

PCT International Search Report; International App. No. PCT/US11/00234; Jun. 9, 2011; pp. 1-4.

PCT International Search Report; International App. No. PCT/US09/01715; Jan. 8, 2010; pp. 1-2.

PCT International Search Report; International App. No. PCT/US08/13646; Apr. 9, 2009; pp. 1-2.

PCT International Search Report; International App. No. PCT/US08/13648; Mar. 13, 2009; pp. 1-2.

PCT International Search Report; International App. No. PCT/US08/13642; Feb. 26, 2009; pp. 1-2.

PCT International Search Report; International App. No. PCT/US08/13643; Feb. 20, 2009; pp. 1-2.

Pekala, R. W.; "Organic Aerogels From the Polycondensation of Resorcinol With Formaldehyde"; Journal of Materials Science; Sep. 1989; pp. 3221-3227; vol. 24; No. 9; Springer Netherlands.

Pickering, Larry K.; Wallace, Gregory; Rodewald, Lance; "Too Hot, Too Cold: Issues with Vaccine Storage"; Pediatrics®—Official Jour-

(56) References Cited

OTHER PUBLICATIONS nal of the American Academy of Pediatrics; 2006; pp. 1738-1739 (4 pages total, incl. cover sheet and end page); vol. 118; American Academy of Pediatrics.
Poole, K. F. et al.; "Hialvac and Teflon outgassing under ultra-high vacuum conditions"; *Vacuum*; Bearing a date of Jun. 30, 1980; pp. 415-417; vol. 30; No. 10; Pergamon Press Ltd.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Pure Temp; "Technology"; Printed on: Feb. 9, 2011; p. 1-3; located at http://puretemp.com/technology.html.
Redhead, P. A.; "Recommended practices for measuring and reporting outgassing data"; *Journal of Vacuum Science Technology*; Bearing a date of Sep./Oct. 2002; pp. 1667-1675; vol. 20; No. 5; American Vacuum Society.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located at www.ChildrensVaccine.org/html/safe_injection.htm.
Ren, Qian et al.; "Evaluation of an Outside-the-Cold-Chain Vaccine Delivery Strategy in Remote Regions of Western China"; Public Health Reports; Sep.-Oct. 2009; pp. 745-750; vol. 124.
Risha, Peter G.; Shewiyo, Danstan; Msami, Amani; Masuki, Gerald; Vergote, Geert; Vervaet, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Rutherford, S; "The Benefits of Viton Outgassing"; Bearing a date of 1997; pp. 1-5; Duniway Stockroom Corp.
Saes Getters; "St707 Getter Alloy for Vacuum Systems"; printed on Sep. 22, 2011; pp. 1-2; located at http://www.saegetters.com/default.aspx?idPage=212.
Saito, K. et al.; "Measurement system for low outgassing materials by switching between two pumping paths"; *Vacuum*; Bearing a date of 1996; pp. 749-752; vol. 47; No. 6-8; Elsevier Science Ltd.
Saitoh, M. et al.; "Influence of vacuum gauges on outgassing rate measurements" ; *Journal of Vacuum Science Technology*; Bearing a date of Sep./Oct. 1993; pp. 2816-2821; vol. 11; No. 5; American Vacuum Society.
Santhanam, S. M. T. J. et al. ;"Outgassing rate of reinforced epoxy and its control by different pretreatment methods"; *Vacuum*; Bearing a date of 1978; pp. 365-366; vol. 28; No. 8-9; Pergamon Press Ltd.
Sasaki, Y. T.; "Reducing SS 304/316 hydrogen outgassing to $2\times10^{-15}$ton- 1/cm $^{2}$s"; *Journal of Vacuum Science Technology*; Bearing a date of Jul./Aug. 2007; pp. 1309-1311; vol. 25; No. 4; American Vacuum Society.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Scurlock, R. G. et al.; "Development of multilayer insulations with thermal conductivities below 0.1 μW cm$^{-1}$ K$^{-1}$"; *Cryogenics*; Bearing a date of May 1976; pp. 303-311; vol. 16.
Setia, S. et al.; "Frequency and causes of vaccine wastage"; *Vaccine* ; Bearing a date of 2002; pp. 1148-1156; vol. 20; Elsevier Science Ltd.
Seto, Joyce; Marra, Fawziah; "Cold Chain Management of Vaccines"; Continuing Pharmacy Professional Development Home Study Program; Feb. 2005; pp. 1-19; University of British Columbia.
Shockwatch; "Environmental Indicators"; printed on Sep. 27, 2007; pp. 1-2; located at www.shockwatch.com.
Shu, Q. S. et al.; "Heat flux from 277 to 77 K through a few layers of multilayer insulation"; *Cryogenics*; Bearing a date of Dec. 1986; pp. 671-677; vol. 26; Butterworth & Co. Ltd.
Shu, Q. S. et al.; "Systematic study to reduce the effects of cracks in multilayer insulation Part 1: Theoretical model"; *Cryogenics*; Bearing a date of May 1987; pp. 249-256; vol. 27; Butterworth & Co. Ltd.
Shu, Q. S. et al.; "Systematic study to reduce the effects of cracks in multilayer insulation Part 2: experimental results"; *Cryogenics*; Bearing a date of Jun. 1987; pp. 298-311; vol. 27; No. 6; Butterworth & Co. Ltd.
Spur Industries Inc.; "The Only Way to Get Them Apart is to Melt Them Apart"; 2006; pp. 1-3; located at http://www.spurind.com/applications.php.
Suemitsu, M. et al.; "Development of extremely high vacuums with mirror-polished Al-alloy chambers"; *Vacuum*; Bearing a date of 1993; pp. 425-428; vol. 44; No. 5-7; Pergamon Press Ltd.
Suemitsu, M. et al.; "Ultrahigh-vacuum compatible mirror-polished aluminum-alloy surface: Observation of surface-roughness-correlated outgassing rates"; *Journal of Vacuum Science Technology*; Bearing a date of May/Jun. 1992; pp. 570-572; vol. 10; No. 3; American Vacuum Society.
Suttmeier, Chris; "Warm Mix Asphalt: A Cooler Alternative"; Material Matters—Around the Hot Mix Industry; Spring 2006; pp. 21-22; Peckham Materials Corporation.
Tatenuma, K. et al.; "Acquisition of clean ultrahigh vacuum using chemical treatment"; *Journal of Vacuum Science Technology*; Bearing a date of Jul./Aug. 1998; pp. 2693-2697; vol. 16; No. 4; American Vacuum Society.
Tatenuma, K.; "Quick acquisition of clean ultrahigh vacuum by chemical process technology"; *Journal of Vacuum Science Technology*; Bearing a date of Jul./Aug. 1993; pp. 2693-2697; vol. 11; No. 4; American Vacuum Society.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage of Vaccines in the Community: Weak Link in the Cold Chain?"; British Medical Journal; Mar. 21, 1992; pp. 756-758; vol. 304, No. 6829; BMJ Publishing Group.
Thompson, Marc T.; "Eddy current magnetic levitation—Models and experiments"; IEEE Potentials; Feb./Mar. 2000; pp. 40-46; IEEE.
Tripathi, A. et al.; "Hydrogen intake capacity of ZrVFe alloy bulk getters"; *Vacuum*; Bearing a date of Aug. 6, 1997; pp. 1023-1025; vol. 48; No. 12; Elsevier Science Ltd.
"Two Wire Gage / Absolute Pressure Transmitters—Model 415 and 440"; Honeywell Sensotec; printed 2007; pp. 1-2; Located www.sensotec.com and www.honeywell.com/sensing.
UNICEF Regional Office for Latin America & The Carribean (UNICEF-TACRO); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Watanabe, S. et al.; "Reduction of outgassing rate from residual gas analyzers for extreme high vacuum measurements"; *Journal of Vacuum Science Technology*; Bearing a date of Nov./Dec. 1996; pp. 3261-3266; vol. 14; No. 6; American Vacuum Society.

(56) References Cited

OTHER PUBLICATIONS

Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
Wiedemann, C. et al.; "Multi-layer Insulation Literatures Review"; *Advances*; Printed on May 2, 2011; pp. 1-10; German Aerospace Center.
Williams, Preston; "Greenbox Thermal Management System Refrigerate-able 2 to 8 C Shipping Containers"; Printed on: Feb. 9, 2011; p. 1; located at http://www.puretemp.com/documents/Refrigerate-able%202%20to%208%20C%20Shipping%20Containers.pdf.
Winn, Joshua N. et al.; "Omnidirectional reflection from a one-dimensional photonic crystal"; Optics Letters; Oct. 15, 1998; pp. 1573-1575; vol. 23, No. 20; Optical Society of America.
Wirkas, Theo, et al.; "A vaccine cold chain freezing study in PNG highlights technology needs for hot climate countries"; Vaccine; 2007; pp. 691-697; vol. 25; Elsevier Ltd.
World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
World Health Organization; "Guidelines on the international packaging and shipping of vaccines"; Department of Immunization, Vaccines and Biologicals; Dec. 2005; 40 pages; WHO/IVB/05.23.
World Health Organization; "Preventing Freeze Damage to Vaccines: Aide-memoire for prevention of freeze damage to vaccines"; 2007; pp. 1-4; WHO/IVB/07.09; World Health Organization.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Yamazaki, K. et al.; "High-speed pumping to UHV"; *Vacuum* ; Bearing a date of 2010; pp. 756-759; vol. 84; Elsevier Science Ltd.
Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zalba, B. et al.; "Review on thermal energy storage with phase change: materials, heat transfer analysis and applications"; *Applied Thermal Engineering*; Bearing a date of 2003; pp. 251-283; vol. 23; Elsevier Science Ltd.
Zhitomirskij, I.S. et al.; "A theoretical model of the heat transfer processes in multilayer insulation"; *Cryogenics*; Bearing a date of May 1979; pp. 265-268; IPC Business Press.
Zhu, Z. Q.; Howe, D.; "Halbach Permanent Magnet Machines and Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.
NSM Archive; "Band structure and carrier concentration"; date of Jan. 22, 2004 provided by examiner, printed on Feb. 16, 2013; pp. 1-10, 1 additional page of archive information; located at: http://web.archive.org/20040122200811/http://www.ioffe.rssi.ru/SVA/NSM/Semicond/SiC/bandstr.html.
Chinese State Intellectual Property Office; Office Action; App. No. 200880119918.0; May 27, 2013 (received by our agent on May 29, 2013); 9 pages (No English Translation Available).
U.S. Appl. No. 13/907,470, Bowers et al.
U.S. Appl. No. 13/906,909, Bloedow et al.
Abdul-Wahab et al.; "Design and experimental investigation of portable solar thermoelectric refrigerator"; Renewable Energy; 2009; pp. 30-34; vol. 34; Elsevier Ltd.
Astrain et al.; "Computational model for refrigerators based on Peltier effect application"; Applied Thermal Engineering; 2005; pp. 3149-3162; vol. 25; Elsevier Ltd.
Azzouz et al.; "Improving the energy efficiency of a vapor compression system using a phase change material"; Second Conference on Phase Change Material & Slurry: Scientific Conference & Business Forum; Jun. 15-17, 2005; pp. 1-11; Yverdon-les-Bains, Switzerland.
Chatterjee et al.; "Thermoelectric cold-chain chests for storing/transporting vaccines in remote regions"; Applied Energy; 2003; pp. 415-433; vol. 76; Elsevier Ltd.
Chiu et al.; "Submerged finned heat exchanger latent heat storage design and its experimental verification"; Applied Energy; 2012; pp. 507-516; vol. 93; Elsevier Ltd.
Conway et al.; "Improving Cold Chain Technologies through the Use of Phase Change Material"; Thesis, University of Maryland; 2012; pp. ii-xv and 16-228.
Dai et al.; "Experimental investigation and analysis on a thermoelectric refrigerator driven by solar cells"; Solar Energy Materials & Solar Cells; 2003; pp. 377-391; vol.77; Elsevier Science B.V.
Ghoshal et al.; "Efficient Switched Thermoelectric Refrigerators for Cold Storage Applications"; Journal of Electronic Materials; 2009; pp. 1-6; doi: 10.1007/s11664-009-0725-3.
Groulx et al.; "Solid-Liquid Phase Change Simulation Applied to a Cylindrical Latent Heat Energy Storage System"; Excerpt from the Proceedings of the COMSOL Conference, Boston; 2009; pp. 1-7.
Jiajitsawat, Somchai; "A Portable Direct-PV Thermoelectric Vaccine Refrigerator with Ice Storage Through Heat Pipes"; Dissertation, University of Massachusetts, Lowell; 2008; three cover pages, pp. ii-x, 1-137.
Kempers et al.; "Characterization of evaporator and condenser thermal resistances of a screen mesh wicked heat pipe"; International Journal of Heat and Mass Transfer; 2008; pp. 6039-6046; vol. 51; Elsevier Ltd.
Mohamad et al.; "An Analysis of Sensitivity Distribution Using Two Differential Excitation Potentials in ECT"; IEEE Fifth International Conference on Sensing Technology; 2011; pp. 575-580; IEEE.
Mohamad et al.; "A introduction of two differential excitation potentials technique in electrical capacitance tomography"; Sensors and Actuators A; 2012; pp. 1-10; vol. 180; Elsevier B.V.
Mughal et al.; "Review of Capacitive Atmospheric Icing Sensors"; The Sixth International Conference on Sensor Technologies and Applications (SENSORCOMM); 2012; pp. 42-47; IARIA.
Omer et al.; "Design optimization of thermoelectric devices for solar power generation"; Solar Energy Materials and Solar Cells; 1998; pp. 67-82; vol. 53; Elsevier Science B.V.
Omer et al.; "Experimental investigation of a thermoelectric refrigeration system employing a phase change material integrated with thermal diode (thermosyphons)"; Applied Thermal Engineering; 2001; pp. 1265-1271; vol. 21; Elsevier Science Ltd.
Oró et al.; "Review on phase change materials (PCMs) for cold thermal energy storage applications"; Applied Energy; 2012; pp. 1-21; doi: 10.1016/j.apenergy.2012.03.058; Elsevier Ltd.
Owusu, Kwadwo Poku; "Capacitive Probe for Ice Detection and Accretion Rate Measurement: Proof of Concept"; Master of Science Thesis, Department of Mechanical Engineering, University of Manitoba; 2010; pp. i-xi, 1-95.
Peng et al.; "Determination of the optimal axial length of the electrode in an electrical capacitance tomography sensor"; Flow Measurement and Instrumentation; 2005; pp. 169-175; vol. 16; Elsevier Ltd.
Peng et al.; "Evaluation of Effect of Number of Electrodes in ECT Sensors on Image Quality"; IEEE Sensors Journal; May 2012; pp. 1554-1565; vol. 12, No. 5; IEEE.

(56) References Cited

OTHER PUBLICATIONS

Riffat et al.; "A novel thermoelectric refrigeration system employing heat pipes and a phase change material: an experimental investigation"; Renewable Energy; 2001; pp. 313-323; vol. 23; Elsevier Science Ltd.
Robak et al.; "Enhancement of latent heat energy storage using embedded heat pipes"; International Journal of Heat and Mass Transfer; 2011; pp. 3476-3483; vol. 54; Elsevier Ltd.
Rodríguez et al.; "Development and experimental validation of a computational model in order to simulate ice cube production in a thermoelectric ice maker"; Applied Thermal Engineering; 2009; one cover page and pp. 1-28; doi: 10.1016/j.applthermaleng.2009.03.005.
Russel et al.; "Characterization of a thermoelectric cooler based thermal management system under different operating conditions"; Applied Thermal Engineering; 2012; two cover pages and pp. 1-29; doi: 10.1016/j.applthermaleng.2012.05.002.
Sharifi et al.; "Heat pipe-assisted melting of a phase change material"; International Journal of Heat and Mass Transfer; 2012; pp. 3458-3469; vol. 55; Elsevier Ltd.
Stampa et al.; "Numerical Study of Ice Layer Growth Around a Vertical Tube"; Engenharia Térmica (Thermal Engineering); Oct. 2005; pp. 138-144; vol. 4, No. 2.
Vián et al.; "Development of a thermoelectric refrigerator with two-phase thermosyphons and capillary lift"; Applied Thermal Engineering; 2008; one cover page and pp. 1-16 doi: 10.1016/j.applthermaleng.2008.09.018.
Ye et al.; "Evaluation of Electrical Capacitance Tomography Sensors for Concentric Annulus"; IEEE Sensors Journal; Feb. 2013; pp. 446-456; vol. 13, No. 2; IEEE.
Yu et al.; "Comparison Study of Three Common Technologies for Freezing-Thawing Measurement"; Advances in Civil Engineering; 2010; pp. 1-10; doi: 10.1155/2010/239651.
Chinese State Intellectual Property Office, Office Action; App. No. 200880119918.0; Sep. 18, 2013 (rec'd by our agent Sep. 20, 2013); pp. 1-10 (No English translation available).
U.S. Appl. No. 14/098,886, Bloedow et al.
U.S. Appl. No. 14/070,892, Hyde et al.
U.S. Appl. No. 14/070,234, Hyde et al.
Chinese State Intellectual Property Office, Office Action; App. No. 201180016103.1 (based on PCT Patent Application No. PCT/US2011/000234); Jun. 23, 2014 (received by our Agent on Jun. 25, 2014); pp. 1-23.
"About Heat Leak—Comparison"; Technifab Products, Inc.; printed on Jun. 25, 2014; 2 pages; located at www.technifab.com/cryogenic-resource-library/about-heat-leak.html.
PCT International Search Report; International App. No. PCT/US2014/067863; Mar. 27, 2015; pp. 1-3.
Chinese State Intellectual Property Office; Office Action; App. No. 200880120366.5; Jun. 27, 2013; 3 pages (No English translation available).

* cited by examiner

TEMPERATURE-CONTROLLED STORAGE SYSTEMS

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

For purposes of the USPTO extra-statutory requirements, the present application constitutes a continuation-in-part of U.S. patent application Ser. No. 12/001,757, entitled TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 11 Dec. 2007, which is currently co-pending or is an application of which a currently co-pending application is entitled to the benefit of the filing date.

For purposes of the USPTO extra-statutory requirements, the present application constitutes a continuation-in-part of U.S. patent application Ser. No. 12/006,089, entitled TEMPERATURE-STABILIZED STORAGE SYSTEMS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 27 Dec. 2007, which is currently co-pending or is an application of which a currently co-pending application is entitled to the benefit of the filing date.

For purposes of the USPTO extra-statutory requirements, the present application constitutes a continuation-in-part of U.S. patent application Ser. No. 12/658,579, entitled TEMPERATURE-STABILIZED STORAGE SYSTEMS, naming Geoffrey F. Deane; Lawrence Morgan Fowler; William Gates; Zihong Guo; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed 8 Feb. 2010, which is currently co-pending or is an application of which a currently co-pending application is entitled to the benefit of the filing date.

For purposes of the USPTO extra-statutory requirements, the present application constitutes a continuation-in-part of U.S. patent application Ser. No. 12/927,981, entitled TEMPERATURE-STABILIZED STORAGE SYSTEMS WITH FLEXIBLE CONNECTORS, naming Fong-Li Chou; Geoffrey F. Deane; William Gates; Zihong Guo; Roderick A. Hyde; Edward K. Y. Jung; Nathan P. Myhrvold; Nels R. Peterson; Clarence T. Tegreene; Charles Whitmer; and Lowell L. Wood, Jr. as inventors, filed 29 Nov. 2010, which is currently co-pending or is an application of which a currently co-pending application is entitled to the benefit of the filing date.

For purposes of the USPTO extra-statutory requirements, the present application constitutes a continuation-in-part of United States patent application Ser. No. 12/927,982, entitled TEMPERATURE-STABILIZED STORAGE SYSTEMS INCLUDING STORAGE STRUCTURES CONFIGURED FOR INTERCHANGEABLE STORAGE OF MODULAR UNITS, naming Geoffrey F. Deane; Lawrence Morgan Fowler; William Gates; Jenny Ezu Hu; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed 29 Nov. 2010, which is currently co-pending or is an application of which a currently co-pending application is entitled to the benefit of the filing date.

For purposes of the USPTO extra-statutory requirements, the present application constitutes a continuation-in-part of U.S. patent application Ser. No. 13/135,126, entitled TEMPERATURE-STABILIZED STORAGE SYSTEMS CONFIGURED FOR STORAGE AND STABILIZATION OF MODULAR UNITS, naming Geoffrey F. Deane; Lawrence Morgan Fowler; William Gates; Jenny Ezu Hu; Roderick A. Hyde; Edward K. Y. Jung; Jordin T. Kare; Mark K. Kuiper; Nathan P. Myhrvold; Nathan Pegram; Nels R. Peterson; Clarence T. Tegreene; Mike Vilhauer; Charles Whitmer; Lowell L. Wood, Jr.; and Ozgur Emek Yildirim as inventors, filed 23 Jun. 2011, which is currently co-pending or is an application of which a currently co-pending application is entitled to the benefit of the filing date.

For purposes of the USPTO extra-statutory requirements, the present application constitutes a continuation-in-part of U.S. patent application Ser. No. 13/200,555, entitled ESTABLISHMENT AND MAINTENANCE OF LOW GAS PRESSURE WITHIN INTERIOR SPACES OF TEMPERATURE-STABILIZED STORAGE SYSTEMS, naming Fong-Li Chou; William Gates; Roderick A. Hyde; Edward K. Y. Jung; Nathan P. Myhrvold; Clarence T. Tegreene; Charles Whitmer; and Lowell L. Wood, Jr. as inventors, filed 23 Sep. 2011, which is currently co-pending or is an application of which a currently co-pending application is entitled to the benefit of the filing date.

For purposes of the USPTO extra-statutory requirements, the present application constitutes a continuation-in-part of U.S. patent application Ser. No. 13/385,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 31 Jan. 2012, which is currently co-pending or is an application of which a currently co-pending application is entitled to the benefit of the filing date, and which is a continuation of U.S. patent application Ser. No. 12/006,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 27 Dec. 2007, now issued as U.S. Pat. No. 8,215,518.

RELATED APPLICATIONS

U.S. patent application Ser. No. 12/008,695, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 10 Jan. 2008, is related to the present application.

U.S. patent application Ser. No. 12/012,490, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 31 Jan. 2008, now issued as U.S. Pat. No. 8,069,680, is related to the present application.

U.S. patent application Ser. No. 12/077,322, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed 17 Mar. 2008, now issued as U.S. Pat. No. 8,215,835, is related to the present application.

U.S. patent application Ser. No. 12/152,465, entitled STORAGE CONTAINER INCLUDING MULTI-LAYER INSULATION COMPOSITE MATERIAL HAVING BANDGAP MATERIAL AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed 13 May 2008, is related to the present application.

U.S. patent application Ser. No. 12/152,467, entitled MULTI-LAYER INSULATION COMPOSITE MATERIAL INCLUDING BANDGAP MATERIAL, STORAGE CONTAINER USING SAME, AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed 13 May 2008, now issued as U.S. Pat. No. 8,211,516, is related to the present application.

U.S. patent application Ser. No. 12/220,439, entitled MULTI-LAYER INSULATION COMPOSITE MATERIAL HAVING AT LEAST ONE THERMALLY-REFLECTIVE LAYER WITH THROUGH OPENINGS, STORAGE CONTAINER USING SAME, AND RELATED METHODS, naming Roderick A. Hyde; Muriel Y. Ishikawa; Jordin T. Kare; and Lowell L. Wood, Jr. as inventors, filed 23 Jul. 2008, is related to the present application.

U.S. patent application Ser. No. 13/199,439, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 29 Aug. 2011, now issued as U.S. Pat. No. 8,322,147, is related to the present application.

U.S. patent application Ser. No. 13/374,218, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed 16 Dec. 2011, is related to the present application.

U.S. patent application Ser. No. 13/489,058, entitled MULTI-LAYER INSULATION COMPOSITE MATERIAL INCLUDING BANDGAP MATERIAL, STORAGE CONTAINER USING SAME, AND RELATED METHODS, naming Jeffery A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed 5 Jun. 2012, is related to the present application.

U.S. patent application Ser. No. 13/720,256, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 19 Dec. 2012, is related to the present application.

U.S. patent application Ser. No. 13/720,328, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 19 Dec. 2012, is related to the present application.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

SUMMARY

In some embodiments, a substantially thermally sealed storage container includes an outer assembly and an evaporative cooling assembly integral to the container. In some embodiments, the outer assembly includes one or more sections of ultra efficient insulation material substantially defining at least one thermally-controlled storage region, and a single access conduit to the at least one thermally-controlled storage region. In some embodiments, the evaporative cooling assembly integral to the container includes: an evaporative cooling unit affixed to a surface of the at least one thermally-controlled storage region; a desiccant unit affixed to an external surface of the container; a vapor conduit, the vapor conduit including a first end and a second end, the first end attached to the evaporative cooling unit, the second end attached to the desiccant unit; and a vapor control unit attached to the vapor conduit.

In some embodiments, a substantially thermally sealed storage container includes: an outer wall substantially defining a substantially thermally sealed storage container, the outer wall substantially defining a single outer wall aperture; an interior wall substantially defining a thermally-controlled storage region, the interior wall substantially defining a single interior wall aperture, the interior wall and the outer wall separated by a distance and substantially defining a gas-sealed gap; at least one section of ultra-efficient insulation material disposed within the gas-sealed gap; a connector forming an access conduit connecting the single outer wall aperture with the single interior wall aperture; a single access aperture to the thermally-controlled storage region, wherein the single access aperture is defined by an end of the access conduit; at least one inner wall, the at least one inner wall sealed to the interior wall along at least one junction, the at least one inner wall and the interior wall separated by a distance and substantially creating a liquid-impermeable gap; an aperture in the at least one inner wall; a desiccant unit external to the outer wall, the desiccant unit including an aperture; a vapor conduit positioned substantially within the access conduit, the vapor conduit including a first end and a second end, the first end sealed to the aperture in the at least one inner wall, the second end sealed to the aperture of the desiccant unit; and a vapor control unit attached to the vapor conduit.

In some embodiments, a substantially thermally sealed storage container includes: an outer wall substantially defining a substantially thermally sealed storage container, the outer wall substantially defining a single outer wall aperture; at least one desiccant unit external to the outer wall, the desiccant unit including at least one aperture; an interior wall substantially defining a thermally-controlled storage area within the container, the interior wall substantially defining a single interior wall aperture, the interior wall and the outer wall separated by a distance and substantially defining a gas-sealed gap; a connector forming an access conduit connecting the single outer wall aperture with the single interior wall aperture; a single access aperture to the thermally-controlled storage area, wherein the single access aperture is defined by an end of the access conduit; a primary vapor conduit positioned substantially within the access conduit, the vapor conduit including a first end and a second end, the first end sealed to the at least one aperture in the interior wall, the second end sealed to the at least one aperture of the desiccant unit; a primary vapor control unit attached to the primary vapor conduit; a first inner wall and a second inner wall each attached to the interior wall, the inner walls positioned to form a first liquid-impermeable gap between the first and second inner walls, the first and second inner walls forming a floor to a first storage region in the thermally-controlled storage area; an aperture in the first inner wall; a first regional vapor conduit including a first end and a second end, the first end sealed to the primary vapor conduit, the second end sealed to the aperture in the first inner wall; a first regional vapor control unit attached to the first regional vapor conduit; a third inner wall attached to the interior wall, the third inner wall positioned to form a second liquid-impermeable gap between the third inner wall and the interior wall, the third inner wall forming a floor to a second storage region in the thermally-controlled storage area; an aperture in the third inner wall; a second regional vapor conduit including a first end and a second end, the first end sealed to the primary vapor conduit, the second end sealed to the aperture in the third inner wall; and a second regional vapor control unit attached to the second regional vapor conduit.

In some embodiments, a substantially thermally sealed storage container includes: an outer wall substantially defining a substantially thermally sealed storage container, the outer wall substantially defining a single outer wall aperture; an interior wall substantially defining a thermally-controlled storage region, the interior wall substantially defining a single interior wall aperture, the interior wall and the outer wall separated by a distance and substantially defining a gas-sealed gap; at least one section of ultra efficient insulation material disposed within the gas-sealed gap; a connector forming an access conduit connecting the single outer wall aperture with the single interior wall aperture; a single access aperture to the thermally-controlled storage region, wherein the single access aperture is defined by an end of the access conduit; at least one inner wall, the inner wall sealed to the interior wall along at least one junction, the inner wall and the interior wall separated by a distance and substantially defining a liquid-impermeable gap; an aperture in the at least one inner wall; a primary vapor conduit positioned substantially within the access conduit, the primary vapor conduit including a first end and a second end, the primary vapor conduit including an integral vapor control unit, the first end sealed to the aperture in the at least one inner wall; a vapor conduit junction attached to the second end of the primary vapor conduit; at least two desiccant units external to the outer wall, each of the desiccant storage units including at least one aperture; and at least two secondary vapor conduits including a first end and a second end, the first end attached to the vapor conduit junction, the second end attached to an aperture in a desiccant unit, and each of the at least two secondary vapor conduits including an externally-operable valve.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
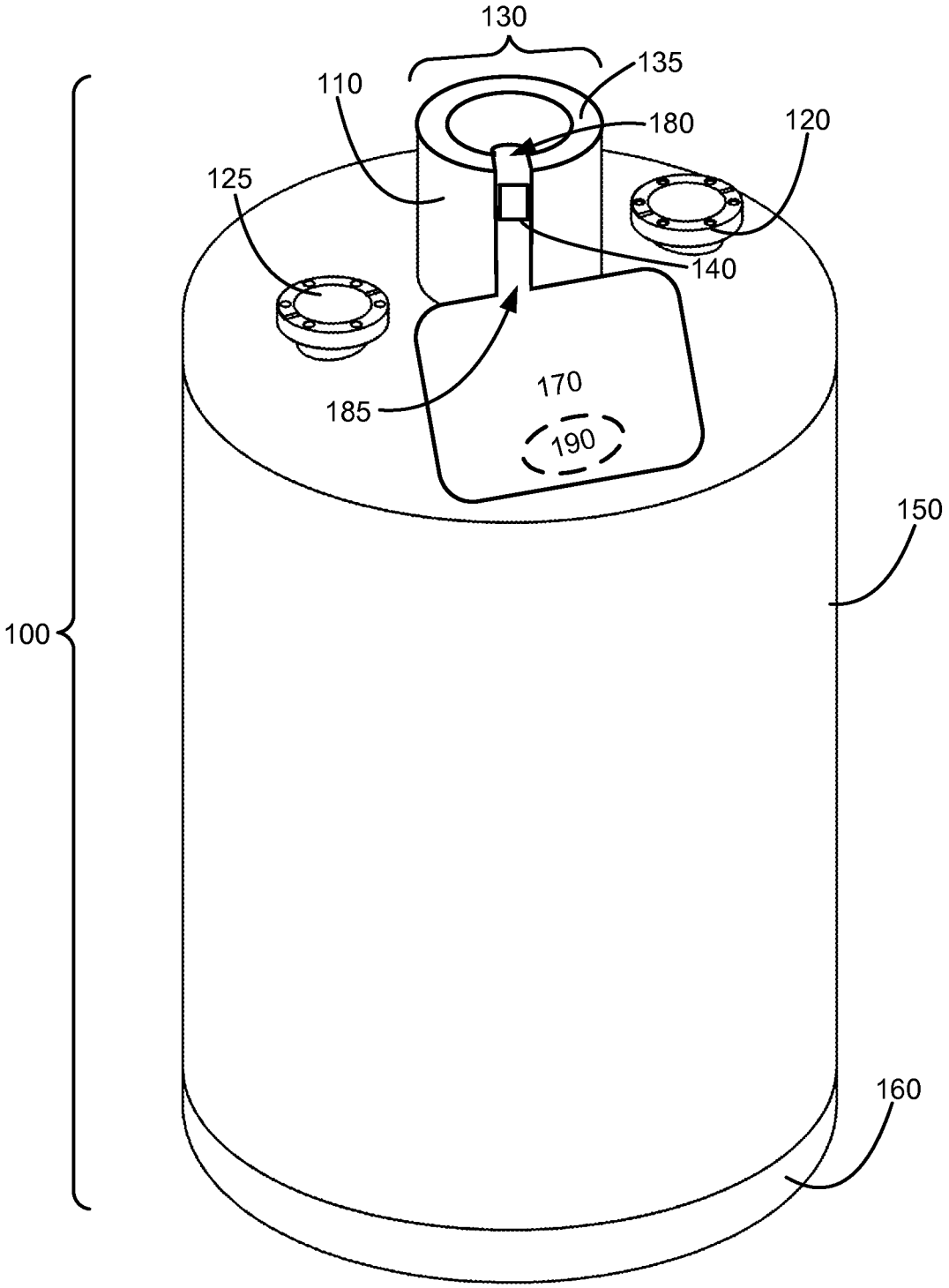
FIG. 1 is a schematic of a substantially thermally sealed storage container from an external view.

In the following detailed description, reference is made to the accompanying drawings, which form a part hereof. In the drawings, similar symbols typically identify similar components, unless context dictates otherwise.

Substantially thermally sealed storage containers described herein include controlled evaporative cooling systems, integral to the containers, which are calibrated to maintain the interior storage regions within a predetermined temperature range over a period of time, measured in days or weeks. In some embodiments, the evaporative cooling system is calibrated to maintain the interior storage region in a predetermined temperature range between 0 degrees Centigrade and 10 degrees Centigrade. In some embodiments, the evaporative cooling system is calibrated to maintain the interior storage region in a predetermined temperature range between 2 degrees Centigrade and 8 degrees Centigrade. In some embodiments, the container requires no external power to operate. In some embodiments, the container requires minimal power to operate the control of the rate of evaporative cooling, such as a power requirement that is less than the power requirements of a standard refrigeration unit. In some embodiments, the integral evaporative cooling system within the container can be recharged, repaired or refreshed to allow reuse of the container multiple times.

The illustrative embodiments described in the detailed description, drawings, and claims are not meant to be limiting. Other embodiments may be utilized, and other changes can be made, without departing from the spirit or scope of the subject matter presented here. The use of the same symbols in different drawings typically indicates similar or identical items unless context dictates otherwise.

FIG. 1 shows a particular perspective of a substantially thermally sealed storage container 100, according to an embodiment. The substantially thermally sealed storage container 100 illustrated in FIG. 1 is shown from an external viewpoint. The substantially thermally sealed storage container 100 includes an outer wall 150. The entire container is stabilized in an upright position by a base region 160. A single access conduit 130 is positioned at a region of the substantially thermally sealed storage container 100 that will be the uppermost region of the container during normal use. As used herein, a "conduit" refers to a structure with a hollow interior and at least two apertures at distal ends, such as a pipe, a tube or a duct. In some embodiments, the interior hollow of a conduit has a substantially round cross-section. In some embodiments, the interior hollow of a conduit has a cross-section that is substantially rectangular, elliptical, or irregularly shaped. The conduit 130 includes an outer wall 110 that substantially defines the exterior of the conduit 130. A seal 135 is positioned at the terminal end of the conduit 130, the seal 135 positioned and fabricated to prevent gas leakage into any interior region of the conduit 130 structure from the adjacent external region.

A first vapor conduit 180 traverses the single access conduit 130 from a region interior to the container 100 to a region exterior to the container 100. A vapor control unit 140 is connected, with a gas-impermeable seal, to the end of the first vapor conduit 180 exterior to the container 100. For example, in some embodiments the first and second vapor conduits and the vapor control unit 140 are fabricated from a metal, such as aluminum or stainless steel, and the vapor control unit and one or more vapor conduits are welded together to form a gas-impermeable seal. The vapor conduit 180 includes another, interior end, which is positioned within the container and, therefore, is not visible in the external view shown in FIG. 1.

The vapor control unit 140 traverses the diameter of the adjacent end of the first vapor conduit 180 as well as the adjacent end of the second vapor conduit 185. The vapor control unit 140 controllably increases and decreases the interior dimensions of a conduit internal to the vapor control unit 140, which serves to alter the rate of vapor flow through the vapor control unit 140 and, therefore, between the first vapor conduit 180 and the second vapor conduit 185. See: "Calculating Pipe Sizes & Pressure Drops in Vacuum Systems," Section 9-Technical Reference, Rietschle Thomas Company, which is incorporated by reference. The conduit internal to the vapor control unit 140 has a first end, which is sealed to the adjacent end of the first vapor conduit 180, and a second end, which is sealed to the adjacent end of the second vapor conduit 185. The vapor control unit 140 includes at least one valve positioned to regulate vapor and gas flow through the internal conduit of the vapor control unit 140. The at least one valve is connected to a controller which regulates the opening and closing of the valve, and therefore the internal diameter of the internal conduit of the vapor control unit 140. The controller is connected to a sensor within the container 100. See FIGS. 4, 5 and 6.

In some embodiments, the vapor control unit 140 includes a visible indicator of information from the controller on the outside of the vapor control unit 140. For example, in some embodiments the vapor control unit 140 includes on its exterior a dial connected to the controller, the dial configured to indicate the temperature reading from the sensor. For example, in some embodiments the vapor control unit 140 includes on its exterior a light connected to the controller, wherein the controller turns the light on and off in combination with sending a control signal to the valve within the vapor control unit 140. For example, in some embodiments the vapor control unit 140 includes on its exterior a light connected to the controller, wherein the controller turns the light on and off in response to data from a pressure sensor attached to the controller. For example, the controller can include circuitry that initiates the light to turn on when information from the pressure sensor indicates that the pressure inside the evaporative cooling system is within a preset range (e.g. to indicate to a user that the internal gas pressure is within a preset acceptable operating range, and therefore is operational, or to indicate to a user that the internal gas pressure is outside of the preset acceptable operating range, and therefore requires maintenance).

A second vapor conduit 185 is connected, with a gas-impermeable seal, to the vapor control unit 140 at a position distal to the connection with the first vapor conduit 180. The connection with the vapor control unit 140 traverses the diameter of a first end of the second vapor conduit 185. The second conduit 185 includes a second end, which is connected to a desiccant unit 170 at a region surrounding an aperture in the desiccant unit 170 with a gas-impermeable seal. For example, in some embodiments the desiccant unit 170 and the second vapor conduit 185 are fabricated from a metal, such as aluminum or stainless steel, and the desiccant unit 170 and the second vapor conduit 185 are welded together to create a gas-impermeable seal. The desiccant unit 170 is attached to an exterior surface of the container 100. The desiccant unit 170 includes an outer wall encircling a hollow interior and forming an internal region that is both gas- and liquid-impermeable. See FIGS. 3, 4, 5 and 6.

In some embodiments, the desiccant unit 170 includes a power unit 190. For example, the power unit 190 can include a plug-in to a AC or DC power source. For example, the power unit 190 can include a solar panel positioned to collect solar energy from a region external to the container. For example, the power unit 190 can include a battery. In some embodiments, a battery is rechargeable. In some embodiments, a battery can be removed and replaced.

In some embodiments, a container 100 includes one or more access ports 125, 120. The access ports 125, 120 are configured to permit access to interior regions of the container 100. In some embodiments, one or more access ports 125, 120 are sealed with a gas-impermeable seal during manufacture of the container 100 and not intended for further use. In some embodiments, the access ports 125, 120 are sealed with a gas-impermeable seal during manufacture of the container 100 but configured for reopening during recharge, repair or refreshment of the container 100 over time and between periods of use of the container 100.

A substantially thermally sealed storage container 100 is fabricated from materials with sufficient strength and durability to be transported and reused over time. The substantially thermally sealed storage container 100 is constructed from materials that are resistant to corrosion in the presence of the specific liquid(s) and desiccant material(s) utilized in a specific embodiment. The substantially thermally sealed storage container 100 is constructed from materials of sufficient durability, strength and toughness for transport, use, and reuse in a given embodiment. For example, the outer wall 150 of the container, the outer wall 110 of the conduit 130, the first and second vapor conduits 180, 185 and the outer wall of the desiccant unit 170 can be fabricated from a metal, such as stainless steel or aluminum. In some embodiments, the container is fabricated from a diversity of materials, one or more composite, and/or alloys. In some embodiments, the container is partially fabricated from a polycarbonate plastic. Some embodiments include a substantially evacuated space within the container 100 structure, and in such embodiments the components of the container 100 that are positioned adjacent to the substantially evacuated space within the container 100 are selected for sufficient durability, strength and toughness for the expected use of the container 100 as well as for low outgassing properties into the substantially evacuated space within the container 100. For example, in some embodiments the container 100 includes substantially evacuated space within the container 100 with a gas pressure less than approximately $1\times10^{-2}$ torr, less than $5\times10^{-3}$ torr, less than $5\times10^{-4}$ torr, less than $5\times10^{-5}$ torr, less than $5\times10^{-6}$ torr or less than $5\times10^{-7}$ torr.

Figure 2:
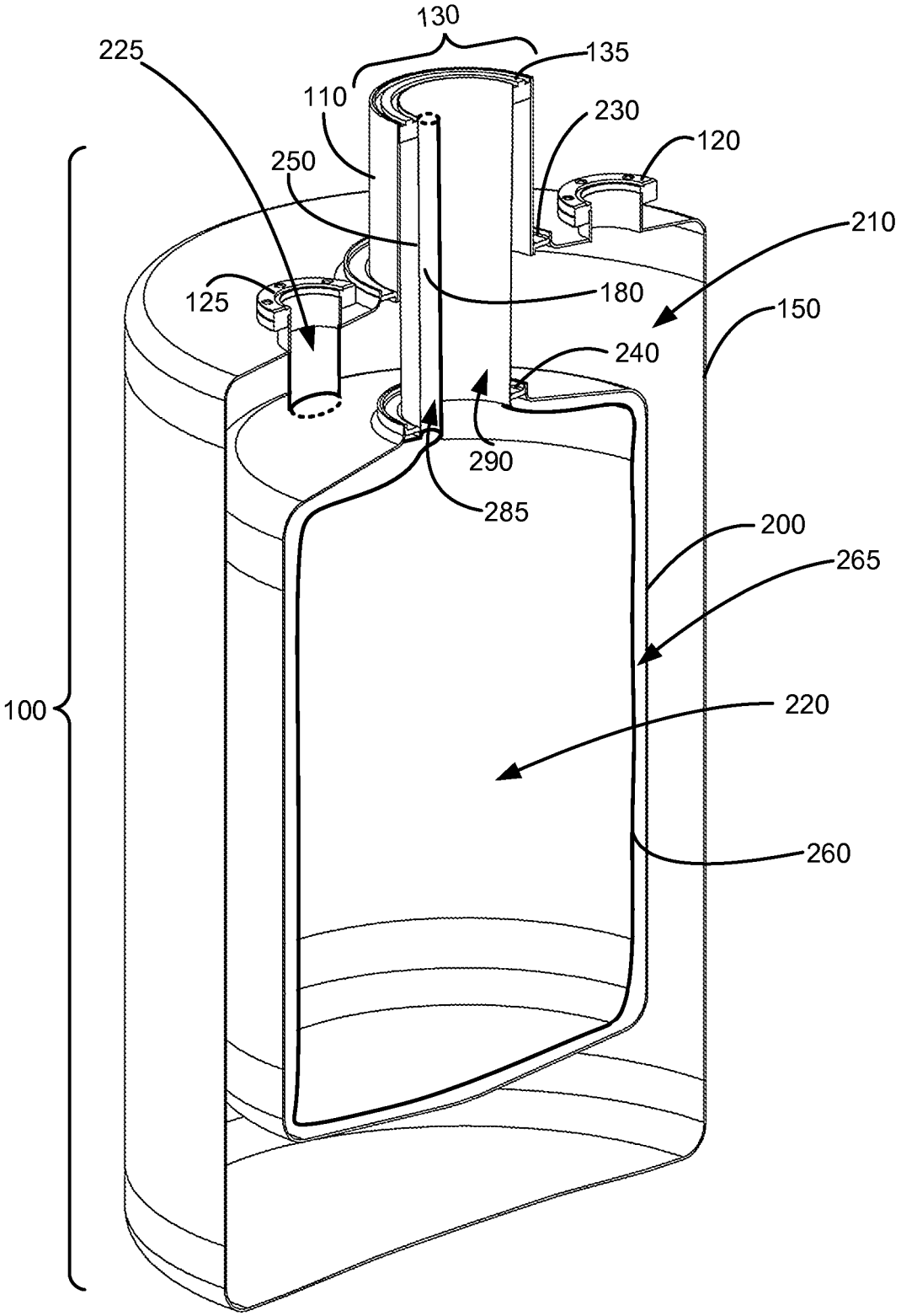
FIG. 2 is a schematic of a substantially thermally sealed storage container illustrated in cross-section.

FIG. 2 depicts a cross-section view of a substantially thermally sealed storage container 100. The view illustrated in FIG. 2 is a vertically bisected container illustrating aspects of the container 100, including aspects of the interior. The container includes an outer wall 150 and an interior wall 200. The outer wall 150 substantially defines the substantially thermally sealed storage container 100. The outer wall 150 of the container substantially defines a single outer wall 150 aperture at the top and center of the container 100. The interior wall 200 is a substantially similar shape as the outer wall 150, but sized to fit within the outer wall 150. The inner wall 150 includes an aperture positioned at a corresponding location to the aperture in the outer wall 150.

The interior wall 200 and the outer wall 150 are separated by a distance and together substantially define a gas-sealed gap 210 in the interior of the container 100. The gas-sealed gap 210 can include a gas pressure significantly below atmospheric pressure. The gas-sealed gap 210 can include substantially evacuated space. Some embodiments include at least one section of ultra-efficient insulation material disposed within the gas-sealed gap 210 between the interior wall 200 and the outer wall 150. The gas-sealed gap 210 can include both ultra-efficient insulation material and a gas pressure significantly below atmospheric pressure. For example, in some embodiments the gas-sealed gap 210 includes substantially evacuated space having a pressure less than or equal to $1\times10^{-2}$ torr. For example, in some embodiments the gas-sealed gap 210 includes substantially evacuated space having a pressure less than or equal to $5\times10^{-4}$ torr. For example, in some embodiments the gas-sealed gap 210 includes substantially evacuated space having a pressure less than or equal to $1\times10^{-2}$ torr in the gas-sealed gap 210. For example, in some embodiments the gas-sealed gap 210 includes substantially evacuated space having a pressure less than or equal to $5\times10^{-4}$ torr in the gas-sealed gap 210. In some embodiments, the gas-sealed gap 210 includes substantially evacuated space having a pressure less than $1\times10^{-2}$ torr, for example, less than $5\times10^{-3}$ torr, less than $5\times10^{-4}$ torr, less than 5×10–5 torr, $5\times10^{-6}$ torror $5\times10^{-7}$ torr. For example, in some embodiments the gas-sealed gap 210 includes a plurality of layers of multilayer insulation material and substantially evacuated space having a pressure less than or equal to $1\times10^{-2}$ torr. For example, in some embodiments the gas-sealed gap 210 includes a plurality of layers of multilayer insulation material and substantially evacuated space having a pressure less than or equal to $5\times10^{-4}$ torr.

The term "ultra efficient insulation material," as used herein, can include one or more type of insulation material with extremely low heat conductance and extremely low heat radiation transfer between the surfaces of the insulation material. The ultra efficient insulation material can include, for example, one or more layers of thermally reflective film, high vacuum, aerogel, low thermal conductivity bead-like units, disordered layered crystals, low density solids, or low density foam. In some embodiments, the ultra efficient insulation material includes one or more low density solids such as aerogels, such as those described in, for example: Fricke and Emmerling, Aerogels-preparation, properties, applications, Structure and Bonding 77: 37-87 (1992); and Pekala, Organic aerogels from the polycondensation of resorcinol with formaldehyde, Journal of Materials Science 24: 3221-3227 (1989), which are each herein incorporated by reference. As used herein, "low density" can include materials with density from about 0.01 g/cm$^3$ to about 0.10 g/cm$^3$, and materials with density from about 0.005 g/cm$^3$ to about 0.05 g/cm$^3$. In some embodiments, the ultra efficient insulation material includes one or more layers of disordered layered crystals, such as those described in, for example: Chiritescu et al., Ultralow thermal conductivity in disordered, layered $WSe_2$ crystals, Science 315: 351-353 (2007), which is herein incorporated by reference. In some embodiments, the ultra efficient insulation material includes at least two layers of thermal reflective film separated, for example, by at least one of: high vacuum, low thermal conductivity spacer units, low thermal conductivity bead like units, or low density foam. In some embodiments, the ultra efficient insulation material can include at least two layers of thermal reflective material and at least one spacer unit between the layers of thermal reflective material. For example, the ultra-efficient insulation material can include at least one multiple layer insulating composite such as described in U.S. Pat. No. 6,485,805 to Smith et al., titled "Multilayer insulation composite," which is herein incorporated by reference. For example, the ultra-efficient insulation material can include at least one metallic sheet insulation system, such as that described in U.S. Pat. No. 5,915,283 to Reed et al., titled "Metallic sheet insulation system," which is herein incorporated by reference. For example, the ultra-efficient insulation material can include at least one thermal insulation system, such as that described in U.S. Pat. No. 6,967,051 to Augustynowicz et al., titled "Thermal insulation systems," which is herein incorporated by reference. For example, the ultra-efficient insulation material can include at least one rigid multilayer material for thermal insulation, such as that described in U.S. Pat. No. 7,001,656 to Maignan et al., titled "Rigid multilayer material for thermal insulation," which is herein incorporated by reference.

In some embodiments, an ultra efficient insulation material includes at least one material described above and at least one superinsulation material. As used herein, a "superinsulation material" can include structures wherein at least two floating thermal radiation shields exist in an evacuated double-wall annulus, closely spaced but thermally separated by at least one poor-conducting fiber-like material.

In some embodiments, one or more sections of the ultra efficient insulation material includes at least two layers of thermal reflective material separated from each other by magnetic suspension. The layers of thermal reflective material can be separated, for example, by magnetic suspension methods including magnetic induction suspension or ferromagnetic suspension. For more information regarding magnetic suspension systems, see Thompson, Eddy current magnetic levitation models and experiments, IEEE Potentials, February/March 2000, 40-44, and Post, Maglev: a new approach, Scientific American, January 2000, 82-87, which are each incorporated herein by reference. Ferromagnetic suspension can include, for example, the use of magnets with a Halbach field distribution. For more information regarding Halbach machine topologies and related applications, see Zhu and Howe, Halbach permanent magnet machines and applications: a review, IEE Proc.-Electr. Power Appl. 148: 299-308 (2001), which is herein incorporated by reference.

Also as shown in FIG. 2, a connector 250 is positioned to form part of the access conduit 130 between the outer wall aperture and the interior wall aperture. For example, a connector can be formed as a substantially cylindrical structure corresponding to the shape of the outer wall 110 of the access conduit 130, with a smaller diameter than the outer wall 110 of the access conduit 130. A seal 240 attaches the external surface of the connector 250 with the region of the interior wall 200 adjacent to the aperture. A seal 230 attaches the external surface of the connector 250 with the region of the outer wall 150 adjacent to the aperture. In the region of the container 100 external to the outer wall 150, the outer wall 110 of the conduit 130 is positioned substantially parallel to the connector 250, with a gap between the outer wall 110 of the conduit 130 and the connector 250. The seal 135 is positioned to create a gas-impermeable barrier between the outer wall 110 of the access conduit 130 and the connector 250. The seal 135 can be formed by a material suitable for a particular embodiment, such as a weld, a crimp and fold, or an additional component sealed to both the outer wall 110 of the conduit 130 and to the connector 250 to form the seal 135. At the end of the conduit 130 distal to the seal 135, the end of the conduit 130 substantially defines a single access aperture to a substantially thermally sealed storage region 220 within the container 100. The interior 290 of the conduit 130, therefore, forms an access region for the interior of the storage region 220 of the container 100.

In some embodiments, the access conduit 130 forms an elongated thermal pathway between the single access aperture to the thermally-controlled storage region 220 and an exterior region of the container 100. For example, the access conduit 130 can be of sufficient length to minimize air passage, and therefore thermal transfer, between the thermally-controlled storage region 220 and an exterior region of the container 100. For example, the access conduit 130 can be configured to minimize thermal transfer between the interior wall 200, the inner wall 260 and an exterior region of the container 100. For example, the access conduit 130 can include materials and/or structure configured to minimize thermal transfer between the interior wall 200, the inner wall 260 and an exterior region of the container 100. Some embodiments include a corrugated structure forming an elongated thermal pathway between the single access aperture to the thermally-controlled storage region 220 and an exterior region of the container 100. For example, the connector 250 of the access aperture can be formed with a pleat structure, with the folds substantially perpendicular to the length of the access conduit 130.

The container 100 illustrated in FIG. 2 includes a substantially thermally sealed storage region 220 within the interior of the container 100. In some embodiments, a substantially thermally sealed storage container includes a plurality of storage regions. For example, a substantially thermally sealed storage container can include a first storage region substantially separated with an internal divider from a second storage region. For example, a substantially thermally sealed storage container can include, in some embodiments, a first storage region maintained at a first temperature, and a second storage region maintained at a second temperature. See, for example, FIGS. 7 and 8 as well as their associated text. In the embodiment illustrated in FIG. 3, the substantially thermally sealed storage region is a uniform space. Some embodiments include a substantially thermally sealed storage region that has structures for the storage of specific materials. For example, a substantially thermally sealed storage region within a container can be calibrated to maintain an internal temperature between 0 degrees Centigrade and 10 degrees Centigrade, and include one or more storage structures of a size, shape and configuration to hold medicinal vials, such as vaccine vials. For example, a substantially thermally sealed storage region within a container can be calibrated to maintain an internal temperature between 2 degrees Centigrade and 8 degrees Centigrade, and include one or more storage structures of a size, shape and configuration to hold medicinal vials, such as vaccine vials.

As described herein, a substantially thermally sealed storage container includes a storage region 220 that is substantially thermally sealed and also temperature controlled through the evaporative cooling system integral to the container. The combination of the thermal properties of a specific embodiment of a container along with the characteristics of an integral evaporative cooling system result in a substantially thermally sealed storage region that is controlled to maintain temperatures within the substantially thermally sealed storage region within a predetermined temperature range. For example, in some embodiments a substantially thermally sealed storage container is fabricated with a heat transfer of approximately 5 W between the exterior of the container and the interior of the substantially thermally sealed storage region. In such an embodiment, desiccant units primarily including calcium chloride (CaCl) and an evaporative liquid primarily including water can be utilized with a vapor control system to maintain the interior of the substantially thermally sealed storage region in a temperature range between 0 degrees Centigrade and 10 degrees Centigrade for a period of weeks. For example, the interior of the substantially thermally sealed storage region can be maintained in a temperature range between 2 degrees Centigrade and 8 degrees Centigrade for at least 30 days in such a container.

In the embodiment illustrated in FIG. 2, the container 100 includes two access ports, 120, 125. Each of the access ports 120, 125 provides access to an interior region of the container when required, such as during fabrication or refurbishment of the container 100. The access ports can be utilized, for example, during fabrication of the container 100 to establish a gas pressure within the gas-sealed gap 210 that is lower than atmospheric pressure. For example, in the illustration shown in FIG. 2, an access port 120 is substantially sealed but is positioned to have been useful for the establishment of a gas pressure within the gas-sealed gap 210 that is lower than atmospheric pressure during fabrication of the container. The container 100 shown in FIG. 2 also includes an access port 125 connected by a conduit 225 to a region within the interior wall 200. This access port 125 is sealed during fabrication of the container 100, but prior to sealing the access port 125 can be utilized to provide access to the region within the interior wall 200. For example, the access port 125 can be used to position a liquid within the liquid-impermeable gap 265 during fabrication of the container. In some embodiments, one or more access port 120, 125 can be configured to be opened during refreshment, repair or recharging of the container 100 between uses.

FIG. 2 also illustrates that the container 100 includes an inner wall 260. The inner wall 260 is sealed to the interior wall 200 along a junction defined by the seal 240 with the connector 250 of the access conduit 130. The inner wall 260 and the interior wall 200 are positioned and fabricated so as to be separated by a liquid-impermeable gap 265. A surface of the inner wall 260 faces the liquid-impermeable gap 265, and the opposing surface of the inner wall 260 faces the substantially thermally sealed storage region 220 within the container. Although not illustrated in FIG. 2, in some embodiments the liquid-impermeable gap 265 contains an evaporative liquid, which is a liquid with evaporative properties under the expected temperatures and gas pressures of the liquid-impermeable gap 265 during use of the container 100. For example, in some embodiments the liquid-impermeable gap 265 includes a partial gas pressure of approximately 5% of atmospheric pressure external to the container, and the liquid within the liquid-impermeable gap 265 includes water. For example, in some embodiments the liquid-impermeable gap 265 includes a partial gas pressure of approximately 10% of atmospheric pressure external to the container, and the liquid within the liquid-impermeable gap 265 includes methanol. For example, in some embodiments the liquid-impermeable gap 265 includes a partial gas pressure of approximately 15% of atmospheric pressure external to the container, and the liquid within the liquid-impermeable gap 265 includes ammonia.

A vapor conduit 180 is positioned substantially within the interior region 290 of the conduit 130. The vapor conduit 180 includes a first end and a second end. In the view illustrated in FIG. 2, only the first end is visible. The first end of the vapor conduit 180 is sealed to an aperture in the inner wall 260. The second end of the vapor conduit 180, which is not visible in FIG. 2, is sealed to the vapor control unit, and thereby creating a controllable vapor pathway to the interior of the desiccant unit (not shown in FIG. 2; see FIG. 1). The liquid impermeable gap 265 formed between the inner wall 260 and the interior wall 200 is directly connected to the interior region 285 of the vapor conduit 180. The liquid impermeable gap 265 formed between the inner wall 260 and the interior wall 200 is in vapor contact with the interior region 285 of the vapor conduit 180 so that vapor can freely pass from the liquid impermeable gap 265 through the vapor conduit 180. The vapor can then pass through the vapor control unit when the attached valve is in an open position, and to the interior of the desiccant unit (not shown in FIG. 2; see FIG. 1). The vapor conduit 180 is of a size and shape to permit free gas flow between the interior of the desiccant unit and the liquid impermeable gap 265 when the valve of the vapor control unit is in a fully open position. In some embodiments, the vapor conduit 180 is a substantially round, tubular structure. In some embodiments, the vapor conduit 180 is a substantially flattened structure. In some embodiments, the vapor conduit 180 is a plurality of closely associated structures, e.g. a series of substantially parallel tubular structures. The interior dimensions of the vapor conduit 180 vary depending on the size of the container 100, the liquid impermeable gap 265, the vapor control unit, and the desiccant unit. The vapor conduit 180 is of a size and shape to permit gas and vapor to flow freely and without substantial hindrance between the liquid impermeable gap 265 and the desiccant unit when the valve of the vapor control unit is in a fully open position.

Figure 3:
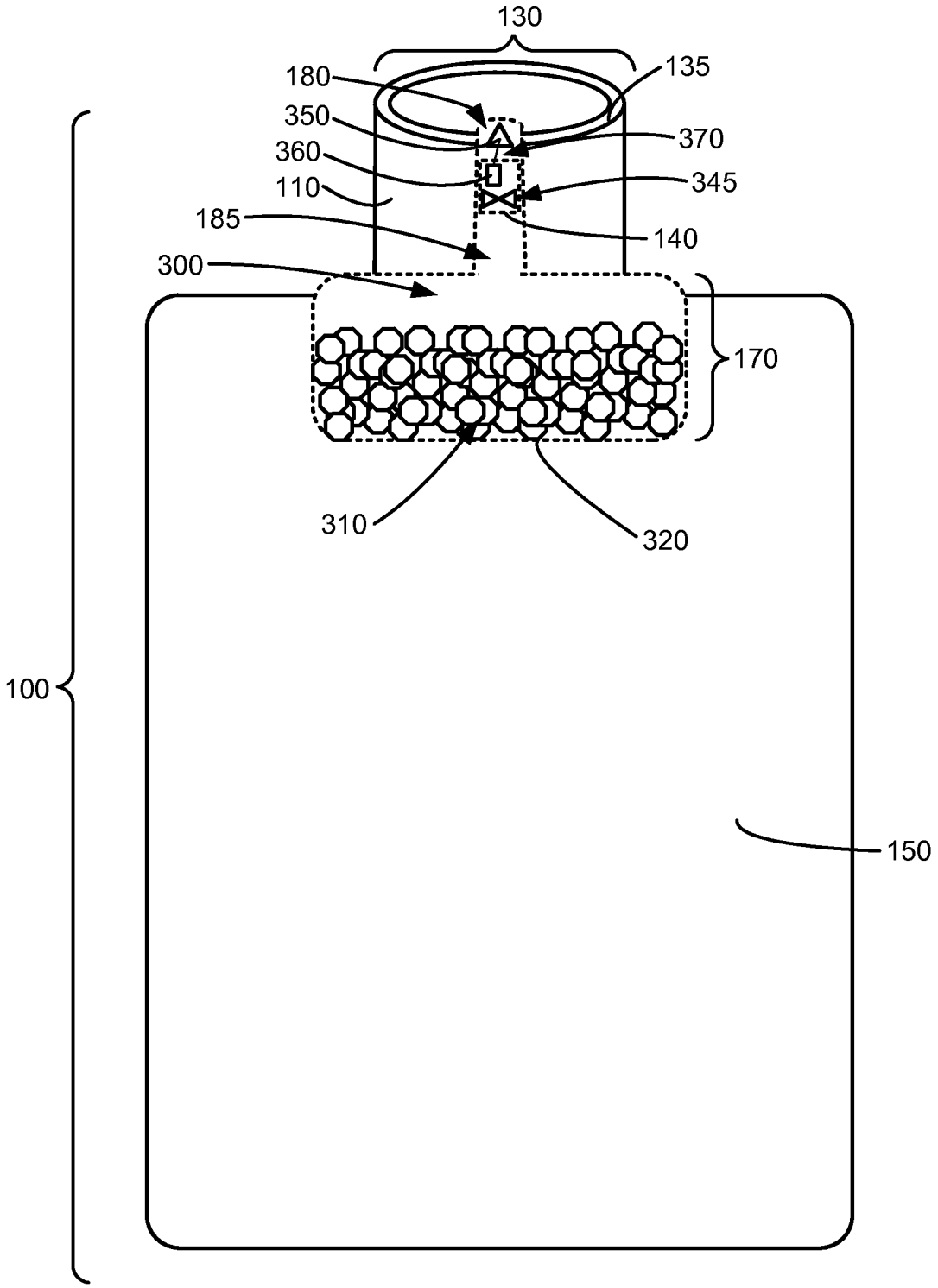
FIG. 3 illustrates aspects of a substantially thermally sealed storage container.

FIG. 3 illustrates aspects of an embodiment of a substantially thermally sealed storage container 100 from an exterior viewpoint to the container, with a cross-section view through a portion of the evaporative cooling unit. FIG. 3 illustrates a substantially thermally sealed storage container 100 including an access conduit 130. The outer wall 110 of the access conduit 130 is sealed to an inner wall with a seal 135 at the top edge of the access conduit 130. A vapor conduit 180 traverses through the access conduit 130 from the interior of the container (not visible in FIG. 3, see, e.g. FIG. 2) to a region adjacent to the outer wall 110 of the access conduit 130 and the outer wall 150 of the container 100. FIG. 3 illustrates a cross-section view through the external portion of the first and second vapor conduits 180, 185, the attached vapor control unit 140 and the desiccant unit 170.

As shown in FIG. 3, the desiccant unit 170 includes an outer wall 320. The outer wall 320 substantially defines the external boundaries of the desiccant unit 170. The outer wall 320 is positioned adjacent to the outer wall 150 of the container 100. The outer wall 320 includes an aperture, which is surrounded by the end of the second vapor conduit 185 distal to the vapor control unit 140. The end of the second vapor conduit 185 distal to the vapor control unit 140 is sealed to the surface of the outer wall 320 of the desiccant unit 170 with a gas-impermeable seal. The desiccant unit 170 includes an interior space 300. The interior space 300 is contiguous with the interior of the end of the vapor conduit 185 distal to the vapor control unit 140, with free flow of gas between the interior space 300 of the desiccant unit 170 and the interior of the adjacent vapor conduit 185. A plurality of units of desiccant material 310 are positioned within the interior space 300 of the desiccant unit 170. Although the units of desiccant material 310 are illustrated as a mass, in some embodiments they may be arrayed in a regular pattern to promote maximum surface contact of the desiccant material 310 with the gas within the interior space 300 of the desiccant unit 170. In some embodiments, the units of desiccant material 310 include a structure or a coating of a size and shape to promote gas circulation around each of the units of desiccant material 310.

The outer wall 320 of the desiccant unit 170 can be fabricated from a variety of materials, depending on the embodiment. The outer wall 320 can be fabricated from a material with sufficient strength to retain its shape in the presence of an interior space 300 gas pressure less than atmospheric pressure. For example, depending on the embodiment, the outer wall 320 can be fabricated from stainless steel, aluminum, polycarbonate plastic, glass, or other materials. In some embodiments, the desiccant unit 170 can include an interior liner positioned adjacent to the outer wall 320. For example, an interior liner can be configured to protect the material of the outer wall 320 from any possible corrosion from the desiccant material 310 utilized in a specific embodiment.

The units of desiccant material 310 are fabricated from at least one material with desiccant properties, or the ability to remove liquid from a liquid vapor in the surrounding space. Units of desiccant material 310 can operate, for example, through the absorption or adsorption of water from the water vapor in the surrounding space. One or more units of desiccant material 310 selected will depend on the specific embodiment, particularly the volume required of a sufficient quantity of desiccant material to absorb liquid for the estimated time period required to operate a specific evaporative cooling unit integral to a specific container. In some embodiments, the units of desiccant material 310 selected will be a solid material under routine operating conditions. One or more units of desiccant material 310 can include non-desiccant materials, for example binding materials, scaffolding materials, or support materials. One or more units of desiccant material 310 can include desiccant materials of two or more types. The containers described herein are intended for use with evaporative cooling for days or weeks, and sufficient desiccant material and corresponding liquid is included for those time periods in any given embodiment. For more information on liquid-desiccant material pairs, see: Saha et al., "A New Generation Cooling Device Employing $CaCl_2$-in-silica Gel-water System," *International Journal of Heat and Mass Transfer*, 52: 516-524 (2009), which is incorporated by reference. The selection of one or more desiccant materials 310 for use in a specific embodiment will also depend on the target cooling temperature range in a specific embodiment. For example, in some embodiments the desiccant material can include calcium carbonate. For example, in some embodiments, the desiccant material can include lithium chloride. For example, in some embodiments, the desiccant material can include liquid ammonia. For example, in some embodiments, the desiccant material can include zeolite. For example, in some embodiments, the desiccant material can include silica. More information regarding desiccant materials is available in: Dawoud and Aristov, "Experimental Study on the Kinetics of Water Vapor Sorption on Selective Water Sorbents, Silica Gel and Alumina Under Typical Operating Conditions of Sorption Heat Pumps," *International Journal of Heat and Mass Transfer*, 46: 273-281 (2004); Conde-Petit, "Aqueous Solutions of Litium and Calcium Chlorides:—Property Formulations for Use in Air Conditioning Equipment Design," *M. Conde Engineering*, (2009); "Zeolite/Water Refrigerators," BINE Informationsdienst, projektinfo 16/10; "Calcium Chloride Handbook: A Guide to Properties, Forms, Storage and Handling," Dow Chemical Company, (August, 2003); "Calcium Chloride, A Guide to Physical Properties," Occidential Chemical Corporation, Form No. 173-01791-0809P&M; and Restuccia et al., "Selective Water Sorbent for Solid Sorption Chiller: Experimental Results and Modelling," *International Journal of Refrigeration*27:284-293 (2004), which are each incorporated herein by reference. In some embodiments, a desiccant material is considered non-toxic under routine handling precautions. The selection of a desiccant material is also dependent on any exothermic properties of the material, in order to retain the thermal properties of the entire container desired in a specific embodiment.

FIG. 3 illustrates aspects of a vapor control unit 140 attached to the first vapor conduit 180 adjacent to the interior of the container and the second vapor conduit 185 attached to the desiccant unit 170. In some embodiments, a vapor control unit is integral to a vapor conduit. In some embodiments, a vapor control unit 140 includes a power source, such as a battery, operably connected to one or more other components. In some embodiments, a vapor control unit 140 does not include an electric power source, for example a vapor control unit can be mechanically powered.

The vapor control unit 140 includes a valve 345. The valve 345 is configured to reversibly impede the flow of gas, including vapor, through the vapor control unit 140, and therefore, between the first vapor conduit 180 and the second vapor conduit 185. The valve 345 can be a plurality of valves, for example a plurality of valves in series along a single conduit within the vapor control unit. The valve 345 can be a plurality of valves, for example a plurality of valves each attached to a separate conduit within the vapor control unit 140, each of the plurality of valves reversibly controllable to open and close the attached conduit. In some embodiments, the valve 345 includes at least one movable valve with at least a first position substantially closing the at least one movable valve to vapor flow through the at least one movable valve, and a second position substantially opening the at least one movable valve to vapor flow through the at least one movable valve. Some embodiments include a movable valve with at least a first position substantially closing vapor flow through the vapor control unit, at least one second position substantially permitting flow of vapor through the vapor control unit to the maximum permitted by the diameter of the vapor control unit, and at least one third position restricting vapor flow through the vapor control unit. In some embodiments, the valve 345 includes a mechanical valve. In some embodiments, the valve 345 includes a gate valve. In some embodiments, the valve 345 includes rotary valve, such as a butterfly valve. In some embodiments, the valve 345 includes a ball valve. In some embodiments, the valve 345 includes a piston valve. In some embodiments, the valve 345 includes a globe valve. In some embodiments, the valve 345 includes a gate valve. In some embodiments, the valve 345 includes In some embodiments, the valve 345 includes a plurality of valves operating in tandem with each other. In some embodiments, the valve 345 includes an electronically-controlled valve. In some embodiments, the valve 345 includes a mechanically-controlled valve. The selection of the valve 345 in a given embodiment depends on, for example, cost, weight, the sealing properties of a type of valve, the estimated failure rate of a type of valve, the durability of a type of valve under expected use conditions, and the power consumption requirements for a type of valve. The selection of the valve 345 in a given embodiment also depends on the level of restriction of gas flow, including vapor flow, through a particular type of valve when the valve is in a fully open position.

Also included within the vapor control unit 140 is a controller 360. The controller 360 is operably connected to the valve 345. The valve 345 is operably connected to the controller 360, and configured to be responsive to the controller 360. The controller 360 is configured to respond to one or more temperature sensors 350 by acting to alter the position of the valve 345. The controller 360 is configured to respond in a specific manner depending on the temperature detected by the temperature sensor 350. For example, a controller 360 can be configured to respond to a temperature above a threshold temperature by acting to cause a complete opening or closure of the valve 345. For example, a controller 360 can be configured to respond to a temperature below a threshold temperature by acting to cause closure of the valve 345. For example, a controller 360 can be configured to respond to a temperature within a temperature range by acting to cause partial opening of the valve 345. For example, a controller 360 can be configured to respond to a temperature within a temperature range by acting to cause partial closure of the valve 345. Although a connection is not illustrated in FIG. 3 between the controller 360 and the valve 345, an operable connection exists between the controller 360 and the valve 345. For example, in some embodiments, the operable connection includes a connector configured to transmit physical pressure, such as a rod or cog. For example, in some embodiments, the operable connection includes a connector configured to transmit electronically, such as through a wire or wireless connection, such as through an IR or short wavelength radio transmission (e.g. Bluetooth).

Different types of controllers can be utilized, depending on the embodiment. For example, a controller 360 can be an electronic controller. In some embodiments, a controller 360 is an electronic controller that accepts data from a plurality of temperature sensors 350 and initiates action by the valve 345 after determination of an average temperature from the accepted data. An electronic controller can include logic and/or circuitry configured to create a bounded or threshold system around a particular range of values from one or more sensors, such as a bounded system around a range of 3 degrees Centigrade to 7 degrees Centigrade, responsive to data from one or more temperature sensors. For example, in some embodiments a controller 360 is a "bang-bang" controller operably attached the valve 345 and configured to be responsive to a temperature sensor 350 that includes a thermocouple. An electronic controller can include logic and/or circuitry configured to create a feedback system around a particular range of values from one or more sensors, such as a feedback system around a range of 2 degrees Centigrade to 8 degrees Centigrade, responsive to data from one or more temperature sensors. For example, in some embodiments a controller 360 is a mechanical controller. For example, in some embodiments the controller 360 is attached to a Bourdon tube operably connected to the valve 345, and configured to respond to changes in vapor pressure associated with temperature differences. Embodiments including a mechanical controller can also include a connector that forms an operable connection between the controller and the valve that is a mechanical connector. For example, a mechanical connector can be a connector configured to transmit physical pressure, such as through operation of one or more rods or cogs, between the controller and the valve.

In the embodiment shown in FIG. 3, a sensor 350 is positioned within the vapor conduit 180 at a position adjacent to the end of the vapor conduit 180 within the interior of the container 100. In some embodiments, a sensor 350 is configured to detect the temperature of the gas present in the interior of the vapor conduit 180. In some embodiments, a sensor 350 is configured to detect the partial pressure of the gas present in the interior of the vapor conduit 180. The sensor 350 illustrated in FIG. 3 is positioned adjacent to the vapor control unit 140 at the side of the vapor control unit 140 adjacent to the interior of the container 100. In some embodiments, a sensor is positioned within the vapor conduit 180 at a region within the conduit 130. In some embodiments, a sensor is positioned within the vapor conduit 180 at a region within the interior of the container. In some embodiments, a sensor is positioned within a liquid-impermeable gap adjacent to the substantially thermally sealed storage region within the container 100, and configured to detect the temperature of gas or liquid within that gap. Some embodiments include a plurality of sensors positioned in series or parallel. A sensor 350 can include, for example, depending on the embodiment, an electronic temperature sensor, a chemical temperature sensor, or a mechanical temperature sensor. A sensor 350 can include, for example, a low-energy temperature sensor, such as a Thermodo device (Robocat, Copenhagen, Denmark). A sensor 350 can include, for example, depending on the embodiment, an electronic gas pressure sensor, or a mechanical gas pressure sensor. A sensor 350 for measurement of gas pressure can include a Bourdon tube. A sensor 350 for measurement of gas pressure can include a diaphragm-based gas pressure sensor. A sensor 350 for measurement of temperature can include, for example, a thermocouple. A sensor 350 can include a combined sensor of gas pressure, gas composition, and temperature. For example, a sensor 350 can include a NODE device, (Variable Technologies, Chattanooga Tenn.). In some embodiments, a sensor can include a power source, such as a battery.

Some embodiments include a sensor that is a temperature sensor. A temperature sensor can include, for example, a mechanical temperature sensor. A temperature sensor can include, for example, an electronic temperature sensor. By way of example, some embodiments include a sensor that is a temperature sensor including one or more of: a thermocouple, a bimetallic temperature sensor, an infrared thermometer, a resistance thermometer, or a silicon bandgap temperature sensor.

Some embodiments include a sensor that is a gas pressure sensor. A gas pressure sensor can include, for example, a mechanical gas pressure sensor, such as a Bourdon tube. A gas pressure sensor can include, for example, an electronic gas pressure sensor. By way of example, some embodiments include a sensor that is a vacuum sensor. For example, the interior of a vapor conduit can be substantially evacuated, or at a low gas pressure relative to atmospheric pressure, before use of a container and then the vacuum reduced during evaporation from the evaporative liquid. Data from a vacuum sensor can, therefore, be indicative of the rate of evaporation, or the total level of evaporation of the evaporative liquid within the container. In some embodiments, a gas pressure sensor can include a piezoresistive strain gauge, a capacitive gas pressure sensor, or an electromagnetic gas pressure sensor.

A sensor 350 can transmit data to a controller 360 that is an electronic controller via a wire 370, as illustrated in FIG. 3. However, depending on the embodiment, different types of connections between the controller 360, a sensor 350 and a valve 345 are possible. For example, in some embodiments, a sensor includes a thermocouple configured to put physical pressure on a mechanical controller that transmits that physical pressure to a control element of a valve to result in the opening or closing of the valve. For example, in some embodiments, a sensor includes an electronic temperature sensor that sends data regarding detected temperature to an electronic controller via a wire or wireless connection, such as through an IR or short wavelength radio transmission (e.g. Bluetooth).

In embodiments including an electronic controller, the electronic controller receives data from one or more sensors, and determines if the detected values are outside or inside of a predetermined range. Depending on the determination, the electronic controller can initiate the valve to open or close to return the temperature or pressure to the predetermined range of values. For example, in some embodiments, if the electronic temperature sensor sends a signal including temperature data at 9 degrees Centigrade, the controller will determine that the received temperature data is outside of the predetermined range of 3-7 degrees Centigrade. In response to the determination, the controller will send a signal to a motor attached to a valve within the vapor control unit, the signal of a type to initiate the motor to open the valve. As another example, in some embodiments, if the electronic temperature sensor sends a signal including temperature data at 1 degree Centigrade, the controller will determine that the received temperature data is outside of the predetermined range of 3-7 degrees Centigrade. In response to the determination, the controller will send a signal to a motor attached to a valve within the vapor control unit, the signal of a type to initiate the motor to close the valve.

An electronic temperature sensor can send data at a plurality of data points. In some embodiments, an electronic controller can accept a plurality of temperature data points from one or more temperature sensor, and calculate a temperature result, such as an average temperature, or a mean temperature, from the accepted data. The electronic controller can then determine if the temperature result is outside or inside of a predetermined temperature range. For example, in some embodiments, a predetermined temperature range is between 0 degrees and 10 degrees Centigrade. For example, in some embodiments, a predetermined temperature range is between 2 degrees and 8 degrees Centigrade. For example, in some embodiments, a predetermined temperature range is between 0 degrees and 5 degrees Centigrade. For example, in some embodiments, a predetermined temperature range is between 5 degrees and 15 degrees Centigrade. For example, in some embodiments, a predetermined temperature range is between 5 degrees and −5 degrees Centigrade. For example, in some embodiments, a predetermined temperature range is between −15 degrees and −25 degrees Centigrade. For example, in some embodiments, a predetermined temperature range is between −25 degrees and −35 degrees Centigrade.

In some embodiments, an electronic controller can accept a plurality of gas pressure data points from one or more gas pressure sensors, and calculate a gas pressure result, such as an average gas pressure, or a mean gas pressure, from the accepted data. The electronic controller can then determine if the gas pressure result is outside or inside of a predetermined gas pressure range for the specific container. For example, gas pressure out of a specific, predetermined range can indicate an excess of evaporation of the liquid, resulting in excess evaporative cooling for the specific container. For example, gas pressure out of a specific, predetermined range can indicate a lack of absorption or adsorption by the desiccant material, indicating that the desiccant material needs to be refreshed or renewed. The gas pressure range is relative to the internal dimensions of the evaporative cooling unit, the conduits, the vapor control unit and the desiccant unit for an embodiment. The gas pressure range is also relative to the type of evaporative liquid, the type of desiccant material, and the predetermined temperature range for cooling in an embodiment. See: Dawoud and Aristov, "Experimental Study on the Kinetics of Water Vapor Sorption on Selective Water Sorbents, Silica Gel and Alumina Under Typical Operating Conditions of Sorption Heat Pumps," *International Journal of Heat and Mass*Transfer, 46: 273-281 (2004); Marquardt, "Introduction to the Principles of Vacuum Physics," CERN Accelerator School, (1999); Kozubal et al., "Desiccant Enhanced Evaporative Air-Conditioning (DEVap): Evaluation of a New Concept in Ultra Efficient Air Conditioning," NREL Technical Report NREL/TP-5500-49722 (January 2011); Conde-Petit, "Aqueous Solutions of Litium and Calcium Chlorides:—Property Formulations for Use in Air Conditioning Equipment Design," *M. Conde Engineering,* (2009); "Zeolite/Water Refrigerators," BINE Informationsdienst, projektinfo 16/10; "Calcium Chloride Handbook: A Guide to Properties, Forms, Storage and Handling," Dow Chemical Company, (August, 2003); "Introduction of Zeolite Technology into Refrigeration Systems: Layman's Report," Dometic project LIFE04 ENV/LU/000829; Rezk and Al-Dadah, "Physical and Operating Conditions Effects on Silica Gel/Water Adsorption Chiller Performance," *Applied Energy* 89: 142-149 (2012); Saha et al., "A New Generation Cooling Device Employing $CaCl_2$-in-silica Gel-water System," International Journal of Heat and Mass Transfer 52: 516-524 (2009); "An Introduction to Zeolite Molecular Sieves," UOP Company Brochure 0702 A 2.5; and "Vacuum and Pressure Systems Handbook," Gast Manufacturing, Inc., which are each incorporated by reference. An equation to calculate the pressure loss in vacuum lines with water vapor is available from GEA Wiegand, a copy accessed at the company website (http://produkte.gea-wiegand.de/GEA/GEACategory/139/index_en.html) on Mar. 13, 2013 is incorporated herein by reference.

An evaporatively-cooled container, such as those described herein, can be stored for a period of time prior to use. In some embodiments, the container is configured to be cooled with a heat sink material, such as ice, when such is available. The container can also be used without a heat sink, such as an ice block, and cooled with the evaporative cooling system when desired by a specific user. In some embodiments, the integral evaporative cooling system can be left inactive for periods of time, such as during storage of the container prior to or between uses, or when a heat sink material such as ice is not available. During these periods of non-activity of the container, the valve within the vapor control unit is left in a fully closed position, substantially blocking vapor flow through the vapor conduit. When a period of evaporative cooling is desired, a user can activate the evaporative cooling system of the container by activating the controller and opening the valve within the vapor control unit. The integral evaporative cooling system of the container will then begin to actively cool the interior storage region for a period of time, the duration of which depends on factors including the relative to the size of the container, the amount of liquid available, the amount of desiccant material available, the target temperature range for the storage region, and the thermal properties of the container. For example, in an embodiment including approximately 1 liter of liquid water and 500 g of a desiccant material including calcium chloride can maintain a temperature range between 0 and 10 degrees Centigrade for approximately 30 days in a storage region of a container with no more than 5 W of heat leak from the storage region to the region external to the container.

Figure 4:
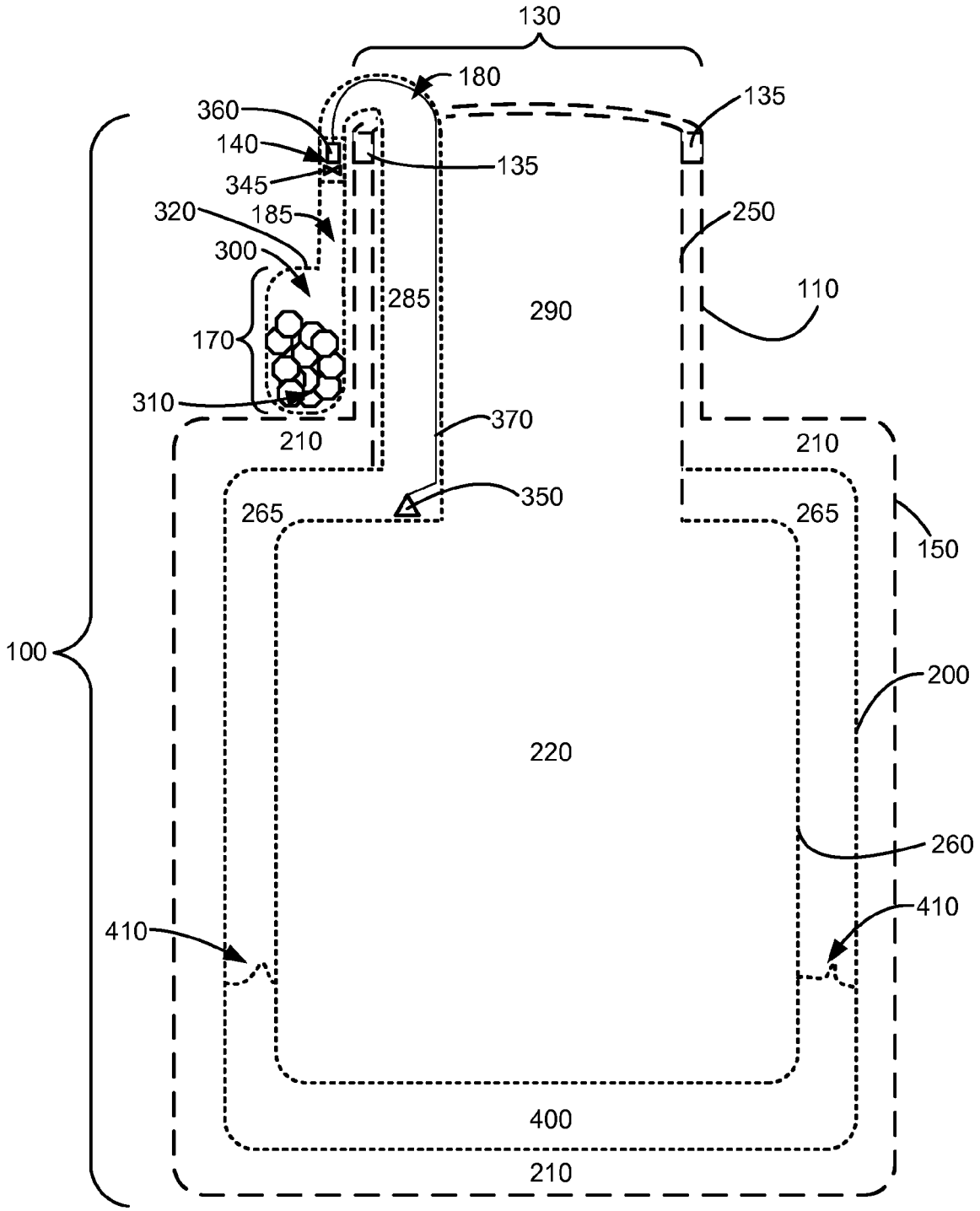
FIG. 4 depicts a schematic of a substantially thermally sealed storage container illustrated in cross-section.

FIG. 4 illustrates a cross-section view of a substantially thermally sealed storage container 100. As shown in FIG. 4, the substantially thermally sealed storage container 100 includes an outer assembly and an evaporative cooling assembly integral to the container 100. The outer assembly includes one or more sections of ultra efficient insulation material within the gap 210 between the outer wall 150 and the interior wall 200 of the container, as well as between the outer wall 110 and the connector 250 of the conduit 130. In some embodiments, an ultra efficient insulation material within the gap 210 can include, for example, multilayer insulation material (MLI) surrounded by substantially evacuated space. In some embodiments, the gap 210 is gas-impermeable, and includes substantially evacuated space. In some embodiments, the ultra efficient insulation material within the gap 210 can include, for example, aerogel. The ultra efficient insulation material substantially defines a thermally-controlled storage region 220 and a single access conduit 130 to the thermally-controlled storage region 220. In some embodiments, the single access conduit includes a connector with a corrugated structure forming an elongated thermal pathway. For example, in some embodiments, the single access conduit includes a connector with a corrugated structure with a plurality of pleat structures positioned essentially parallel to the plane formed by the end of the conduit 130. The evaporative cooling assembly integral to the container 100 includes an evaporative cooling unit attached to a surface of the at least one thermally controlled storage region 220, a desiccant unit 170 affixed to an external surface of the container 100, and a first and second vapor conduit 180, 185. The first vapor conduit 180 is attached at one end to the evaporative cooling unit, and at the other end to the vapor control unit 140. The second vapor conduit 185 is attached at one end to the desiccant unit, and at the other end to the vapor control unit 140.

In the embodiment illustrated in FIG. 4, the evaporative cooling unit integral to the container 100 includes a first wall formed by the interior wall 200 of the container 100. The evaporative cooling unit integral to the container 100 also includes a second, inner wall 260 which is sealed to the interior wall 200 of the container 100, forming a liquid-impermeable gap 265 between the walls 200, 260. In the view illustrated, an evaporative liquid 400 is positioned within the liquid-impermeable gap 265 between the walls 200, 260. The evaporative liquid 400 has a surface 410 that is below the top of the liquid-impermeable gap 265, thereby providing non-liquid filled space above the surface 410 of the evaporative liquid.

During fabrication of the container 100 in an embodiment such as illustrated in FIG. 4, the liquid-impermeable gap 265 between the walls 200, 260, the interior of the vapor conduit 285 and the interior space 300 of the desiccant unit 170 are evacuated, for example with a vacuum pump. The vacuum pump can be attached, for example to an access conduit 225 such as illustrated in FIG. 2. After a predetermined gas pressure, which is lower than atmospheric pressure, is achieved within the liquid-impermeable gap 265 between the walls 200, 260, the interior of the vapor conduit 285 and the interior space 300 of the desiccant unit 170, the combined spaces are sealed to form a gas-impermeable combined interior space. For example, in some embodiments the combined interior spaces are reduced to a gas pressure of no more than 20 torr. For example, in some embodiments the combined interior spaces are reduced to a gas pressure of no more than 10 torr. For example, in some embodiments the combined interior spaces are reduced to a gas pressure of no more than 5 torr. For example, in some embodiments the combined interior spaces are reduced to a gas pressure of no more than 1 torr. The liquid-impermeable gap 265 between the walls 200, 260, the interior of the vapor conduit 285 and the interior space 300 of the desiccant unit 170, therefore, form an internal region of reduced gas pressure within the container 100. Due to the design of the container and the integral evaporative cooling system, the gas that is present within this internal region can flow freely between the liquid-impermeable gap 265, the interior of the vapor conduit 285 and the interior space 300 of the desiccant unit 170 when the valve 345 is in a fully open configuration.

During use of the container 100, the evaporative liquid 400 will evaporate at a rate relative to the temperature of the evaporative liquid 400 and the vapor pressure of the evaporative liquid 400 within the liquid-impermeable gap 265. The rate of evaporation for any specific evaporative liquid at a specific time will occur relative to the temperature of the evaporative liquid at the time, the partial pressure of the evaporative liquid, as well as the physical properties of that specific liquid. For example, at 10 degrees Centigrade, the vapor pressure of water, based on its physical properties, is approximately 9 torr. Therefore, when the temperature of the evaporative liquid 400 within the container is 10 degrees Centigrade, the liquid will tend to evaporate as long as the vapor pressure within the adjacent liquid-impermeable gap 265 is less than approximately 9 torr. As an additional example, the vapor pressure of water, based on its physical properties, is approximately 6.8 torr at 5 degrees Centigrade. Therefore, when the temperature of the evaporative liquid 400 within the container is 5 degrees Centigrade, the liquid will tend to evaporate as long as the vapor pressure within the adjacent liquid-impermeable gap 265 is less than approximately 6.8 torr. For any given embodiment, the evaporation temperatures of the included evaporative liquid at different internal vapor pressures can be calculated using standard equations and the physical properties of the included evaporative liquid. Furthermore, as the vapor pressure of the specific evaporative liquid utilized in an embodiment rises within the adjacent liquid-impermeable gap 265, the evaporation rate and associated evaporative cooling will diminish. See, e.g. Rezk et al., "Physical and Operating Conditions Effects on Silica Gel/water Adsorption Chiller Performance," *Applied Energy* 89: 142-149 (2012), which is incorporated by reference herein. This can be utilized to create an expected lower cooling temperature boundary for a particular embodiment.

During use of the container 100, evaporation will cool the evaporative liquid 400 and the space of the liquid-impermeable gap 265 through the physical effect of evaporative cooling. See: Wang et al., "Study of a Novel Silica Gel-Water Adsorption Chiller. Part I. Design and Performance Prediction," *International Journal of Refrigeration* 28: 1073-1083 (2005); U.S. Pat. No. 6,584,797 "Temperature-Controlled Shipping Container and Method for Using Same," to Smith and Roderick; U.S. Pat. No. 6,688,132 "Cooling Device and Temperature-Controlled Shipping Container Using Same," to Smith et al.; U.S. Pat. No. 6,701,724 "Sorption Cooling Devices," to Smith et al.; and U.S. Pat. No. 6,438,992 "Evacuated Sorbent Assembly and Cooling Device Incorporating Same," to Smith et al., which are each incorporated by reference herein. See also: "Cool-System Presents: CoolKeg® The World's First Self-chilling Keg!" by Coolsystem Company; Sketch of Larry D. Hall's Homemade Icyball; "Icyball is Practical Refrigerator for Farm or Camp Use," advertisement; and the entry labeled "Steam Jet Cycle" from www.machine-history.com, which are each incorporated by reference. When the evaporative liquid 400 is at a lower temperature than the storage region 220, heat from the storage region 220 will equilibrate through conduction through the inner wall 260 to the evaporative liquid 400, thereby cooling the interior storage region 220. Since the liquid-impermeable gap 265, the interior of the vapor conduit 285 and the interior space 300 of the desiccant unit 170 include a contiguous, gas-sealed space when the valve 345 is in a fully open position, the vapor phase of the evaporated liquid will disperse throughout the combined spaces. When the vapor phase of the evaporated liquid comes into contact with the desiccant material 310 in the desiccant unit 170, some of the liquid vapor will be removed from the gas phase and become associated with the desiccant material 310 until the desiccant material 310 is saturated with the evaporative liquid 400. The removal of liquid vapor in the desiccant unit 170 will reduce the partial pressure of the vapor phase of the evaporative liquid 400 within the entirety of the liquid-impermeable gap 265, the interior of the vapor conduit 285 and the interior space 300 as long as the valve 345 is in a fully open position. A reduced vapor pressure will create further evaporative cooling within the liquid-impermeable gap 265. Control of the movement of the vapor phase of the evaporative liquid 400 through the valve 345 controls the amount of the vapor phase of the evaporative liquid 400 present within the interior space 300 of the desiccant unit 170, and the associated reduction of partial pressure of the vapor phase of the evaporative liquid within the liquid-impermeable gap 265. By closing and opening the valve 345 in response to information from the sensor 350, the controller 360 can act to control the rate of evaporation of the evaporative liquid 400 and the associated evaporative cooling of the storage region 220.

Different embodiments of an evaporative cooling unit integral to the container 100 include different types of evaporative liquids. In some embodiments, the liquid includes water. In some embodiments, the liquid includes an alcohol, such as methanol or ethanol. A specific evaporative liquid is selected based on the evaporation rate of the liquid in the temperature ranges targeted by a specific embodiment, as well as the absorption rate of the vapor phase of the evaporative liquid by the desiccant material utilized in the embodiment. In any given embodiment, the evaporation rate of the evaporative liquid is promoted by the desiccant material, which removes the liquid vapor from the gas and promotes further evaporation of the evaporative liquid. In some embodiments, for example, the evaporative liquid includes water, and the desiccant material includes calcium chloride. Evaporation of the evaporative liquid induces a cooling effect on the evaporative cooling unit affixed to the surface of the thermally controlled storage region. The evaporation rate is controlled by action of the valve 345, as directed by the controller 360 in response to data received from a sensor 350. In some embodiments, the sensor 350 can provide data to the controller 360 through a wire connection 370. For example, if the sensor 350 is a temperature sensor that provides a temperature reading to the controller 360 that is above a predetermined level, the controller 360 can operate to affect an opening of the valve 345. For example, if the sensor 350 provides a temperature reading to the controller 360 that is below a predetermined level, the controller 360 can operate to affect a closure of the valve 345. In some embodiments, the controller 360 only operates to fully open or close the valve 345. In some embodiments, the controller 360 can operate to partially open and/or partially close the valve 345, creating intermediate control of the evaporative cooling by controllably restricting the vapor passage through the valve 345. The ongoing detection of sensor data combined with control of the valve, and the resulting control of the evaporation rate of the evaporative liquid, provides control of the temperature within the storage region 220 through thermal conduction between the storage region 220 and the adjacent liquid-impermeable gap 265.

FIG. 4 illustrates aspects of the desiccant unit 170, which is external to and attached to the exterior of the container 100. FIG. 4 depicts a plurality of units of desiccant material 310 within the desiccant unit 170. A gas-filled space 300 provides gas contact between the plurality of units of desiccant material 310 and the interior of the adjacent end of the second vapor conduit 185. In some embodiments, the desiccant unit 170 includes a vapor-sealed chamber including an interior desiccant region in vapor contact with an interior region of the second vapor conduit 185. In some embodiments, the desiccant unit 170 includes a vapor-impermeable region within the desiccant unit 170, the vapor-impermeable region in vapor contact with the interior of the second vapor conduit 185.

Some embodiments also include a gas vent mechanism configured to allow gas with pressure beyond a preset limit to vent externally from the desiccant unit 170. For example, the wall 320 of the desiccant unit 170 can include a region configured to break when the internal gas pressure rises above a threshold level. For example, the desiccant unit 170 can include an additional valve connected to a region external to the desiccant unit 170 and configured to open in response to excessive gas pressure within the gas-filled space 300 of the desiccant unit 170. Some embodiments include a gas vent mechanism configured to allow gas of a temperature beyond a preset limit to vent externally from the desiccant unit 170. For example, a desiccant unit 170 can include a temperature sensor, such as a thermocouple, within the gas-filled space 300 of the desiccant unit 170, the temperature sensor operably connected to a one-way valve configured to vent gas from the gas-filled space 300 if the detected temperature is above a preset threshold.

The desiccant unit 170 is operably attached to the second vapor conduit 185 at one end of the conduit. The second vapor conduit 185 is attached to the vapor control unit 140 at the distal end of the conduit. The vapor control unit 140 is configured to control vapor flow between the interior region 265 of the evaporative cooling unit and the interior region 300 of the desiccant unit 170 through the first vapor conduit 180 and the second vapor conduit 185. As shown in FIG. 4, in some embodiments the first and second vapor conduits 185, 180 are configured as a tubular structure traversing the single access conduit 130 of the container 100. The first and second vapor conduits 180, 185 are configured to allow sufficient gas, including evaporated vapor, to move to the interior region 300 of the desiccant unit 170 in situations where maximum evaporative cooling of the container is desired. Therefore, the size, shape and placement of the first and second vapor conduits 180, 185 will depend on factors including the size of the container, the temperature ranges desired for the container, and the physical properties of the desiccant material and the evaporative liquid utilized in a particular embodiment. For example, in some embodiments the target temperature range of the storage region is between 0 and 10 degrees Centigrade, and the container includes approximately 1 liter of liquid water and a corresponding volume of desiccant material including calcium chloride to absorb greater than 1 liter of water. See "The Calcium Chloride Handbook, A Guide to Properties, Forms, Storage and Handling," DOW Chemical Company, dated August 2003, which is incorporated by reference herein. FIG. 4 illustrates that some embodiments include a sensor 350 that is a temperature sensor within the interior region 265 of the evaporative cooling unit and operably connected to the controller 360 within the vapor control unit 140 with a wire connection 370. Some embodiments include a plurality of sensors, including temperature sensors.

The vapor control unit 140 is connected between the first vapor conduit 180 and the second vapor conduit 185. In the embodiment illustrated in FIG. 4, the vapor control unit 140 is integral to, and substantially internal to, the ends of the first and second vapor conduits 180, 185. The vapor control unit 140 includes a valve 345 and a controller 360. The controller 360 is operably connected to a sensor 350 with a wire connection 370. The controller 360 is operably connected to the valve 345 within the vapor control unit 140. In some embodiments, the vapor control unit 140 includes: a thermocouple unit configured to respond to the temperature of vapor in the vapor conduit 180; a valve 345 configured to regulate vapor flow through the vapor control unit 140; and a controller 360 operably connected to the thermocouple unit and to the valve 345.

Figure 5:
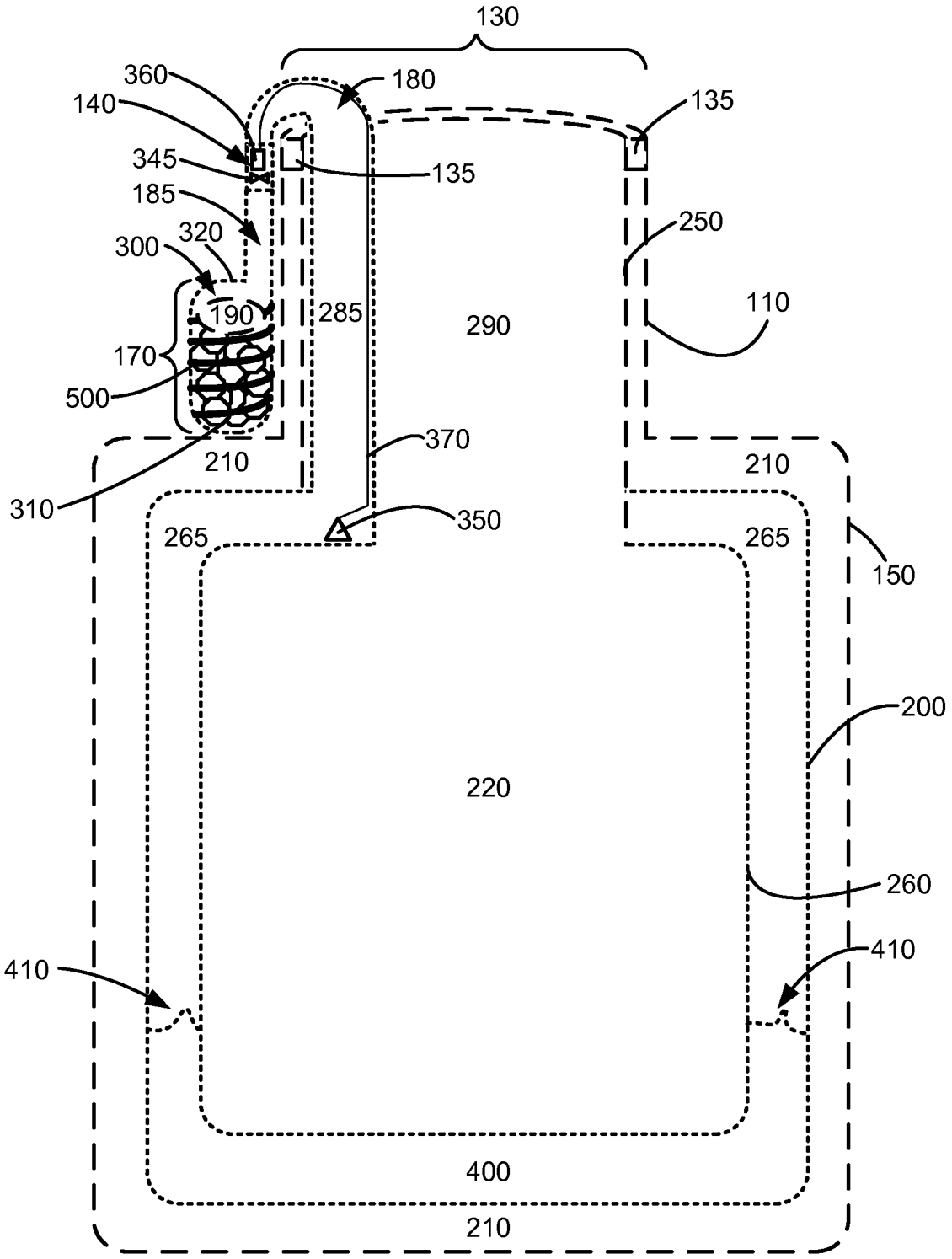
FIG. 5 shows a schematic of a substantially thermally sealed storage container illustrated in cross-section.

FIG. 5 shows aspects of an embodiment of a substantially thermally sealed storage container 100. The view and embodiment illustrated in FIG. 5 is similar to that shown in FIG. 5. In the embodiment illustrated in FIG. 5, the desiccant unit 170 also includes a heating element 500 within the desiccant unit 170, the heating element 500 configured to heat an internal, liquid-impermeable chamber of the desiccant unit 170. For example, the heating element 500 can include an electrical heating coil positioned around the interior of the desiccant unit 170 and in thermal contact with the plurality of units of desiccant material 310. In some embodiments, the heating element is positioned external to the desiccant unit 170, for example adjacent to the external wall 320 of the desiccant unit 170. For example, the heating element can include a heat lamp positioned adjacent to the exterior surface of the desiccant unit 170. Some embodiments include a power source 190 operably attached to the heating element 500. For example, the power source 190 can include one or more of: a battery pack, an electric plug configured to receive AC or DC power from an external source, a solar panel, or a mechanical generator (e.g. a crank mechanism for a mechanical electricity generator).

Some embodiments include a display unit operably attached to the vapor conduit, such as directly to a temperature sensor within the vapor conduit. A display unit can include, for example, a light, a screen display, an e-ink display or a similar device. Some embodiments include a display unit operably attached to the vapor control unit. The display unit can, for example, be operably connected to the controller and configured to receive signals from the controller indicating conditions regarding the interior of the container. For example, in embodiments including a light as a display unit, the controller can be configured to make a transmission to the light initiating the light to switch on when data accepted from the sensor indicates that the interior temperature of the container is within a preset temperature range. For example, in embodiments including a screen display, the controller can be configured to transmit data regarding the conditions of the container to the screen display, such as the most recent internal temperature reading(s), the most recent gas pressure reading(s), or the position of the valve 345. Some embodiments include a user input device, such as a push-button, a touch sensor, or a keypad. The user input device can be operably attached to the controller. For example, the controller may be configured to respond to a specific user input, as transmitted by a user input device, by opening the valve within the vapor conduit. For example, the controller may be configured to respond to a specific user input, as transmitted by a user input device, by closing the valve within the vapor conduit. For example, the controller may be configured to respond to a specific user input, as transmitted by a user input device, by initiating a display of the most recent temperature data on an attached screen display.

Figure 6:
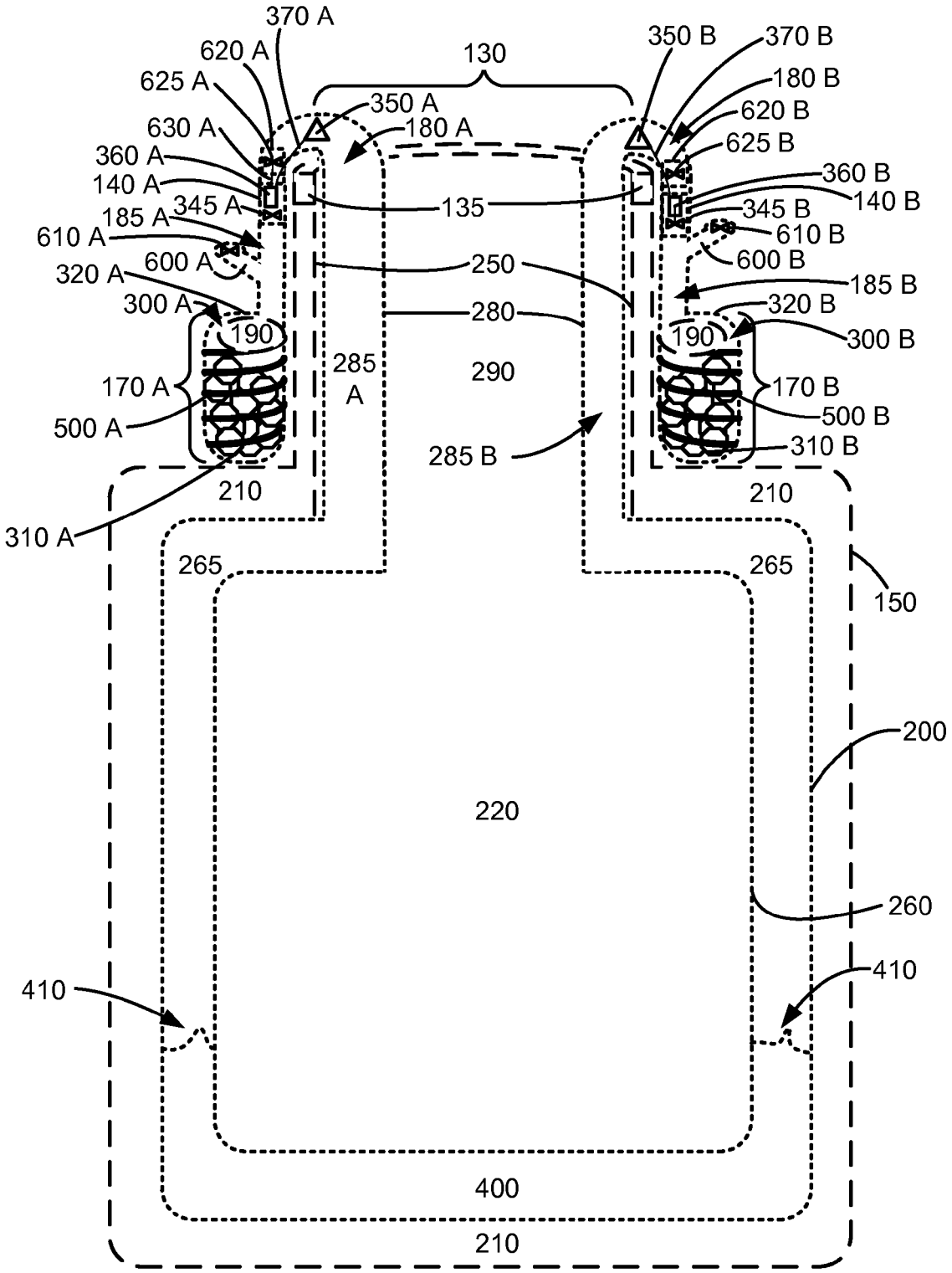
FIG. 6 illustrates a schematic of a substantially thermally sealed storage container illustrated in cross-section.

FIG. 6 illustrates aspects of an embodiment of a substantially thermally sealed storage container 100 in a cross-section view, similar to the views shown in FIGS. 4 and 5. FIG. 6 depicts a substantially thermally sealed storage container 100 including an outer wall 150 and an interior wall 200 forming a substantially gas sealed gap 210 between the walls. The walls 150, 200 are attached to an outer wall and the conduit 250 of a single access conduit 130 at the upper region of the container 100. A seal 135 creates a gas-sealed gap between the outer wall and connector 250 of the single access conduit 130. The gap 210 can include an ultra-efficient insulation material within the gap 210. The container 100 includes an inner wall 260, which is configured to form a gas-sealed gap 265 between the interior wall 200 and the inner wall 260. The gas-sealed gap 265 includes an evaporative liquid 400 with a surface region 410. The gas-sealed gap 265 is connected to two first vapor conduits, 180 A, 180B. Each of the vapor conduits, 180 A, 180 B traverse the interior of the conduit 130 and wrap around the outer surface of the conduit 130 to attach to an adjacent desiccant unit 170 A, 170 B. Each of the desiccant units 170 A, 170 B include a heating element 500 A, 500 B within the desiccant unit 170 A, 170 B and attached to the outer wall 310 A, 310 B of the respective desiccant unit 170 A, 170 B. Each of the respective heating elements 500 A, 500 B are operably attached to a power source 190 A, 190 B. The second vapor conduit 185 A, 185 B attached to each of the desiccant units 170 A, 170 B includes a side conduit 600 A, 600 B. Each of the respective side conduits 600 A, 600 B terminate with a sealing valve 610 A, 610 B configured to form a gas-impermeable seal on the end of the side conduit 600 A, 600 B. The sealing valves 610 A, 610 B can be, for example, one-way pressure valves configured to permit the release of gas beyond a specific pressure from within the attached side conduit 600 A, 600 B. The sealing valves 610 A, 610 B can be, for example, one-way pressure valves configured to permit the release of gas beyond a specific temperature.

A control unit 140 A, 140 B is positioned adjacent to, and attached to, each of the second vapor conduits 185 A, 185 B at and end of the second vapor conduits at a position between the side conduit 600 A, 600 B and the interior of the container 100. The control units 140 A, 140 B each include a valve, 345 A, 345 B configured to form a gas-impermeable seal across the respective control units 140 A, 140 B, and therefore between the attached first vapor conduit 180 A, 180 B and the attached second vapor conduits 185 A, 185 B. The control units 140 A, 140 B each include a controller 360 A, 360 B operably attached to the valve, 345 A, 345 B. The controllers 360 A, 360 B are each also attached to a sensor 350 A, 350 B attached to an inner surface of the first vapor conduit 180 A, 180 B. A connector 370 A, 370 B operably attaches the controller 360 A, 360 B and the sensor 350 A, 350 B. Although a wire connector 370 A, 370 B is illustrated, in some embodiments the controller 360 A, 360 B and the sensor 350 A, 350 B are connected with a wireless connection, such as infra-red (IR) or short range radio signals (e.g. Bluetooth).

An externally-controllable sealing unit 620 A, 620 B including a externally-controllable valve 625 A, 625 B is positioned within the first vapor conduit 180 A, 180 B at a position external to the container 100. In some embodiments, the externally-controllable sealing unit 620 A, 620 B can include, for example, a magnetically-controllable valve 625 A, 625 B configured to form and detach a gas-impermeable seal within the first vapor conduit 180 A, 180 B in response to an external magnetic field. In some embodiments, the externally-controllable sealing unit 620 A, 620 B can include, for example, an externally-controllable valve 625 A, 625 B with a manual control wheel positioned externally wherein the externally-controllable valve 625 A, 625 B is of a size and shape to form and detach a gas-impermeable seal across the internal diameter of the first vapor conduit 180 A, 180 B in response to external turning of the manual control wheel. For example, an externally-controllable valve 625 A, 625 B can include a butterfly valve within the first vapor conduit 180 A, 180 B, the butterfly valve externally-operable by a hand crank external to the first vapor conduit.

Over the duration of use of a container such as the one illustrated in FIG. 6, a quantity of liquid 400 may be transferred from the gas-sealed gap 265 interior of the container to the desiccant material 310 A, 310 B. In order for the container to remain operational with control of the evaporative cooling unit within a particular, predetermined temperature range, the desiccant material 310 A, 310 B must be periodically recharged by removal of the associated evaporative liquid. In an embodiment such as the one illustrated in FIG. 6, an externally-controllable valve 625 A, 625 B can be used to effectively seal the first vapor conduit 180 A, 180 B between one of the desiccant units 170 A, 170 B and the gas-sealed gap 265 and the liquid surface 410 during recharging of a desiccant unit 170 A, 170 B while the remaining desiccant unit 170 A, 170 B remains operational. In some embodiments, the user can choose to use either the A or the B side of the desiccant units 170 A, 170 B, or both sides, at a given time. Some embodiments include a controller that automatically utilizes either the A or the B side of the desiccant units 170 A, 170 B, or both sides, at a given time. The desiccant unit 170 A, 170 B sealed from the gas-sealed gap at a particular time can be heated with the attached heating unit 500 A, 500 B, resulting in vaporization of the evaporative liquid associated with the desiccant material 310 A, 310B. This vaporized evaporative liquid is removed from the system via the sealing valve 610 A, 610 B. After refreshment, the sealing valve 610 A, 610 B is closed, and the externally-controllable valve 625 A, 625 B can be opened when desired for evaporative cooling of the container and further absorption of vapor by the desiccant material.

Alternatively, in some embodiments the vapor conduit 180 A, 180 B includes a detachment mechanism configured to permit the removal of a desiccant unit 170 A, 170 B from the container for recharging and/or refreshment. For example, a desiccant unit 170 A, 170 B can be configured to be removable, wherein the desiccant material can be refreshed or replaced, then the desiccant unit can be reattached to the container for continued use.

Figure 7:
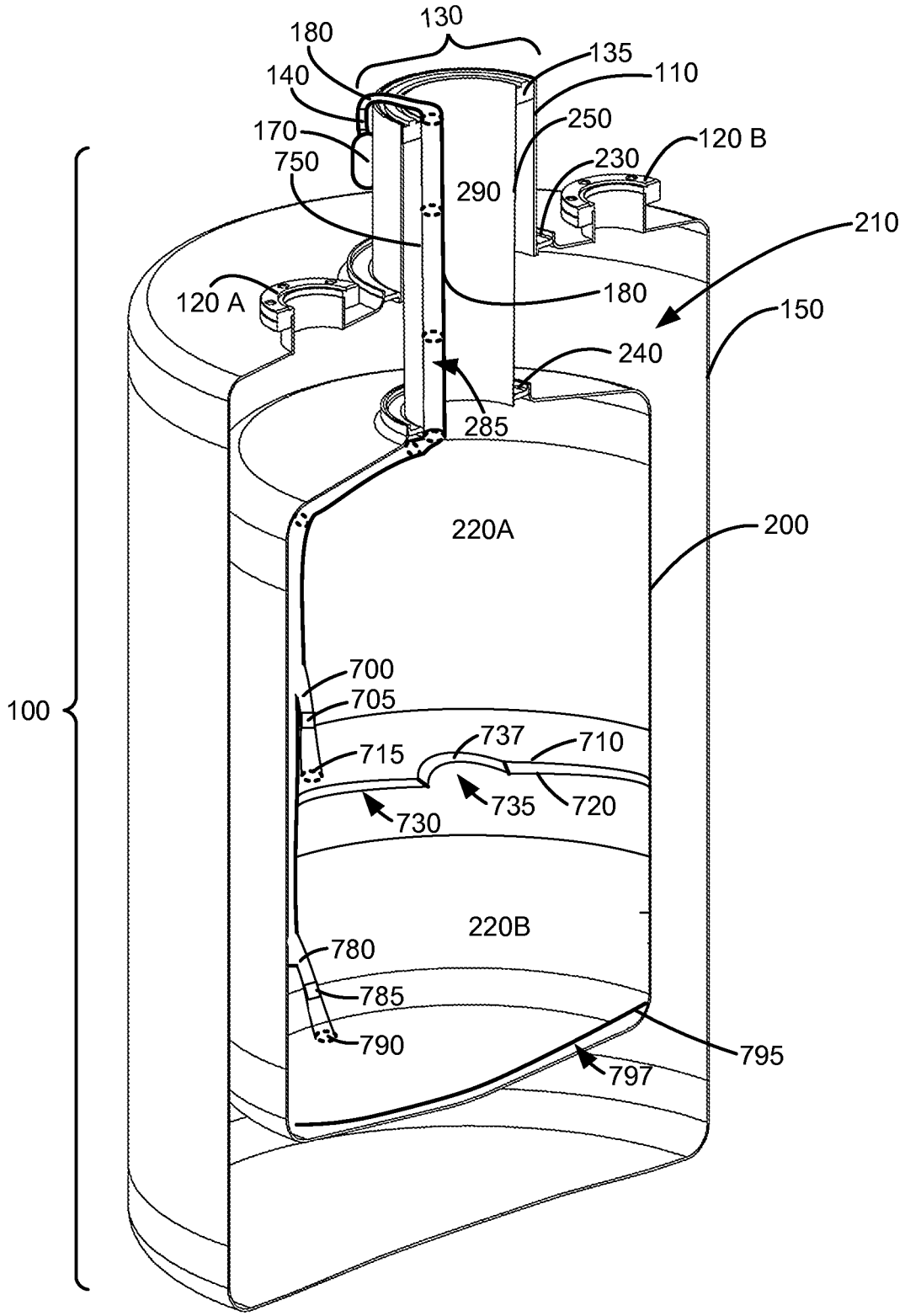
FIG. 7 depicts a schematic of a substantially thermally sealed storage container illustrated in cross-section.

FIG. 7 illustrates aspects of an embodiment of a substantially thermally sealed storage container 100. The substantially thermally sealed storage container 100 includes an outer wall 150 substantially defining a substantially thermally sealed storage container 100, the outer wall 150 substantially defining a single outer wall aperture. The container 100 includes a desiccant unit 170 external to the outer wall 150, the desiccant unit 170 including at least one aperture connected to a vapor conduit. The container 100 also includes an interior wall 200 substantially defining a thermally-controlled storage area 220 within the container 100, the interior wall 200 substantially defining a single interior wall aperture. The interior wall 200 and the outer wall 150 are separated by a distance and substantially define a gas-sealed gap 210. The container 100 includes a connector 250 forming the internal wall of a single access conduit 130 connecting the single outer wall aperture with the single interior wall aperture. The connector 250 is sealed 230 to the single outer wall aperture and sealed 240 to the single interior wall aperture. The container 100 includes a single access aperture to the thermally-controlled storage area 220, wherein the single access aperture is defined by an end of the access conduit 130. The container 100 also includes a primary vapor conduit 180 positioned substantially within the access conduit 130, the primary vapor conduit 180 including a first end and a second end, the first end traversing the at least one aperture in the interior wall, the second end sealed to a primary vapor control unit 140. The primary vapor control unit 140 is also sealed to the vapor conduit attached to the desiccant unit 170. The primary vapor control unit 140 includes a valve configured to create a gas-impermeable seal across the interior of the primary vapor control unit 140. A gas-impermeable seal across the interior of the primary vapor control unit 140 also blocks vapor flow through the length of the interior 285 of the primary vapor conduit 180. The primary vapor control unit 140 includes a controller operably attached to the valve, and a sensor operably attached to the controller.

The container 100 includes a first inner wall 710 and a second inner wall 720 each attached to the interior wall 200, the inner walls 710, 720 positioned to form a first liquid-impermeable gap 730 between the first 710 and second 720 inner walls, the first 710 and second 720 inner walls together forming a floor to a first storage region 220 A in the thermally-controlled storage area 220. The container 100 includes an aperture 715 in the first inner wall 710. A first regional vapor conduit 700 is attached to the primary vapor conduit 180, the first regional vapor conduit 700 including a first end and a second end, the first end sealed to the primary vapor conduit 180, the second end sealed to the aperture 715 in the first inner wall 710. A first regional vapor control unit 705 is attached to the first regional vapor conduit 700. The container 100 includes a third inner wall 795 attached to the interior wall 200, the third inner wall 795 positioned to form a second liquid-impermeable gap 797 between the third inner wall 795 and the interior wall 200, the third inner wall 795 forming a floor to a second storage region 220 B in the thermally-controlled storage area. There is an aperture 790 in the third inner wall 795. The container 100 includes a second regional vapor conduit 780 attached to the end of the primary vapor conduit 180. The second regional vapor conduit 780 includes a first end and a second end, the first end sealed to the primary vapor conduit 180, the second end sealed to the aperture 790 in the third inner wall 795. The container 100 includes a second regional vapor control unit 785 attached to the second regional vapor conduit 780. A concavity 735 in the first 710 and second 720 inner walls creates an inner aperture to permit access to the second storage region 220 B. The concavity is sealed with a liquid-impermeable seal 737.

In an embodiment such as the one illustrated in FIG. 7, each of the first and second regional vapor control units 705, 785 are configured to independently regulate the gas transfer from, and therefore the evaporation of, evaporative liquid in each of the first liquid-impermeable gap 730 and the second liquid-impermeable gap 797, respectively. In some embodiments, each of the first liquid-impermeable gap 730 and the second liquid-impermeable gap 797 include the same evaporative liquid. For example, each of the first liquid-impermeable gap 730 and the second liquid-impermeable gap 797 can include an evaporative liquid that is water. In some embodiments, the first liquid-impermeable gap 730 and the second liquid-impermeable gap 797 include different evaporative liquids, both of which are absorbed by the desiccant material within the desiccant unit 170. For example, in some embodiments the first liquid-impermeable gap 730 can include an evaporative liquid that is water while the second liquid-impermeable gap 797 can include an evaporative liquid that is methanol, while the desiccant material includes calcium chloride. Each of the regional vapor control units 705, 785 includes a regional controller, and a valve operably attached to the controller, the valve configured to reversibly create a gas-impermeable seal across the attached regional vapor conduit 700, 780, and a temperature sensor operably attached to the controller. Each of the regional vapor control units 705, 785 can be preset to operate the attached valve in a preset temperature range, creating a first storage region 220 A and a second storage region 220 B retained at different temperatures during use. For example, a container 100 can include a first storage region 220 A with a regional vapor control unit 705 configured to retain the first storage region in a temperature range between 2 degrees and 8 degrees Centigrade. Also by way of example, the container 100 can also include a second storage region 220 B with a regional vapor control unit 785 configured to retain the second storage region 220 B in a temperature range between −5 degrees and +5 degrees Centigrade. Some embodiments include: a primary vapor control unit 140 including a thermocouple unit configured to respond to the temperature of vapor in the primary vapor conduit 285, a valve configured to regulate vapor flow through the primary vapor conduit 180, and a primary controller operably connected to the thermocouple unit and to the valve; a first regional vapor control unit 705 including a thermocouple unit configured to respond to the temperature of vapor in the first regional vapor conduit 700, a valve configured to regulate vapor flow through the first regional vapor conduit 700, and a connection to the primary controller; and a second regional vapor control unit 785 including a thermocouple unit configured to respond to the temperature of vapor in the second regional vapor conduit 780, a valve configured to regulate vapor flow through the second regional vapor conduit 780, and a connection to the primary controller.

Figure 8:
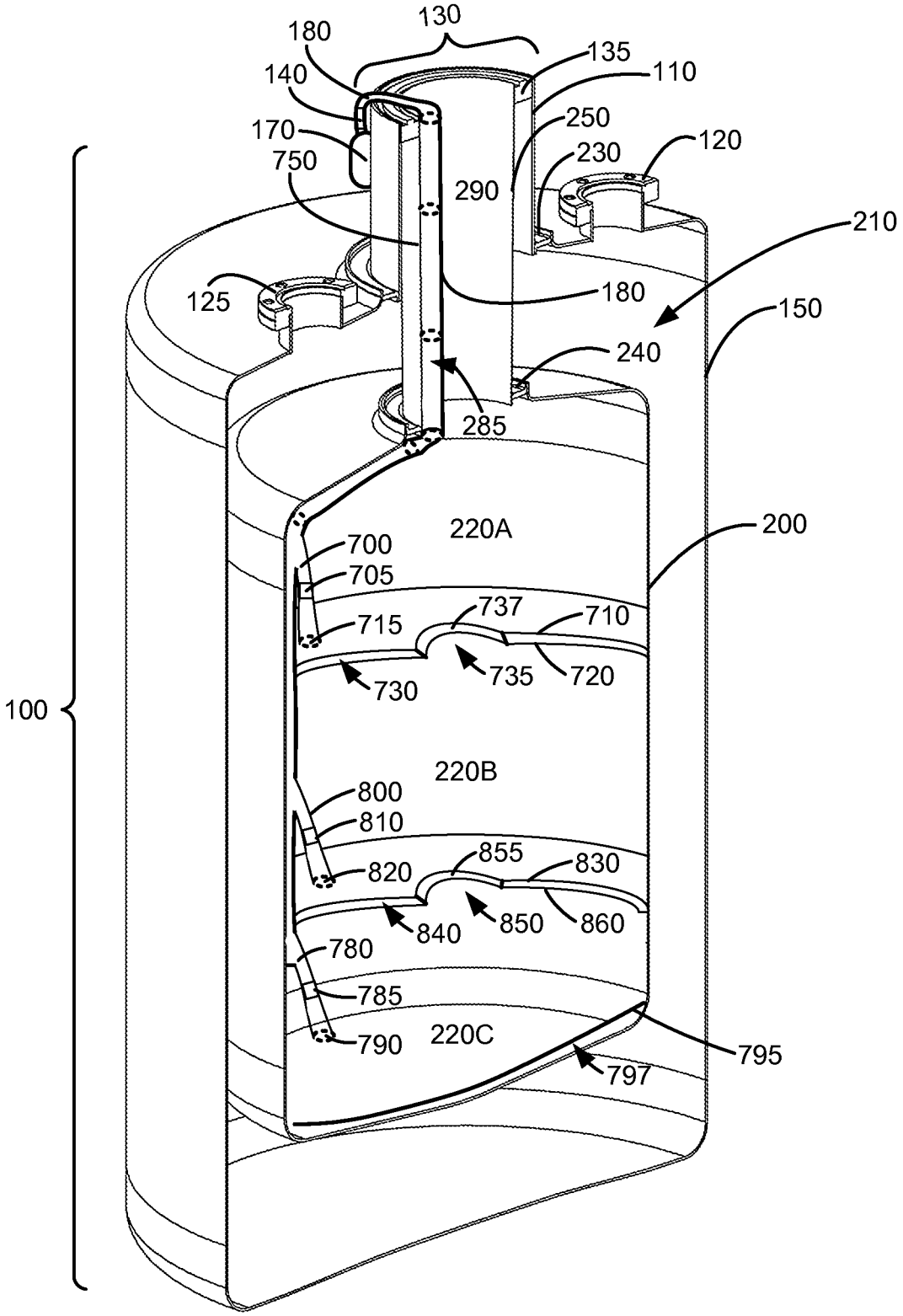
FIG. 8 shows a schematic of a substantially thermally sealed storage container illustrated in cross-section.

FIG. 8 illustrates aspects of an embodiment of a substantially thermally sealed storage container 100. The container 100 includes an outer wall 150 substantially defining the substantially thermally sealed storage container 100, the outer wall 150 substantially defining a single outer wall aperture. The container 100 includes an interior wall 200 substantially defining a thermally-controlled storage region 220, the interior wall 200 substantially defining a single interior wall aperture. The interior wall 200 and the outer wall 150 of the container 100 are separated by a distance and substantially define a gas-sealed gap 210. The container 100 includes at least one section of ultra efficient insulation material disposed within the gas-sealed gap 210. The container 100 includes a connector 250 forming an access conduit 130 connecting the single outer wall aperture with the single interior wall aperture. A seal 230 creates a gas-impermeable junction between the exterior 110 of the conduit 130 and the outer wall 150. A seal 240 creates a gas-impermeable junction between the interior region 290 of the access conduit 130 and the interior wall 200. The container 100 includes a single access aperture to the thermally-controlled storage region 220, wherein the single access aperture is defined by an end of the access conduit 130. The container includes a primary vapor conduit 180 positioned substantially within the access conduit 130, the primary vapor conduit 180 including a first end and a second end, the first end traversing the at least one aperture in the interior wall 200, the second end sealed to the at least one aperture of the desiccant unit 170.

The container 100 includes first inner wall 710 and a second inner wall 720 each attached to the interior wall 200, the inner walls 710, 720 positioned to form a first liquid-impermeable gap 730 between the first 710 and second 720 inner walls, the first 710 and second 720 inner walls forming a floor to a first storage region 220 A in the thermally-controlled storage area 220. The first 710 and second 720 inner walls are positioned substantially parallel to each other, and substantially horizontally when the container 100 is positioned for its normal use, as shown in FIG. 8. The container 100 includes an aperture 715 in the first inner wall 710. A first regional vapor conduit 700 is attached to the primary vapor conduit 180, the first regional vapor conduit 700 including a first end and a second end, the first end sealed to the primary vapor conduit 180, the second end sealed to the aperture 715 in the first inner wall 710. A first regional vapor control unit 705 is attached to the first regional vapor conduit 700. A concavity 735 in the first 710 and second 720 inner walls creates an inner aperture to permit access to the second storage region 220 B from the first storage region 220 A. A liquid-impermeable seal 737 is at the edge of the first 710 and second 720 inner walls around the concavity 735.

The embodiment illustrated in FIG. 8 also includes a third inner wall 830 and a fourth inner wall 860, each attached to the interior wall 200, the inner walls 830, 860 positioned to form a second liquid-impermeable gap 840 between the third 830 and fourth 860 inner walls, the third 830 and fourth 860 inner walls forming a floor to a second storage region 220 B in the thermally-controlled storage area 220. The third 830 and fourth 860 inner walls are positioned substantially parallel to each other, and substantially horizontally when the container 100 is positioned for its normal use. The container 100 includes an aperture 850 in the third inner wall 830. A second regional vapor conduit 800 is attached to the primary vapor conduit 180, the second regional vapor conduit 800 including a first end and a second end, the first end sealed to the primary vapor conduit 180, the second end sealed to an aperture 820 in the third inner wall 820. A second regional vapor control unit 810 is attached to the second regional vapor conduit 800. A concavity 850 in the third 830 and fourth 860 inner walls creates an inner aperture to permit access from the second storage region 220 B to the third storage region 220 C. A liquid-impermeable seal 855 is at the edge of the third 830 and fourth 860 inner walls around the concavity 850. The container 100 also includes fifth inner wall 795 attached to the interior wall 200, the fifth inner wall 795 positioned to form a third liquid-impermeable gap 797 between the fifth inner wall 795 and the interior wall 200, the fifth inner wall 795 forming a floor to a third storage region 220 C in the thermally-controlled storage area 220. There is an aperture 790 in the fifth inner wall 795. The container 100 includes a third regional vapor conduit 780 attached to the end of the primary vapor conduit 180. The third regional vapor conduit 780 includes a first end and a second end, the first end sealed to the primary vapor conduit 180, the second end sealed to the aperture 790 in the fifth inner wall 795. The container 100 includes a third regional vapor control unit 785 attached to the third regional vapor conduit 780.

In an embodiment such as the one illustrated in FIG. 8, each of the regional vapor control units 705, 810, 785 are configured to independently regulate the gas transfer from, and therefore the evaporation of, liquid in each of the first liquid-impermeable gap 730 and the second liquid-impermeable gap 840 and the third liquid-impermeable gap 797, respectively. In some embodiments, each of the liquid-impermeable gaps 730, 840, 797 include the same evaporative liquid. For example, each of the liquid-impermeable gaps 730, 840, 797 can include an evaporative liquid that is water. In some embodiments, each of the first liquid-impermeable gap 730 and the second liquid-impermeable gap 840 and the third liquid-impermeable gap 797 include different evaporative liquids, each of which are absorbed by the desiccant material within the desiccant unit 170. For example, the first liquid-impermeable gap 730 can include an evaporative liquid that is water, the second liquid-impermeable gap 840 can include an evaporative liquid that is ethanol, and the third liquid-impermeable gap can include an evaporative liquid that is ammonia, while the desiccant material in the desiccant unit 170 includes lithium chloride. Each of the regional vapor control units 705, 810, 785 includes a regional controller, a valve operably attached to the controller, the valve configured to reversibly create a gas-impermeable seal across the attached regional vapor conduit 700, 800, 780, and a temperature sensor operably attached to the controller.

Each of the regional vapor control units 705, 810, 785 can be preset to operate the attached valve in a preset temperature range, so that the first storage region 220 A, the second storage region 220 B and the third storage region 220 C can be retained at different temperatures during use. For example, a container 100 can include a first storage region 220 A with a regional vapor control unit 705 configured to retain the first storage region in a temperature range between 2 degrees and 8 degrees Centigrade. Also by way of example, the container 100 can also include a second storage region 220 B with a regional vapor control unit 810 configured to retain the second storage region 220 B in a temperature range between −5 degrees and +5 degrees Centigrade. As a further example, the container 100 can include a third storage region 220 C with a regional vapor control unit 785 configured to retain the third storage region 220 C in a temperature range between −15 degrees and −25 degrees Centigrade. Some embodiments include: a primary vapor control unit 140 including a thermocouple unit configured to respond to the temperature of vapor in the primary vapor conduit 285, a valve configured to regulate vapor flow through the primary vapor conduit 180, and a primary controller operably connected to the thermocouple unit and to the valve; as well as each of a first, second and third regional vapor control unit 705, 810, 785 including a thermocouple unit configured to respond to the temperature of vapor in the attached regional vapor conduit 700, 800, 780, a valve configured to regulate vapor flow through the attached regional vapor conduit 700, 800, 780, and a connection to the primary controller.

Some embodiments include a substantially thermally sealed storage container including a plurality of storage regions within the container. See, e.g. FIGS. 7 and 8. In some embodiments, the outer assembly including one or more sections of ultra efficient insulation material substantially defines a plurality of thermally sealed storage regions. The plurality of storage regions can be, for example, of comparable size and shape or they can be of differing sizes and shapes as appropriate to the embodiment. Different storage regions can include, for example, various removable inserts, at least one layer including at least one metal on the interior surface of a storage region, or at least one layer of nontoxic material on the interior surface, in any combination or grouping.

Figure 9:
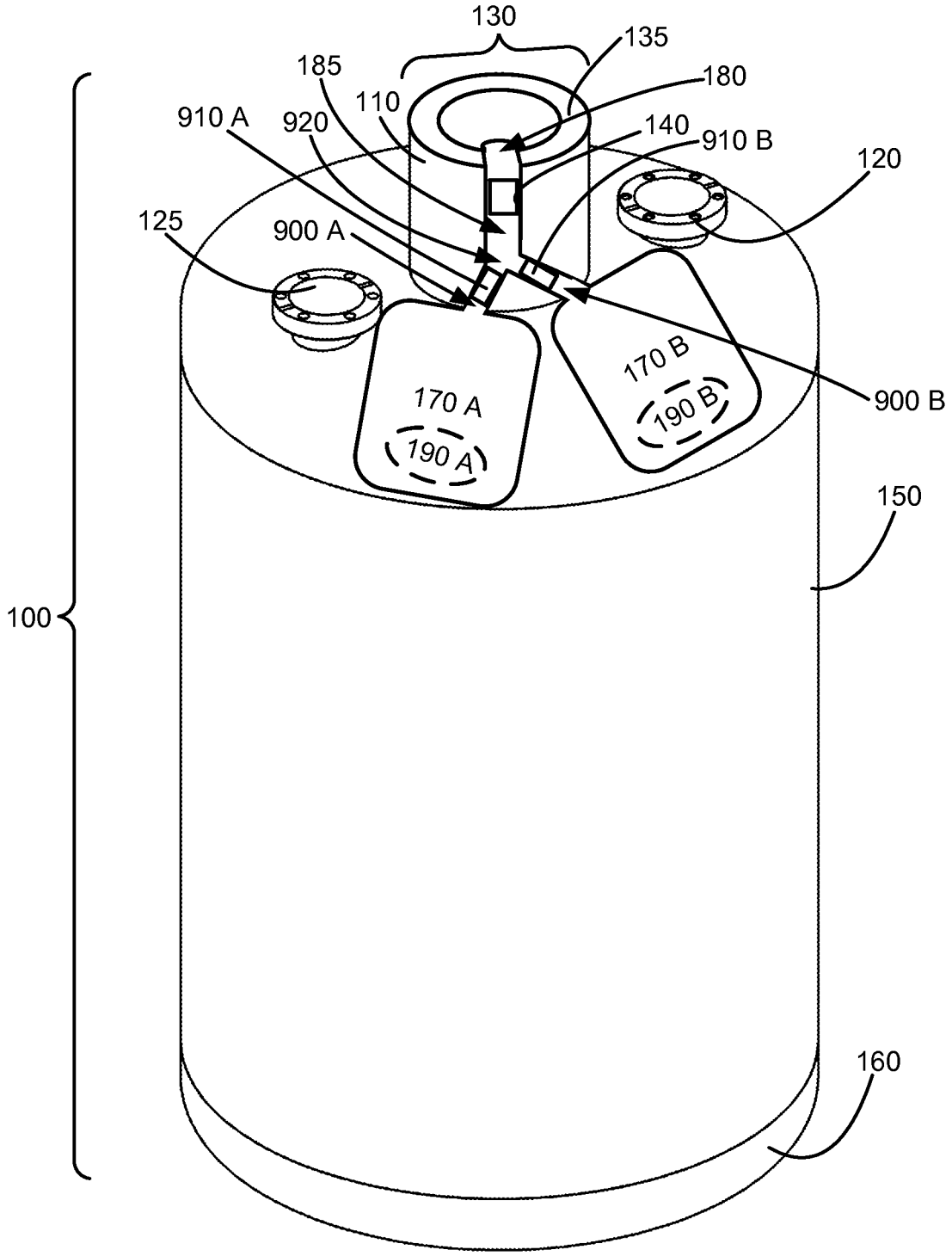
FIG. 9 is a schematic of a substantially thermally sealed storage container from an external view.

FIG. 9 illustrates aspects of a substantially thermally sealed storage container 100. The substantially thermally sealed storage container 100 is illustrated from an external view. The substantially thermally sealed storage container 100 includes an outer wall 150 substantially defining the substantially thermally sealed storage container 100, the outer wall 150 substantially defining a single outer wall aperture. A base region 160 is attached to the lower portion of the outer wall 150. Two external access ports 125, 120 are attached to the outer wall 150 and sealed prior to use of the container 100. The container 100 also includes an interior wall substantially defining a thermally-controlled storage region, the interior wall substantially defining a single interior wall aperture, wherein the interior wall and the outer wall are separated by a distance and substantially define a gas-sealed gap. The container 100 includes at least one section of ultra efficient insulation material disposed within the gas-sealed gap. The container 100 includes a connector forming the interior of an access conduit connecting the single outer wall aperture with the single interior wall aperture, and a single access aperture to the thermally-controlled storage region, wherein the single access aperture is defined by an end of the access conduit 130. The access conduit includes an outer wall 110 and an inner wall, the walls of the conduit 130 connected at the outer edge with a seal 135. The container 100 includes at least one inner wall, the inner wall sealed to the interior wall along at least one junction, the inner wall and the interior wall separated by a distance and substantially defining a liquid-impermeable gap, and an aperture in the at least one inner wall.

The container 100 includes a primary vapor conduit 180 positioned substantially within the access conduit, the primary vapor conduit 180 including a first end and a second end, the primary vapor conduit 180 sealed to a vapor control unit 140, the first end sealed to the aperture in the at least one inner wall. A second vapor conduit 185 is attached to the vapor control unit 140 at a position distal to the primary vapor conduit 180. In some embodiments, the vapor control unit 140 is integral to a vapor conduit. In some embodiments, the vapor control unit 140 is integral to a junction between the primary vapor conduit 180 and the second vapor conduit 185. The container 100 includes a vapor conduit junction 920 attached to the second vapor conduit 185 at a position distal to the vapor control unit 140. The vapor conduit junction includes a three-way junction in the conduit, the junction of a size and shape to not inhibit gas flow between the vapor control unit 140 and each of the desiccant storage units 170 A, 170 B.

The container 100 includes two desiccant units 170 A, 170 B external to the outer wall 150, each of the desiccant storage units 170 A, 170 B including at least one aperture. The container 100 includes two secondary vapor conduits 900 A, 900 B including a first end and a second end, the first end attached to the vapor conduit junction 920, the second end attached to an aperture in the adjacent desiccant unit 170 A, 170 B, and each of the two secondary vapor conduits 900 A, 900 B including an externally-operable valve 910 A, 910 B. One or more of the externally-operable valves 910 A, 910 B can be configured to substantially eliminate gas flow through the attached secondary vapor conduit 900 A, 900 B when closed. One or more of the externally-operable valves 910 A, 910 B can be configured to allow free gas flow through the attached secondary vapor conduit 900 A, 900 B when open. For example, one or more of the externally-operable valves 910 A, 910 B can include a butterfly valve positioned within the secondary vapor conduit 900 A, 900 B, the butterfly valve attached to an external wheel to open and close the valve within the attached secondary vapor conduit 900 A, 900 B. In some embodiments, the second end of each of the secondary vapor conduits 900 A, 900 B is reversibly attachable to the associated desiccant unit 170 A, 170 B with a gas-impermeable, removable fitting. For example, the desiccant units 170 A 170 B can be configured to be removable, replaceable and rechargeable.

In the embodiment illustrated in FIG. 9, each of the desiccant units 170 A, 170 B includes a power source 190 A, 190 B. The power source 190 A, 190 B can, for example, be operably connected to a heating element within the desiccant unit 170 A, 170B. See, e.g. FIGS. 5 and 6. Some embodiments include a gas vent mechanism configured to allow gas with a pressure above a preset limit to vent externally from the desiccant unit 170 A, 170 B. For example, a desiccant unit 170 A, 170 B can include a one-way, pressure-sensitive reversible valve. For example, a desiccant unit 170 A, 170 B can include a one-way, pressure-sensitive region that breaks open when subjected to excessive pressure.

Some embodiments of a container can include one or more interlocks. As used herein, an "interlock" includes at least one connection between storage regions, wherein the interlock acts so that the motion or operation of one part is constrained by another. An interlock can be in an open position, allowing the movement of stored material from one region to another, or an interlock can be in a closed position to restrict the movement or transfer of material. In some embodiments, an interlock can have intermediate stages or intermediate open positions to regulate or control the movement of material. For example, an interlock can have at least one position that restricts egress of a discrete quantity of a material from at least one storage region. For example, an interlock can act to restrict the egress of a stored unit of a material from a storage region until another previously-stored unit of a material egresses from the container. For example, an interlock can act to allow the egress of only a fixed quantity of stored material or stored units of material from a storage region during a period of time. At least one of the one or more interlocks can operate independently of an electrical power source, or at least one of the one or more interlocks can be electrically operable interlocks. An electrical power source can originate, for example, from municipal electrical power supplies, electric batteries, or an electrical generator device. Interlocks can be mechanically operable interlocks. For example, mechanically operable interlocks can include at least one of: electrically actuated mechanically operable interlocks, electromagnetically operable interlocks, magnetically operable interlocks, mechanically actuated interlocks, ballistically actuated interlocks, dynamically actuated interlocks, centrifugally actuated interlocks, optically actuated interlocks, orientationally actuated interlocks, thermally actuated interlocks, or gravitationally actuated interlocks. In some embodiments, at least one of the one or more interlocks includes at least one magnet.

An interlock can operate to allow the transfer or movement of material from one region to another in a unidirectional or a bidirectional manner. For example, an interlock can operate to allow the transfer of material from a storage region within a container to an intermediate region or a region external to the container in a unidirectional manner, while restricting the transfer or movement of material from a region external to the container into the container. For example, an interlock can operate to allow the transfer of material into at least one storage region within a container, such as for refilling or recharging a supply of material stored within the container. For example, an interlock can operate to restrict the egress of stored material from a storage region while allowing for the ingress of a heat sink material such as dry ice, wet ice, liquid nitrogen, or other heat sink material. For example, an interlock can operate to restrict the egress of stored material from a storage region while allowing the ingress of gas or vapor, such as to equalize the gaseous pressure within at least one region within the container with a gaseous pressure external to the container.

In some embodiments the substantially thermally sealed storage container can include one or more heat sink units thermally connected to one or more of the at least one storage region. In some embodiments, the substantially thermally sealed storage container can include no heat sink units. In some embodiments, the substantially thermally sealed storage container can include no heat sink units within the interior of the container. The term "heat sink unit," as used herein, includes one or more units that absorb thermal energy. See, for example, U.S. Pat. No. 5,390,734 to Voorhes et al., titled "Heat Sink," U.S. Pat. No. 4,057,101 to Ruka et al., titled "Heat Sink," U.S. Pat. No. 4,003,426 to Best et al., titled "Heat or Thermal Energy Storage Structure," and U.S. Pat. No. 4,976,308 to Faghri titled "Thermal Energy Storage Heat Exchanger," which are each incorporated herein by reference. Heat sink units can include, for example: units containing frozen water or other types of ice; units including frozen material that is generally gaseous at ambient temperature and pressure, such as frozen carbon dioxide ($CO_2$); units including liquid material that is generally gaseous at ambient temperature and pressure, such as liquid nitrogen; units including artificial gels or composites with heat sink properties; units including phase change materials; and units including refrigerants. See, for example: U.S. Pat. No. 5,261,241 to Kitahara et al., titled "Refrigerant," U.S. Pat. No. 4,810,403 to Bivens et al., titled "Halocarbon Blends for Refrigerant Use," U.S. Pat. No. 4,428,854 to Enjo et al., titled "Absorption Refrigerant Compositions for Use in Absorption Refrigeration Systems," and U.S. Pat. No. 4,482,465 to Gray, titled "Hydrocarbon-Halocarbon Refrigerant Blends," which are each herein incorporated by reference.

In some embodiments, a substantially thermally sealed container includes at least one layer of nontoxic material on an interior surface of one or more of the at least one thermally sealed storage region. Nontoxic material can include, for example, material that does not produce residue that can be toxic to the contents of the at least one substantially thermally sealed storage region, or material that does not produce residue that can be toxic to the future users of contents of the at least one substantially thermally sealed storage region. Nontoxic material can include material that maintains the chemical structure of the contents of the at least one substantially thermally sealed storage region, for example nontoxic material can include chemically inert or non-reactive materials. Nontoxic material can include material that has been developed for use in, for example, medical, pharmaceutical or food storage applications. Nontoxic material can include material that can be cleaned or sterilized, for example material that can be irradiated, autoclaved, or disinfected. Nontoxic material can include material that contains one or more antibacterial, antiviral, antimicrobial, or antipathogen agents. For example, nontoxic material can include aldehydes, hypochlorites, oxidizing agents, phenolics, quaternary ammonium compounds, or silver. Nontoxic material can include material that is structurally stable in the presence of one or more cleaning or sterilizing compounds or radiation, such as plastic that retains its structural integrity after irradiation, or metal that does not oxidize in the presence of one or more cleaning or sterilizing compounds. Nontoxic material can include material that consists of multiple layers, with layers removable for cleaning or sterilization, such as for reuse of the at least one substantially thermally sealed storage region. Nontoxic material can include, for example, material including metals, fabrics, papers or plastics.

In some embodiments, a substantially thermally sealed container includes at least one layer including at least one metal on an interior surface of one or more of the at least one thermally sealed storage region. For example, the at least one metal can include gold, aluminum, copper, or silver. The at least one metal can include at least one metal composite or alloy, for example steel, stainless steel, metal matrix composites, gold alloy, aluminum alloy, copper alloy, or silver alloy. In some embodiments, the at least one metal includes metal foil, such as titanium foil, aluminum foil, silver foil, or gold foil. A metal foil can be a component of a composite, such as, for example, in association with polyester film, such as polyethylene terephthalate (PET) polyester film. The at least one layer including at least one metal on the interior surface of at least one storage region can include at least one metal that can be sterilizable or disinfected. For example, the at least one metal can be sterilizable or disinfected using plasmons. For example, the at least one metal can be sterilizable or disinfected using autoclaving, thermal means, or chemical means. Depending on the embodiment, the at least one layer including at least one metal on the interior surface of at least one storage region can include at least one metal that has specific heat transfer properties, such as a thermal radiative properties.

In some embodiments, a substantially thermally sealed storage container includes one or more removable inserts within an interior of one or more of the at least one thermally sealed storage region. The removable inserts can be made of any material appropriate for the embodiment, including nontoxic materials, metal, alloy, composite, or plastic. The one or more removable inserts can include inserts that can be reused or reconditioned. The one or more removable inserts can include inserts that can be cleaned, sterilized, or disinfected as appropriate to the embodiment.

Some embodiments can include a substantially thermally sealed storage container including one or more temperature sensors. For example, at least one temperature sensor can be located within one or more of the at least one substantially thermally sealed storage region, at least one temperature sensor can be located exterior to the container, or at least one temperature sensor can be located within the structure of the container. In some embodiments, multiple temperature sensors can be located in multiple positions. Temperature sensors can include temperature indicating labels, which can be reversible or irreversible. See, for example, the Environmental Indicators sold by ShockWatch Company, with headquarters in Dallas Tex., the Temperature Indicators sold by Cole-Palmer Company of Vernon Hills Ill. and the Time Temperature Indicators sold by 3M Company, with corporate headquarters in St. Paul Minn., the brochures for which are each hereby incorporated by reference. Temperature sensors can include time-temperature indicators, such as those described in U.S. Pat. Nos. 5,709,472 and 6,042,264 to Prusik et al., titled "Time-temperature indicator device and method of manufacture" and U.S. Pat. No. 4,057,029 to Seiter, titled "Time-temperature indicator," which are each herein incorporated by reference. Temperature sensors can include, for example, chemically-based indicators, temperature gauges, thermometers, bimetallic strips, or thermocouples.

In some embodiments, a substantially thermally sealed container can include one or more sensors. In some embodiments, multiple sensors can be located in multiple positions. In some embodiments, the one or more sensors includes at least one sensor of a gaseous pressure within one or more of the at least one storage region, sensor of a mass within one or more of the at least one storage region, sensor of a stored volume within one or more of the at least one storage region, sensor of a temperature within one or more of the at least one storage region, or sensor of an identity of an item within one or more of the at least one storage region. In some embodiments, at least one sensor can include a temperature sensor, such as, for example, chemical sensors, thermometers, bimetallic strips, or thermocouples. An integrally thermally sealed container can include one or more sensors such as a physical sensor component such as described in U.S. Pat. No. 6,453,749 to Petrovic et al., titled "Physical sensor component," which is herein incorporated by reference. An integrally thermally sealed container can include one or more sensors such as a pressure sensor such as described in U.S. Pat. No. 5,900,554 to Baba et al., titled "Pressure sensor," which is herein incorporated by reference. An integrally thermally sealed container can include one or more sensors such as a vertically integrated sensor structure such as described in U.S. Pat. No. 5,600,071 to Sooriakumar et al., titled "Vertically integrated sensor structure and method," which is herein incorporated by reference. An integrally thermally sealed container can include one or more sensors such as a system for determining a quantity of liquid or fluid within a container, such as described in U.S. Pat. No. 5,138,559 to Kuehl et al., titled "System and method for measuring liquid mass quantity," U.S. Pat. No. 6,050,598 to Upton, titled "Apparatus for and method of monitoring the mass quantity and density of a fluid in a closed container, and a vehicular air bag system incorporating such apparatus," and U.S. Pat. No. 5,245,869 to Clarke et al., titled "High accuracy mass sensor for monitoring fluid quantity in storage tanks," which are each herein incorporated by reference. An integrally thermally sealed container can include one or more sensors of radio frequency identification ("RFID") tags to identify material within the at least one substantially thermally sealed storage region. RFID tags are well known in the art, for example in U.S. Pat. No. 5,444,223 to Blama, titled "Radio frequency identification tag and method," which is herein incorporated by reference.

In some embodiments, a substantially thermally sealed container can include one or more communications devices. The one or more communications devices, can include, for example, one or more recording devices, one or more transmission devices, one or more display devices, or one or more receivers. Communications devices can include, for example, communication devices that allow a user to detect information about the container visually, auditorily, or via signal to a remote device. Some embodiments can include communications devices on the exterior of the container, including devices attached to the exterior of the container, devices adjacent to the exterior of the container, or devices located at a distance from the exterior of the container. Some embodiments can include communications devices located within the structure of the container. Some embodiments can include communications devices located within at least one of the one or more substantially thermally sealed storage regions. Some embodiments can include at least one display device located at a distance from the container, for example a display located at a distance operably linked to at least one sensor. Some embodiments can include more than one type of communications device, and in some embodiments the devices can be operably linked. For example, some embodiments can contain both a receiver and an operably linked transmission device, so that a signal can be received by the receiver which then causes a transmission to be made from the transmission device. Some embodiments can include more than one type of communications device that are not operably linked. For example, some embodiments can include a transmission device and a display device, wherein the transmission device is not linked to the display device.

In some embodiments, a substantially thermally sealed storage container includes at least one authentication device, wherein the at least one authentication device can be operably connected to at least one of the one or more interlocks. In some embodiments, a substantially thermally sealed storage container includes at least one authentication device, wherein the at least one authentication device can be operably connected to at least one externally-operable opening, control egress device, communications device, or other component. For example, an authentication device can include a device which can be authenticated with a key, or a device that can be authenticated with a code, such as a password or a combination. For example, an authentication device can include a device that can be authenticated using biometric parameters, such as fingerprints, retinal scans, hand spacing, voice recognition or biofluid composition (e.g. blood, sweat, or saliva).

In some embodiments, a substantially thermally sealed storage container includes at least one logging device, wherein the at least one logging device is operably connected to at least one of the one or more interlocks. In some embodiments, a substantially thermally sealed storage container includes at least one logging device, wherein the at least one logging device can be operably connected to at least one externally-operable opening, control egress device, communications device, or other component. The at least one logging device can be configured to log information desired by the user. In some embodiments, a substantially thermally sealed container can include at least one logging device, wherein the at least one logging device is operably connected to at least one of the one or more outlet channels. For example, a logging device can include a record of authentication via the authentication device, such as a record of times of authentication, operation of authentication or individuals making the authentication. For example, a logging device can record that an authentication device was authenticated with a specific code which identifies a specific individual at one or more specific times. For example, a logging device can record egress of a quantity of a material from one or more of at least one storage region, such as recording that some quantity or units of material egressed at a specific time. For example, a logging device can record information from one or more sensors, one or more temperature indicators, or one or more communications devices.

In some embodiments, a substantially thermally sealed storage container can include at least one control ingress device, wherein the at least one control ingress device is operably connected to at least one of the one or more interlocks. In some embodiments, a substantially thermally sealed storage container includes at least one control ingress device, wherein the at least one control ingress device can be operably connected to at least one externally-operable opening, control egress device, communications device, or other component. For example, at least one control ingress device can control ingress into the inner assembly of the container, such as ingress of: substance or material to be stored, heat sink material, one or more devices, electromagnetic radiation, gas, or vapor.

In some embodiments an integrally thermally sealed container can include one or more recording devices. The one or more recording devices can include devices that are magnetic, electronic, chemical, or transcription based recording devices. One or more recording device can be located within one or more of the at least one substantially thermally sealed storage region, one or more recording device can be located exterior to the container, or one or more recording device can be located within the structure of the container. The one or more recording device can record, for example, the temperature from one or more temperature sensor, the result from one or more temperature indicator, or the gaseous pressure, mass, volume or identity of an item information from at least one sensor within the at least one storage region. In some embodiments, the one or more recording devices can be integrated with one or more sensor. For example, in some embodiments there can be one or more temperature sensors which record the highest, lowest or average temperature detected. For example, in some embodiments, there can be one or more mass sensors which record one or more mass changes within the container over time. For example, in some embodiments, there can be one or more gaseous pressure sensors which record one or more gaseous pressure changes within the container over time.

In some embodiments an integrally thermally sealed container can include one or more transmission device. One or more transmission device can be located within at least one substantially thermally sealed storage region, one or more transmission device can be located exterior to the container, or one or more transmission device can be located within the structure of the container. The one or more transmission device can transmit any signal or information, for example, the temperature from one or more temperature sensor, or the gaseous pressure, mass, volume or identity of an item or information from at least one sensor within the at least one storage region. In some embodiments, the one or more transmission device can be integrated with one or more sensor, or one or more recording device. The one or more transmission devices can transmit by any means known in the art, for example, but not limited to, via radio frequency (e.g. RFID tags), magnetic field, electromagnetic radiation, electromagnetic waves, sonic waves, or radioactivity.

In some embodiments, an integrally thermally sealed container can include one or more receivers. For example, one or more receivers can include devices that detect sonic waves, electromagnetic waves, radio signals, electrical signals, magnetic pulses, or radioactivity. Depending on the embodiment, one or more receiver can be located within one or more of the at least one substantially thermally sealed storage region. In some embodiments, one or more receivers can be located within the structure of the container. In some embodiments, the one or more receivers can be located on the exterior of the container. In some embodiments, the one or more receiver can be operably coupled to another device, such as, for example, one or more display devices, recording devices or transmission devices. For example, a receiver can be operably coupled to a display device on the exterior of the container so that when an appropriate signal is received, the display device indicates data, such as time or temperature data. For example, a receiver can be operably coupled to a transmission device so that when an appropriate signal is received, the transmission device transmits data, such as location, time, or positional data.

Figure 10:
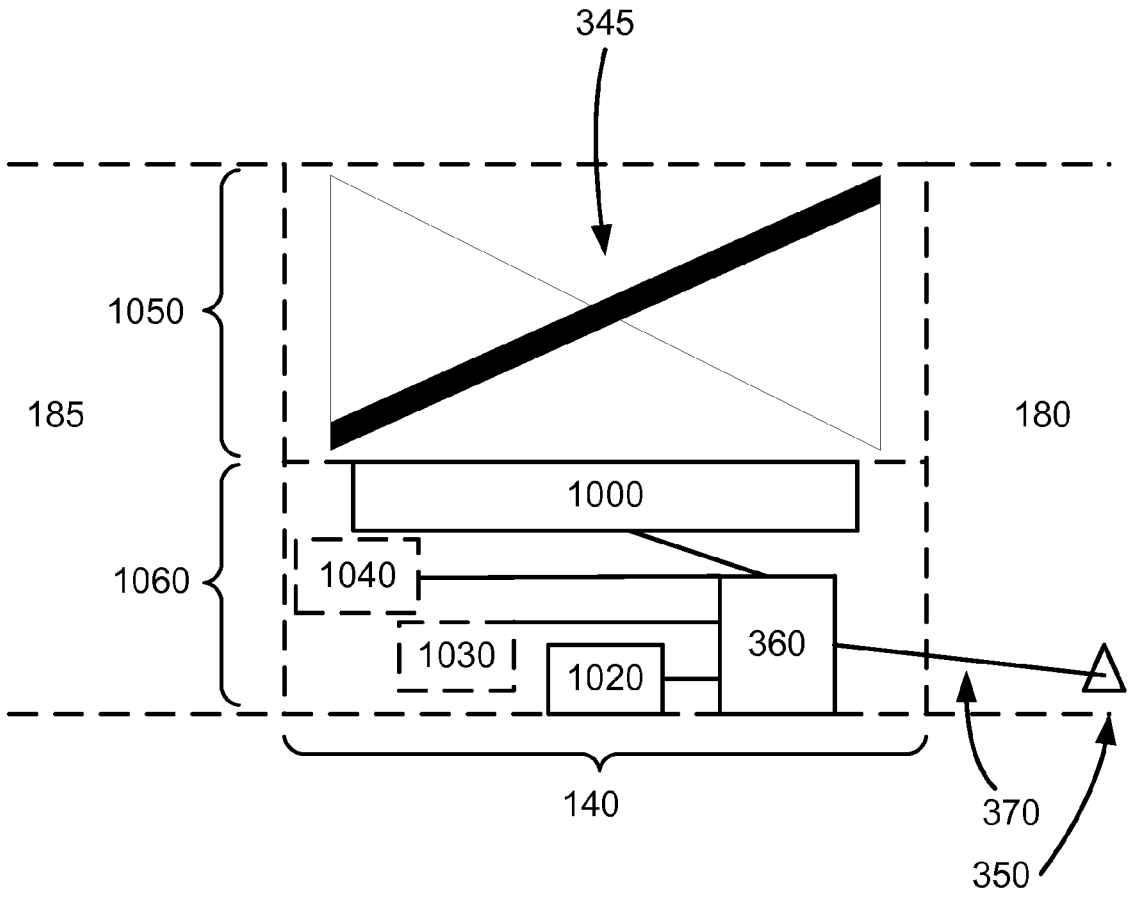
FIG. 10 illustrates aspects of a vapor control unit positioned between a first and second vapor conduit.

FIG. 10 illustrates aspects of an embodiment of a vapor control unit 140. The vapor control unit 140 shown in FIG. 10 is positioned at the junction between a first vapor conduit 180 and a second vapor conduit 185. FIG. 10 illustrates a vapor control unit 140 within the interior dimensions of the junction between a first vapor conduit 180 and a second vapor conduit 185. The vapor control unit 140 is sealed to each of the first vapor conduit 180 and a second vapor conduit 185 with a gas-impermeable seal. The vapor control unit 140 includes a valve region 1050 and a control region 1060.

The valve region 1050 of the vapor control unit 140 illustrated in FIG. 10 includes a valve 345. In the embodiment illustrated, the valve 345 is a butterfly valve, directly physically connected to the control region 1060 of the vapor control unit 140. The valve 345 is positioned and sized to include at least two positions, a substantially open position and a substantially closed position within the valve region 1050. When the valve 345 is in a substantially open position, the dimensions of the valve 345 within the valve region 1050 of the vapor control unit 140 permit free flow of gas, including vapor, between the first vapor conduit 180 and the second vapor conduit 185 to equalize gas pressure between the first vapor conduit 180 and the second vapor conduit 185. The valve 345 is of a size and shape to substantially block the flow of gas between the first vapor conduit 180 and the second vapor conduit 185 when the valve 345 is in a substantially closed position. In some embodiments, a valve 345 includes one or more intermediate positions that partially impede gas flow through the valve 345 between the first vapor conduit 180 and the second vapor conduit 185, but do not fully block gas flow. For example, a valve 345 can have a "half-flow" position, or a position that reduces the flow of gas through the valve 345, and therefore between the first vapor conduit 180 and the second vapor conduit 185, by approximately half, relative to the fully open position. For example, a valve 345 can have a "quarter-flow" position, or a position that reduces the flow of gas through the valve 345, and therefore between the first vapor conduit 180 and the second vapor conduit 185 to approximately one quarter of the gas flow relative to the fully open position.

The valve 345 illustrated in FIG. 10 is directly connected to a motor 1000. For example, in some embodiments the motor 1000 is a servomotor. For example, in some embodiments the motor 1000 is a stepper motor. The motor 1000 is directly connected to the valve 345 and causes the opening and closing of the valve 345 on receipt of signals from the controller 360. The motor 1000 is directly connected to the controller 360 with a wire connector. The controller 360 is an electronic controller. For example, in some embodiments, an electronic controller is a "bang-bang" controller. For example, in some embodiments, an electronic controller is a bounded system controller. For example, in some embodiments, an electronic controller is a threshold system controller. For example, in some embodiments an electronic controller is a feedback system controller. For example, in some embodiments an electronic controller is a PID controller. A sensor 350 is attached to the controller 360 with a wire connector 370 in the embodiment illustrated in FIG. 10.

The controller 360 can include circuitry configured to perform specific operations and processes. For example, the controller 360 can include circuitry configured to accept data from an attached sensor and determine if the data is within a preset range, wherein the controller sends a signal to the motor 1000 that results in either opening or closing the valve 345, relative to if the data is above or below the preset range. For example, in some embodiments a controller includes circuitry that accepts data originating with a temperature sensor, compares that data with a preset range of temperatures, and if the data from the temperature sensor indicates a detected temperature that is above the preset range, the controller sends a signal to the motor to initiate the valve to open. For example, in some embodiments a controller includes circuitry that accepts data originating with a temperature sensor, compares that data with a preset range of temperatures, and if the data from the temperature sensor indicates a detected temperature that is within the preset range, the controller does not send a signal to the motor. For example, in some embodiments a controller includes circuitry that accepts data originating with a temperature sensor, compares that data with a preset range of temperatures, and if the data from the temperature sensor indicates a detected temperature that is below the preset range, the controller sends a signal to the motor to initiate the valve to close. In some embodiments, the preset temperature range is between 2 degrees Centigrade and 8 degrees Centigrade. In some embodiments, the preset temperature range is between 3 degrees Centigrade and 7 degrees Centigrade. In some embodiments, the preset temperature range is between −2 degrees Centigrade and +2 degrees Centigrade. In some embodiments, the preset temperature range is between −3 degrees Centigrade and −7 degrees Centigrade.

In some embodiments, the controller includes circuitry that calculates an error value between data accepted from a sensor and a predetermined target value. The calculation can include data accepted over time, i.e. multiple data points from a single sensor. The calculation can include data accepted from a plurality of sensors. In response to the calculated error values, the controller can calculate a predicted future error value. The circuitry then calculates a combined error value. If the calculated combination of the calculated past, present and future error values is beyond the preset setpoint, the circuitry then initiates a signal to the motor to alter the opening of the valve. For example, a preset setpoint for some embodiments of a vapor control unit is 5 degrees Centigrade. In such an embodiment, if the combination of the calculated past, present and future error values was higher than the preset setpoint (e.g. 8 degrees Centigrade), the controller would send a signal to the motor, the signal of a type to initiate the motor to open the attached valve. Similarly, in such an embodiment, if the combination of the calculated past, present and future error values was lower than the preset setpoint (e.g. 2 degrees Centigrade), the controller would send a signal to the motor, the signal of a type to initiate the motor to close the attached valve.

As shown in FIG. 10, the control region 1060 of the vapor control unit 140 includes a power source 1020. The power source 1020 can include, for example, a battery. The battery can be rechargeable, for example from a AC or DC power source or a mechanical mechanism, such as a crank. The power source can include a solar cell connected to the external surface of the vapor control unit 140. In the embodiment illustrated in FIG. 10, the power source 1020 is connected to the controller 360 with a wire connection. In the embodiment illustrated, the power source 1020 supplies electrical power to the controller 360, which then further transfers electrical power to the motor 1000. The controller 360 can, for example, transfer power to the motor when needed to operate the motor 1000. In some embodiments, the power source 1020 supplies electrical power to the motor 1000 directly, such as through a direct wire connection.

FIG. 10 illustrates that in some embodiments the control region 1060 of the vapor control unit 140 includes optional memory 1030. The memory 1030 can, for example, be non-volatile memory. The memory 1030 can, for example, be integrated into the controller 360, or operably connected to the controller 360. The memory 1030 can, for example, be random-access (RAM) memory.

FIG. 10 illustrates that in some embodiments the control region 1060 of the vapor control unit 140 includes optional transmitter unit 1040. For example, the control region 1060 can include a transmitter unit 1040 including an antenna and circuitry configured to send a signal from the antenna. The circuitry configured to send a signal from the antenna can be responsive to the controller 360, for example the circuitry configured to send a signal from the antenna can send the signal based on data received from the controller 360 (e.g. one or more data points based on data from the sensor, information on activity of the motor 1000, or the result of calculations made by the controller 360). The transmitter unit can be, for example, a Bluetooth™ unit.

Figure 11A:
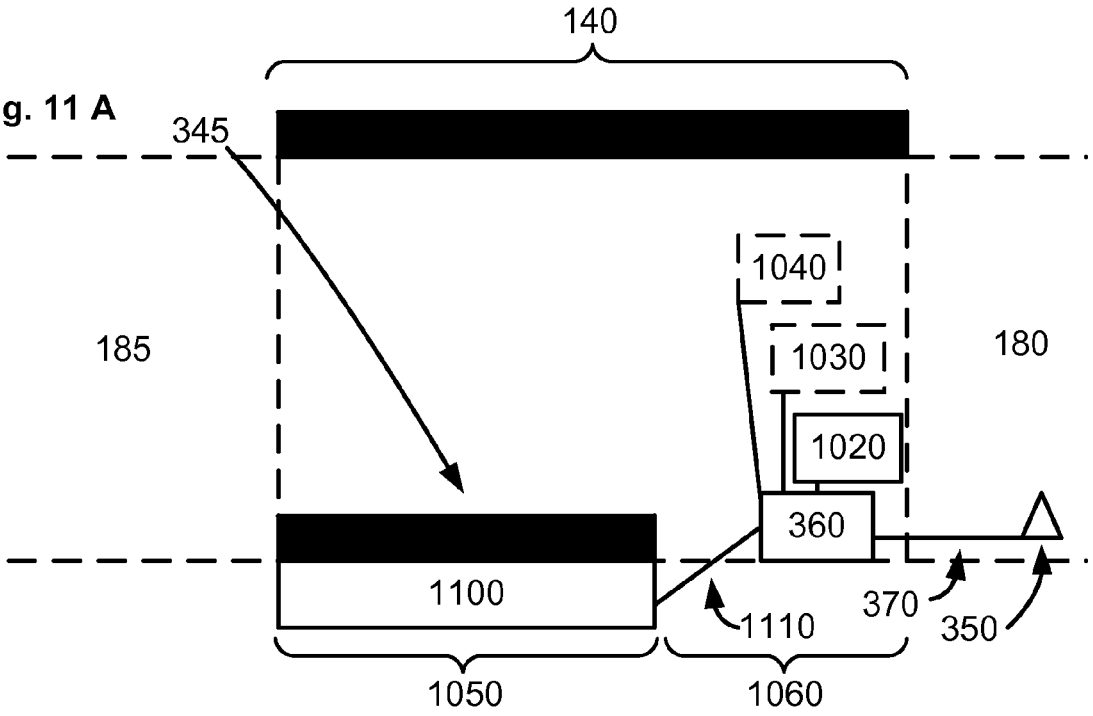
FIG. 11A illustrates aspects of a vapor control unit positioned between a first and second vapor conduit.
Figure 11B:
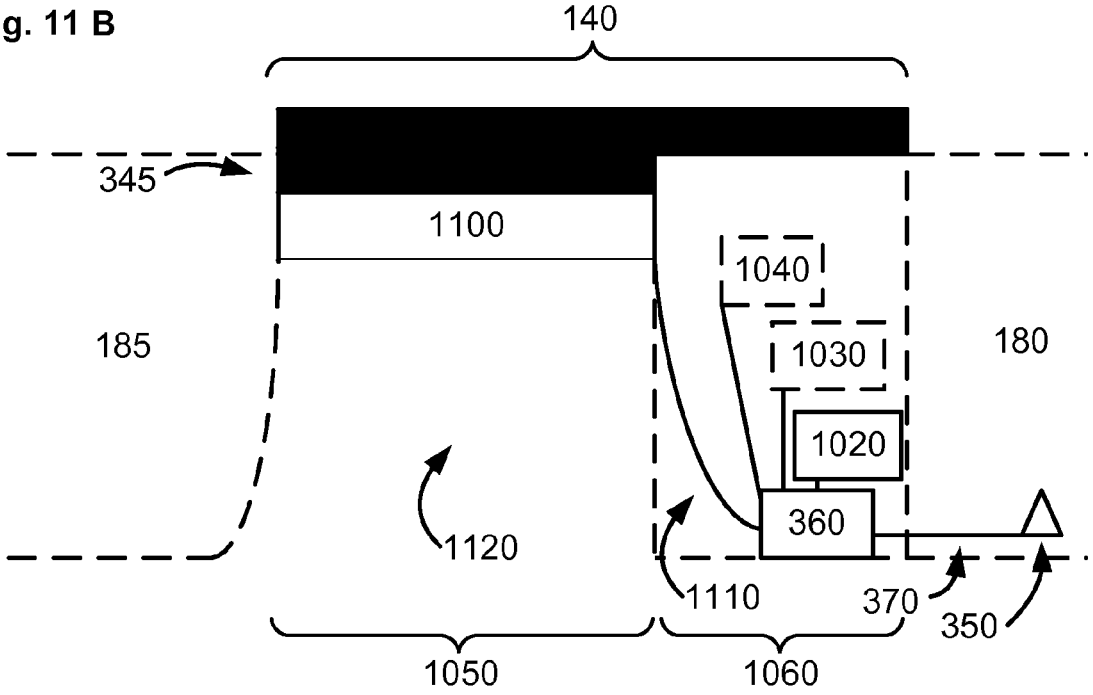
FIG. 11B illustrates aspects of a vapor control unit positioned between a first and second vapor conduit.

FIGS. 11A and 11B depict aspects of a vapor control unit 140. The vapor control unit 140 is positioned between the ends of a first vapor conduit 180 and a second vapor conduit 185. The respective ends of the vapor control unit 140 are each sealed to an end of the first vapor conduit 180 or the second vapor conduit 185 with a gas-impermeable seal. The vapor control unit 140 includes a valve region 1050 and a control region 1060.

The vapor control unit 140 illustrated in FIG. 11A includes a valve region 1050 including a valve 345 and a movable unit 1100. The movable unit 1100 is physically attached to the valve 345 and configured to provide physical force against the valve 345 in response to a stimulus. For example, in some embodiments a movable unit 1100 is a crank mechanism attached to a valve 345. For example, in some embodiments a movable unit 1100 includes a bonnet and a stem attached to a valve interior that includes a disc and a physical seat for the disc. For example, in some embodiments a valve 345 includes a physically deformable region of a conduit, and a movable unit 1100 includes at least two physical elements that are positioned to press against opposing exterior surfaces of the physically deformable region of the conduit in response to a signal from the controller. For example, in some embodiments a valve region 1050 includes a valve 345 with a physically deformable region of a conduit and a movable unit 1100 that includes a reversible clamp on the exterior of the valve, wherein the movable unit 1100 is attached to a controller. In some embodiments, the movable unit 1100 includes a motor. In some embodiments, the movable unit 1100 is entirely internal to the vapor control unit 140. In some embodiments, the movable unit 1100 includes one or more elements that are external to the vapor control unit 140.

The movable unit 1100 is operably attached to the controller 360 within the control region 1060 of the vapor control unit 140. A power source 1020 is attached to the controller 360. The power source 1020 and the controller 360 supply power to the movable unit 1100, for example a motor element of the movable unit 1100, as needed for operation of the movable unit 1100. The controller 360 accepts data from an attached sensor 350 within the first vapor conduit 180. Although the sensor 350 is illustrated in FIGS. 11A and 11B as adjacent to the junction between the vapor control unit 140 and the first vapor conduit 180, in some embodiments the sensor 350 is positioned distal to the junction between the vapor control unit 140 and the first vapor conduit 180. For example, in some embodiments a sensor 350 is positioned adjacent to the substantially thermally sealed storage region within a container. See, e.g. FIG. 5. The sensor 350 is attached to the controller 360 with a wire connector 370 in the embodiment illustrated in FIGS. 11A and 11B. In some embodiments, memory 1030 is connected to the controller 360. In some embodiments, memory 1030 is integrated with the controller 360. Some embodiments include a transmitter 1040 attached to the controller 360. In some embodiments, a transmitter 1040 is integrated with the controller 360.

In the illustration shown in FIGS. 11A and 11B, components of the control region 1060, including the controller 360, the power unit 1020, the memory 1030 and the transmitter 1040 are shown as filling space within the interior of the vapor control unit 140. The components are displayed in an enlarged and distinct manner for ease of visualization. In an actual embodiment, the components of the control region 1060 would not impede vapor flow through the vapor control unit 140. In an actual embodiment, the components illustrated would be smaller than shown. In an actual embodiment, the valve region 1050 of the vapor control unit 140 is the limiting factor for vapor flow between the first vapor conduit 180 and the second vapor conduit 185 through the vapor control unit 140.

FIG. 11A illustrates an embodiment of a vapor control unit 140 with the valve 345 in a substantially open position. In the configuration shown in FIG. 11A, the movable unit 1100 attached to the valve 345 is positioned substantially flush with the exterior surface of the vapor control unit 140. This allows for maximum vapor flow between the first vapor conduit 180 and the second vapor conduit 185 through the vapor control unit 140. For example, evaporated liquid from the evaporative unit will flow freely through the vapor control unit 140 to the desiccant unit in the configuration shown in FIG. 11A.

FIG. 11B illustrates the same embodiment as shown in FIG. 11A, with the valve 345 in a substantially closed position. In the configuration shown in FIG. 11B, the movable unit 1100 attached to the valve 345 has moved the valve to a position adjacent to the interior surface of the vapor control unit 140. An externally-visible gap 1120 is formed in the vapor control unit 140 when the valve is in the illustrated "closed" position. The position of the movable unit 1100 and the valve 345 allows for minimal vapor flow between the first vapor conduit 180 and the second vapor conduit 185 through the vapor control unit 140. For example, the partial pressure of evaporated liquid from the evaporative unit will increase within the first vapor conduit 140 in the configuration shown in FIG. 11B as the evaporated liquid will not be able to flow through the vapor control unit 140 to the desiccant unit. In some embodiments, a valve 345 of a vapor control unit 140 has one or more intermediate or partially open/partially closed configurations that partially restrict vapor flow through the vapor control unit 140 and between the first vapor conduit 180 and the second vapor conduit 185.

In some implementations described herein, logic and similar implementations can include computer programs or other control structures. Electronic circuitry, for example, can have one or more paths of electrical current constructed and arranged to implement various functions as described herein. In some implementations, one or more media can be configured to bear a device-detectable implementation when such media hold or transmit device detectable instructions operable to perform as described herein. In some variants, for example, implementations can include an update or modification of existing software or firmware, or of gate arrays or programmable hardware, such as by performing a reception of or a transmission of one or more instructions in relation to one or more operations described herein. Alternatively or additionally, in some variants, an implementation can include special-purpose hardware, software, firmware components, and/or general-purpose components executing or otherwise invoking special-purpose components.

The subject matter described herein can be implemented in an analog or digital fashion or some combination thereof. In a general sense, some aspects described herein can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.).

Alternatively or additionally, implementations can include executing a special-purpose instruction sequence or invoking circuitry for enabling, triggering, coordinating, requesting, or otherwise causing one or more occurrences of virtually any functional operation described herein. In some variants, operational or other logical descriptions herein can be expressed as source code and compiled or otherwise invoked as an executable instruction sequence. In some contexts, for example, implementations can be provided, in whole or in part, by source code, such as C++, or other code sequences. In other implementations, source or other code implementation, using commercially available and/or techniques in the art, can be compiled//implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) can be manifested as a Verilog-type hardware description (e.g., via Hardware Description Language (HDL) and/or Very High Speed Integrated Circuit Hardware Descriptor Language (VHDL)) or other circuitry model which can then be used to create a physical implementation having hardware (e.g., an Application Specific Integrated Circuit).

In a general sense, various aspects of the embodiments described herein can be implemented, individually and/or collectively, by various types of electro-mechanical systems having a wide range of electrical components such as hardware, software, firmware, and/or virtually any combination thereof, limited to patentable subject matter under 35 U.S.C. 101; and a wide range of components that can impart mechanical force or motion such as rigid bodies, spring or torsional bodies, hydraulics, electro-magnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs (e.g., graphene based circuitry). Examples of electro-mechanical systems include, but are not limited to, a variety of consumer electronics systems, medical devices, as well as other systems such as motorized transport systems, factory automation systems, security systems, and/or communication/computing systems.

At least a portion of the devices and/or processes described herein can be integrated into a data processing system. A data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system can be implemented utilizing suitable commercially available components, such as those typically found in data computing/communication and/or network computing/communication systems.

The state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer can opt for a mainly hardware and/or firmware vehicle; alternatively, if flexibility is paramount, the implementer can opt for a mainly software implementation; or, yet again alternatively, the implementer can opt for some combination of hardware, software, and/or firmware in one or more machines, compositions of matter, and articles of manufacture, limited to patentable subject matter under 35 USC 101. Hence, there are several possible vehicles by which the processes and/or devices and/or other technologies described herein can be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components. In some instances, one or more components can be referred to herein as "configured to," "configured by," "configurable to," "operable/operative to," "adapted/adaptable," "able to," "conformable/conformed to," etc. Such terms (e.g. "configured to") generally encompass active-state components and/or inactive-state components and/or standby-state components, unless context requires otherwise.

The herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

While particular aspects of the present subject matter described herein have been shown and described, changes and modifications can be made without departing from the subject matter described herein and its broader aspects and, therefore, the appended claims are to encompass within their scope all such changes and modifications as are within the true spirit and scope of the subject matter described herein. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). If a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended as "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended as "a system having at least one of A, B, or C" that would include but not be limited to systems that have A alone, B alone, C alone, A and B together, A and C together, B and C together, and/or A, B, and C together, etc. Typically, a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, recited operations therein can generally be performed in any order. Also, although various operational flows are presented in a sequence(s), it should be understood that the various operations can be performed in other orders than those which are illustrated, or can be performed concurrently. Examples of such alternate orderings can include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A substantially thermally sealed storage container, comprising:

an outer assembly, including one or more sections of ultra efficient insulation material substantially defining at least one thermally-controlled storage region and a single access conduit to the at least one thermally-controlled storage region; and an evaporative cooling assembly integral to the container, including an evaporative cooling unit affixed to a surface of the at least one thermally-controlled storage region, a desiccant unit affixed to an external surface of the container, a vapor conduit, the vapor conduit including a first end and a second end, the first end attached to the evaporative cooling unit, the second end attached to the desiccant unit, and a vapor control unit attached to the vapor conduit.

2. The substantially thermally sealed storage container of claim 1, wherein the evaporative cooling unit comprises:

a liquid impermeable region within the evaporative cooling unit, the liquid impermeable region in vapor contact with the interior of the vapor conduit.

3. The substantially thermally sealed storage container of claim 1, wherein the desiccant unit comprises:

a vapor-sealed chamber including an interior desiccant region in vapor contact with an interior region of the vapor conduit.

4. The substantially thermally sealed storage container of claim 1, wherein the desiccant unit comprises:

a gas vent mechanism configured to allow gas with pressure beyond a preset limit to vent externally from the desiccant unit.

5. The substantially thermally sealed storage container of claim 1, wherein the desiccant unit comprises:

a gas vent mechanism configured to allow gas of a temperature beyond a preset limit to vent externally from the desiccant unit.

6. The substantially thermally sealed storage container of claim 1, wherein the vapor control unit comprises:

a thermocouple unit configured to respond to the temperature of vapor in the vapor conduit;

a valve configured to regulate vapor flow through the vapor control unit; and a controller operably connected to the thermocouple unit and to the valve.

7. The substantially thermally sealed storage container of claim 1, wherein the vapor control unit comprises:

a temperature sensor;

an electronic controller operably connected to the temperature sensor; and a valve operably connected to the electronic controller.

8. The substantially thermally sealed storage container of claim 1, wherein the vapor control unit comprises:

a temperature sensor;

a mechanical controller operably connected to the temperature sensor; and a valve operably connected to the mechanical controller.

9. The substantially thermally sealed storage container of claim 1, comprising:

at least one temperature sensor positioned within the evaporative cooling assembly;

a controller operably connected to the at least one temperature sensor; and a valve operably connected to the controller.

10. A substantially thermally sealed storage container, comprising:

an outer wall substantially defining a substantially thermally sealed storage container, the outer wall substantially defining a single outer wall aperture;

an interior wall substantially defining a thermally-controlled storage region, the interior wall substantially defining a single interior wall aperture, the interior wall and the outer wall separated by a distance and substantially defining a gas-sealed gap;

at least one section of ultra-efficient insulation material disposed within the gas-sealed gap;

a connector forming an access conduit connecting the single outer wall aperture with the single interior wall aperture;

a single access aperture to the thermally-controlled storage region, wherein the single access aperture is defined by an end of the access conduit;

at least one inner wall, the at least one inner wall sealed to the interior wall along at least one junction, the at least one inner wall and the interior wall separated by a distance and substantially creating a liquid-impermeable gap;

an aperture in the at least one inner wall;

a desiccant unit external to the outer wall, the desiccant unit including an aperture;

a vapor conduit positioned substantially within the access conduit, the vapor conduit including a first end and a second end, the first end sealed to the aperture in the at least one inner wall, the second end sealed to the aperture of the desiccant unit; and a vapor control unit attached to the vapor conduit.

11. The substantially thermally sealed storage container of claim 10, wherein the gas-sealed gap comprises:

substantially evacuated space.

12. The substantially thermally sealed storage container of claim 10, wherein the connector forms an elongated thermal pathway between the single access aperture to the thermally-controlled storage region and an exterior region of the container.

13. The substantially thermally sealed storage container of claim 10, wherein the desiccant unit comprises:

a vapor-sealed chamber including an interior desiccant region in vapor contact with an interior region of the vapor conduit.

14. The substantially thermally sealed storage container of claim 10, wherein the vapor control unit comprises:

at least one movable valve with at least a first position substantially closing the at least one movable valve to vapor flow through the at least one movable valve, and a second position substantially opening the at least one movable valve to vapor flow through the at least one movable valve.

15. The substantially thermally sealed storage container of claim 10, wherein the vapor control unit comprises:

a thermocouple unit configured to respond to the temperature of vapor in the vapor conduit;

a valve configured to regulate vapor flow through the vapor control unit; and a controller operably connected to the thermocouple unit and to the valve.

16. The substantially thermally sealed storage container of claim 10, wherein the vapor control unit comprises:

an electronic controller; and a valve operably connected to the electronic controller.

17. The substantially thermally sealed storage container of claim 10, wherein the vapor control unit comprises:

a mechanical controller; and a valve operably connected to the mechanical controller.

18. The substantially thermally sealed storage container of claim 10, comprising:

at least one temperature sensor positioned within the vapor conduit;

a controller operably connected to the at least one temperature sensor; and a valve operably connected to the controller.

19. A substantially thermally sealed storage container, comprising:

an outer wall substantially defining a substantially thermally sealed storage container, the outer wall substantially defining a single outer wall aperture;

at least one desiccant unit external to the outer wall, the desiccant unit including at least one aperture;

an interior wall substantially defining a thermally-controlled storage area within the container, the interior wall substantially defining a single interior wall aperture;

the interior wall and the outer wall separated by a distance and substantially defining a gas-sealed gap;

a connector forming an access conduit connecting the single outer wall aperture with the single interior wall aperture;

a single access aperture to the thermally-controlled storage area, wherein the single access aperture is defined by an end of the access conduit;

a primary vapor conduit positioned substantially within the access conduit, the primary vapor conduit including a first end and a second end, the first end traversing the at least one aperture in the interior wall, the second end sealed to the at least one aperture of the desiccant unit;

a primary vapor control unit attached to the primary vapor conduit;

a first inner wall and a second inner wall each attached to the interior wall, the inner walls positioned to form a first liquid-impermeable gap between the first and second inner walls, the first and second inner walls forming a floor to a first storage region in the thermally-controlled storage area;

an aperture in the first inner wall;

a first regional vapor conduit including a first end and a second end, the first end sealed to the primary vapor conduit, the second end sealed to the aperture in the first inner wall;

a first regional vapor control unit attached to the first regional vapor conduit;

a third inner wall attached to the interior wall, the third inner wall positioned to form a second liquid-impermeable gap between the third inner wall and the interior wall, the third inner wall forming a floor to a second storage region in the thermally-controlled storage area;

an aperture in the third inner wall;

a second regional vapor conduit including a first end and a second end, the first end sealed to the primary vapor conduit, the second end sealed to the aperture in the third inner wall; and a second regional vapor control unit attached to the second regional vapor conduit.

20. The substantially thermally sealed storage container of claim 19, wherein the desiccant unit comprises:

a vapor-sealed chamber including an interior desiccant region in vapor contact with an interior region of the vapor conduit.

21. The substantially thermally sealed storage container of claim 19, wherein the desiccant unit comprises:

a gas vent mechanism configured to allow gas with pressure beyond a preset limit to vent externally from the desiccant unit.

22. The substantially thermally sealed storage container of claim 19, wherein the desiccant unit comprises:

a gas vent mechanism configured to allow gas of a temperature beyond a preset limit to vent externally from the desiccant unit.

23. The substantially thermally sealed storage container of claim 19, wherein the desiccant unit comprises:

a heating element within the desiccant unit, the heating element configured to heat an internal, liquid-impermeable chamber of the desiccant unit.

24. The substantially thermally sealed storage container of claim 19, wherein the primary vapor control unit comprises:

at least one movable valve with at least a first position substantially closing the at least one movable valve to vapor flow through the at least one movable valve, and a second position substantially opening the at least one movable valve to vapor flow through the at least one movable valve.

25. The substantially thermally sealed storage container of claim 19, wherein the primary vapor control unit comprises:

a sensor positioned within the primary vapor conduit;

an controller operably connected to the temperature sensor; and a valve operably connected to the controller.

26. The substantially thermally sealed storage container of claim 19, wherein the primary vapor control unit is operably attached to the first regional vapor control unit and the second regional vapor control unit.

27. The substantially thermally sealed storage container of claim 19, wherein the first regional vapor control unit comprises:

a sensor;

a controller; and a valve operably connected to the controller.

28. The substantially thermally sealed storage container of claim 19, wherein the second regional vapor control unit comprises:

a sensor;

a controller operably connected to the sensor; and a valve operably connected to the controller.

29. The substantially thermally sealed storage container of claim 19, comprising:

the primary vapor control unit including a thermocouple unit configured to respond to the temperature of vapor in the primary vapor conduit, a valve configured to regulate vapor flow through the primary vapor conduit, and a primary controller operably connected to the thermocouple unit and to the valve;

the first regional vapor control unit including a thermocouple unit configured to respond to the temperature of vapor in the first regional vapor conduit, a valve configured to regulate vapor flow through the first regional vapor conduit, and a connection to the primary controller; and the second regional vapor control unit including a thermocouple unit configured to respond to the temperature of vapor in the second regional vapor conduit, a valve configured to regulate vapor flow through the second regional vapor conduit, and a connection to the primary controller.

30. A substantially thermally sealed storage container, comprising:

an outer wall substantially defining a substantially thermally sealed storage container, the outer wall substantially defining a single outer wall aperture;

an interior wall substantially defining a thermally-controlled storage region, the interior wall substantially defining a single interior wall aperture;

the interior wall and the outer wall separated by a distance and substantially defining a gas-sealed gap;

at least one section of ultra efficient insulation material disposed within the gas-sealed gap;

a connector forming an access conduit connecting the single outer wall aperture with the single interior wall aperture;

a single access aperture to the thermally-controlled storage region, wherein the single access aperture is defined by an end of the access conduit;

at least one inner wall, the inner wall sealed to the interior wall along at least one junction, the inner wall and the interior wall separated by a distance and substantially defining a liquid-impermeable gap;

an aperture in the at least one inner wall;

a primary vapor conduit, including an integral vapor control unit, positioned substantially within the access conduit, the primary vapor conduit including a first end and a second end, the first end sealed to the aperture in the at least one inner wall;

a vapor conduit junction attached to the second end of the primary vapor conduit;

at least two desiccant units external to the outer wall, each of the desiccant units including at least one aperture; and at least two secondary vapor conduits including a first end and a second end, the first end attached to the vapor conduit junction, the second end attached to an aperture in a desiccant unit, and each of the at least two secondary vapor conduits including an externally-operable valve.

31. The substantially thermally sealed storage container of claim 30, wherein the integral vapor control unit to the primary vapor conduit comprises:

a sensor;

a controller operably connected to the sensor; and a valve operably connected to the electronic controller.

32. The substantially thermally sealed storage container of claim 30, wherein the integral vapor control unit to the primary vapor conduit comprises:

a controller, the controller operably connected to a valve within the integral vapor control unit.

33. The substantially thermally sealed storage container of claim 30, wherein the integral vapor control unit to the primary vapor conduit comprises:

a thermocouple unit configured to respond to the temperature of vapor in the primary vapor conduit;

a valve configured to regulate vapor flow through the primary vapor conduit; and a controller operably connected to the thermocouple unit and to the valve.

34. The substantially thermally sealed storage container of claim 30, wherein each of the desiccant units comprises:

a vapor-impermeable region within the desiccant unit, the vapor-impermeable region in vapor contact with the interior of an attached secondary vapor conduit.

35. The substantially thermally sealed storage container of claim 30, wherein each of the desiccant units comprises:

a gas vent mechanism configured to allow gas with pressure beyond a preset limit to vent externally from the desiccant unit.

36. The substantially thermally sealed storage container of claim 30, wherein the externally-operable valve included in the secondary vapor conduit comprises:

a externally-operable valve configured to substantially eliminate gas flow through the secondary vapor conduit.

37. The substantially thermally sealed storage container of claim 30, wherein the second end of each of the at least two secondary vapor conduits is reversibly attachable to each of the apertures in the desiccant units.

38. The substantially thermally sealed storage container of claim 30, comprising:

a user input device operably attached to the primary vapor control unit.

* * * * *